US009205659B2

(12) United States Patent
Ishizawa et al.

(10) Patent No.: US 9,205,659 B2
(45) Date of Patent: Dec. 8, 2015

(54) LIQUID CONTAINER AND FILLING METHOD

(71) Applicant: SEIKO EPSON CORPORATION, Tokyo (JP)

(72) Inventors: Taku Ishizawa, Nagano (JP); Hiroyuki Kawate, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/657,201

(22) Filed: Mar. 13, 2015

(65) Prior Publication Data

US 2015/0258802 A1 Sep. 17, 2015

(30) Foreign Application Priority Data

Mar. 14, 2014 (JP) ..... 2014-051104

(51) Int. Cl.
*B41J 2/175* (2006.01)

(52) U.S. Cl.
CPC ..... *B41J 2/17513* (2013.01); *B41J 2/17506* (2013.01); *B41J 2002/17516* (2013.01)

(58) Field of Classification Search
CPC .... B41J 2/175; B41J 2/17513; B41J 2/17523; B41J 2/17559
USPC ..... 347/85, 86; 383/9, 26, 28, 56
See application file for complete search history.

(56) References Cited

FOREIGN PATENT DOCUMENTS

JP 2004-338146 A 12/2004
JP 2008-114506 A 5/2008

*Primary Examiner* — Anh T. N. Vo
(74) *Attorney, Agent, or Firm* — Global IP Counselors, LLP

(57) ABSTRACT

A liquid container includes a liquid containing bag which contains a liquid and has at least two sheets of flexible film, and a liquid supply portion which supplies the liquid to a liquid consuming apparatus. The liquid supply portion is welded with the two sheets of film at one end of the liquid containing bag, and has a liquid supply path, a first chamber, and a second chamber. The first chamber communicates with the liquid supply path and an interior of the liquid containing bag. The second chamber communicates with the interior of the liquid supply portion. The first chamber is partitioned by a first rib, and the second chamber is partitioned from the first chamber by a second rib separated from the first rib. The first chamber communicates with the second chamber via a gap between the second rib and the one sheet of film.

9 Claims, 58 Drawing Sheets

PARTIAL CROSS SECTIONAL DIAGRAM ALONG 18a-18a

LIQUID CONTAINER AND FILLING METHOD

CROSS-REFERENCE TO RELATED APPLICATIONS

This application claims priority to Japanese Patent Application No. 2014-051104 filed on Mar. 14, 2014. The entire disclosure of Japanese Patent Application No. 2014-051104 is hereby incorporated herein by reference.

BACKGROUND

1. Technical Field

The present invention relates to injecting liquid into a containing body.

2. Related Art

A type of ink cartridge (a liquid container) is known where ink is contained in a bag which has flexibility. The bag is formed by, for example, welding a plurality of films at their end portions.

The ink cartridge is for supplying ink to a printer and ink is injected during manufacturing. Filling is implemented from, for example, an ink supply port as a reverse flow to the flow when supplying ink to a printer. A technique is known where a bypass is provided separately to an ink supply flow path when in use in order improve the speed of filling. The bypass is a flow path which links the supply port and an interior of the ink cartridge and is sealed due to welding after filling of ink (for example, Japanese Unexamined Patent Application Publication No. 2008-114506).

Other than this, a technique is known where a through hole for filling ink is provided separately to the supply port. The through hole is sealed due to welding after filling of ink (for example, Japanese Unexamined Patent Application Publication No. 2004-338146).

The problem which the invention in the present application attempts to solve is to reduce the possibility that ink leaks from a portion which is welded while simplifying the structure of an ink cartridge. A portion which is welded which is implemented in order to form the bag is welded again in a process to seal the bypass in the case of Japanese Unexamined Patent Application Publication No. 2008-114506. The film excessively melts when the same portion is welded a plurality of times in this manner and it is easy for ink to leak.

The structure becomes complicated since the through hole is provided separately to the supply port in the case of Japanese Unexamined Patent Application Publication No. 2004-338146.

Other than this, a reduction in size, a reduction in costs, a reduction in materials, an increase in the ease of manufacture, an improvement in usability, and the like are desirable for the apparatus.

SUMMARY

The present invention is for solving at least one of the problems described above and is able to be realized as the following aspects.

(1) According to an aspect of the present invention, a liquid container includes a liquid containing bag configured and arranged to contain a liquid, the liquid containing bag having at least two sheets of film which are flexible, and a liquid supply portion configured and arranged to supply the liquid to a liquid consuming apparatus. The liquid supply portion is welded with each of the two sheets of film at one end of the liquid containing bag. The liquid supply portion has a liquid supply path, a first chamber and a second chamber in the liquid supply portion. The first chamber communicates with the liquid supply path and with an interior of the liquid containing bag. The second chamber communicates with the interior of the liquid containing bag. The first chamber is partitioned by a first rib, an end surface of the first rib opposing one sheet of film out of the two sheets of film and being welded with the film. The second chamber is partitioned from the first chamber by a second rib, an end surface of the second rib opposing the one sheet of film and being configured to be welded to the film. The first chamber communicates with the second chamber via a gap between the second rib and the one sheet of film. The second rib is separated from the first rib. According to this aspect, it is possible to inject liquid into a flow path, which reaches from the first chamber to the liquid containing bag via the second chamber, other than a flow path which communicates from the first chamber to the interior of the liquid containing bag since the first chamber and the second chamber communicate via the gap between the end surface of the second rib and the film. For this reason, filling of liquid from the liquid supply portion into the interior of the liquid containing bag is easier. The possibility of the first rib or another section for welding being welded a plurality of times is reduced in a case where the second rib and the film are welded after filling of liquid since the second rib is separated from the first rib. As a result, not only is the possibility of the films peeling reduced but leaking of liquid is suppressed. Additionally, it is not necessary for an filling port to be separately provided in the liquid container of this aspect.

(2) In the aspect described above, a first flow path and a second flow path are formed, the first flow path communicating from the first chamber to the interior of the liquid containing bag, and the second flow path communicating from the first chamber to the interior of the liquid containing bag via the second chamber. According to this aspect, since it is possible to inject liquid using the first flow path and the second flow path, filling of liquid is easier compared to a case where only one of the flow paths is used. Furthermore, it is possible to inject liquid even in a case where a check valve which prevents inflow of liquid from the liquid supply path to the inside of the liquid containing bag, is provided in the first flow path.

(3) In the aspect described above, an opening portion of the second flow path which communicates with the interior of the liquid containing bag is arranged closer to the one end than an opening portion of the first flow path in the liquid containing bag. According to this aspect, discharging of gas which is retained in an upper portion inside the liquid containing bag is easier by liquid being discharged due to the liquid supply portion being positioned upper than the liquid containing bag in the direction of gravity.

(4) In the aspect described above, the liquid container further includes a filter which is provided in the first flow path. According to this aspect, liquid in the liquid containing bag is supplied via the filter in a case where the second flow path is blocked off after filling of liquid. For this reason, outflow of foreign matter inside the liquid containing bag is suppressed. Here, an increase in flow path resistance during filling is suppressed since the second flow path functions as an filling flow path even when the filter is arranged on the first flow path.

(5) In the aspect described above, the liquid container further includes a flow path member whose one end is connected with regard to an end portion of the first flow path in the liquid containing bag. The other end of the flow path member is positioned lower than the one end in the direction of gravity. According to this aspect, it is possible to reduce the amount of remaining liquid due to the flow path member being provided. Here, an increase in flow path resistance during filling is suppressed since the second flow path functions as an filling flow path even when flow path resistance in the first flow path increases due to the flow path member. Additionally, discharging of gas which is retained in an upper portion inside the liquid containing bag is easier in a case where liquid is injected due to the liquid supply portion being positioned upper than the liquid containing bag in the direction of gravity due to the second flow path being provided even when the flow path member is provided.

(6) In the aspect described above, a protrusion is provided on the end surface of the second rib. According to this aspect, the gap between the second rib and the films is enlarged due to the protrusion and it is easy for liquid to flow into the gap.

(7) As another aspect, there is provided a method for filling liquid into the liquid container of the aspect described above. The filling method includes filling liquid from the liquid supply path to the interior of the liquid containing bag via the first chamber and filling liquid from the liquid supply path to the interior of the liquid containing bag via the first chamber and the second chamber, and welding the end surface of the second rib and the film by melting the protrusion. According to this aspect, it is possible to easily inject liquid to the inside of the liquid containing bag. Additionally, the possibility of the first rib or another section for welding being welded a plurality of times is reduced when the second rib and the films are welded after filling of liquid since the second rib is separated from the first rib. As a result, the possibility of the films peeling is reduced and leaking of liquid is suppressed.

(8) The method of the aspect described above further includes discharging gas in the liquid supply path from the interior of the liquid containing bag via the second chamber and the first chamber after the filling of liquid and before the welding. According to this aspect, it is possible to supply liquid where the amount of gas which is contained is low to a liquid consuming apparatus since it is possible to discharge gas inside the liquid containing bag.

(9) As another aspect, a liquid container includes a liquid containing bag configured and arranged to contain a liquid, the liquid containing bag having at least two sheets of film which are flexible, and a liquid supply portion configured and arranged to supply the liquid to a liquid consuming apparatus. The liquid supply portion is welded with each of the two sheets of film at one end of the liquid containing bag. The liquid supply portion has a liquid supply path, a first chamber which communicates with the liquid supply path and an interior of the liquid containing bag, and a second chamber which communicates with the interior of the liquid supply portion in the liquid supply portion. The first chamber is partitioned by a first rib, an end surface of the first rib being welded to one sheet of film out of the two sheets of film. The second chamber is partitioned from the first chamber by a second rib, an end surface of the second rib being welded to the one sheet of film. The second rib is separated from the first rib.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Configuration of Liquid Ejecting System 1000

Figure 1:
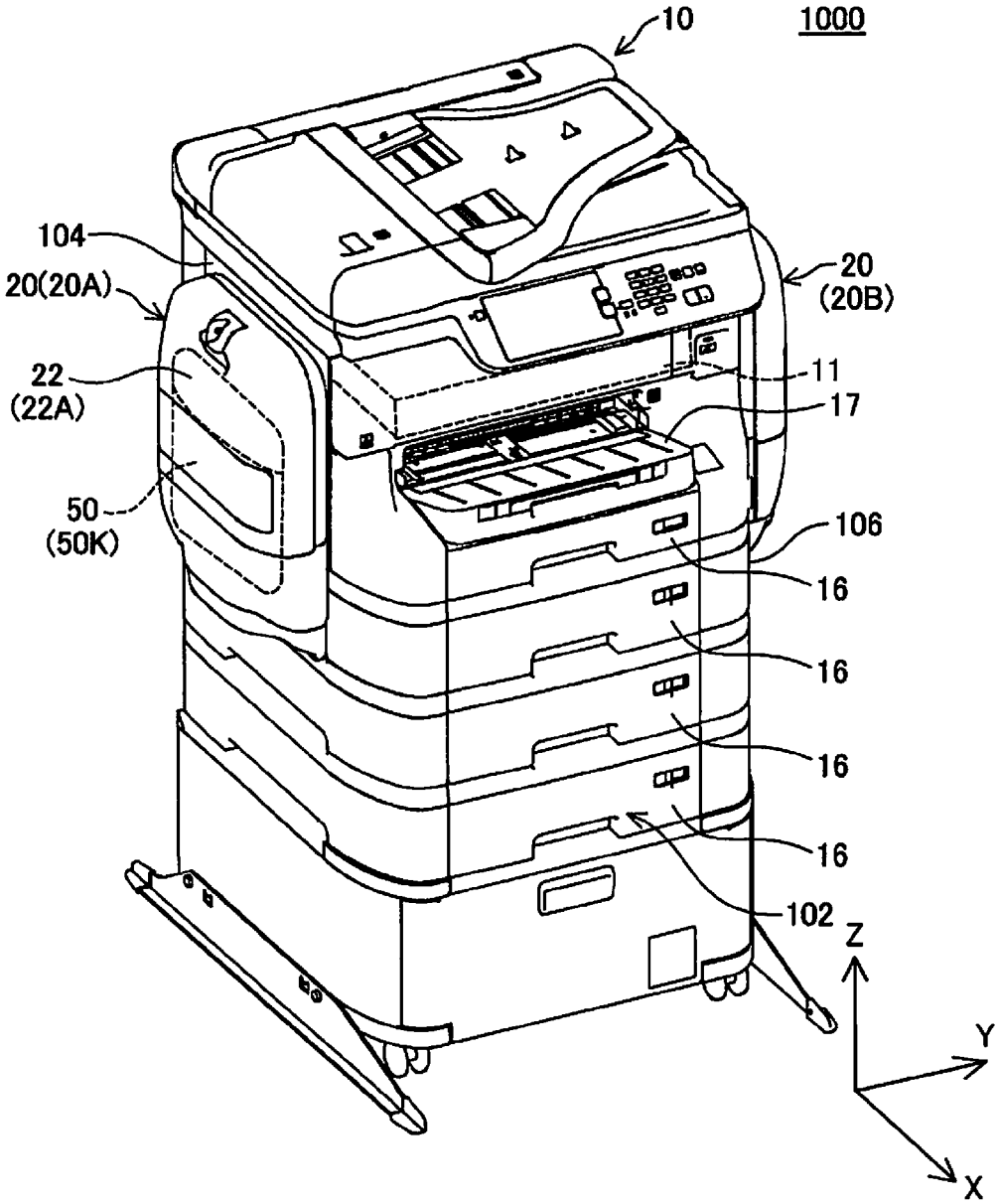
FIG. 1 is a perspective diagram illustrating the outer appearance of a liquid ejecting system.
Figure 2:
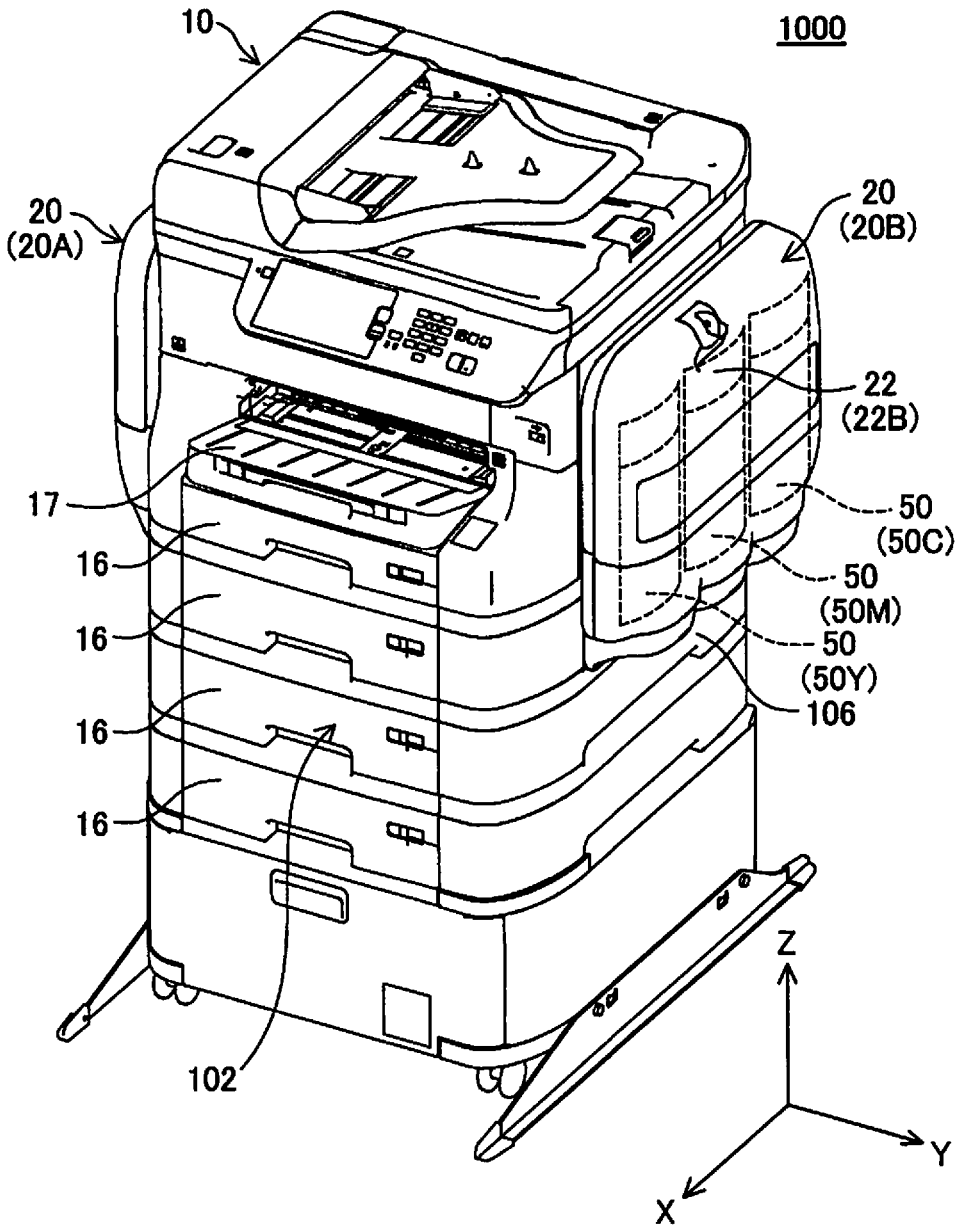
FIG. 2 is a perspective diagram illustrating the outer appearance of a liquid ejecting system.

FIG. 1 and FIG. 2 are perspective diagrams illustrating the outer appearance of a liquid ejecting system 1000. As shown in FIG. 1, the liquid ejecting system 1000 is provided with a printer 10 and two liquid supply apparatuses 20. The two liquid supply apparatuses 20 are respectively provided on both sides of the printer 10. The printer 10 is placed on a horizontal plane in a state of being used in the liquid ejecting system 1000. The XY plane is the horizontal plane and the Z axis direction is the direction of gravity. A positive orientation in the Z axis direction is upwards in the direction of gravity and a negative orientation in the Z axis direction is downwards in the direction of gravity. Below, the positive orientation in the Z axis direction is written as "+Z axis direction" and the negative orientation in the Z axis direction is written as the "−Z axis direction". Other axes (the X axis and the Y axis, and a K1 axis and a K2 axis which will be described later) are also written in the same manner.

The liquid supply apparatus 20 supplies ink to the printer 10. It is possible for a liquid container 50 (refer to FIG. 6 and the like) which is provided in the liquid supply apparatus 20 to be connected (mounted) so as to able to be attached and detached with regard to the printer 10.

The printer 10 is an ink jet printer. The printer 10 is provided with a recording mechanism 11, a plurality of paper supply trays 16, and a discharge tray 17. The plurality of paper supply trays 16 are provided at positions which are different from each other in the Z axis direction. The paper supply trays 16 are provided on a first apparatus-surface 102 of the printer 10. A recording medium, (for example, paper sheets) where an image such as characters is printed (recorded) by the printer 10, is contained in the paper supply trays 16.

The recording mechanism 11 is provided with a recording head (which is not shown in the drawings) which discharges ink. The recording head communicates with the liquid supply apparatus 20 via a flow path pipe such as a tube. The recording head performs recording (printing) by discharging ink onto a recording medium using ink which is supplied from the liquid supply apparatus 20. The recording medium which is recorded on is discharged to the discharge tray 17.

The two liquid supply apparatuses 20 are provided on a second apparatus-surface 104 and a third apparatus-surface 106 which intersect with the first apparatus-surface 102 of the printer 10. The first apparatus-surface 102, the second apparatus-surface 104, and the third apparatus-surface 106 are each surfaces which are substantially perpendicular with regard to a placement surface in a state where the printer 10 is being used. The liquid supply apparatus 20 which is provided on the second apparatus-surface 104 is also referred to as a "first liquid supply apparatus 20A" and the liquid supply apparatus 20 which is provided on the third apparatus-surface 106 is referred to as a "second liquid supply apparatus 20B". In a case where the first and second liquid supply apparatuses 20A and 20B are used without needing to be distinguishable, the liquid supply apparatuses 20A and 20B are simply referred to as the "liquid supply apparatus 20".

Figure 3:
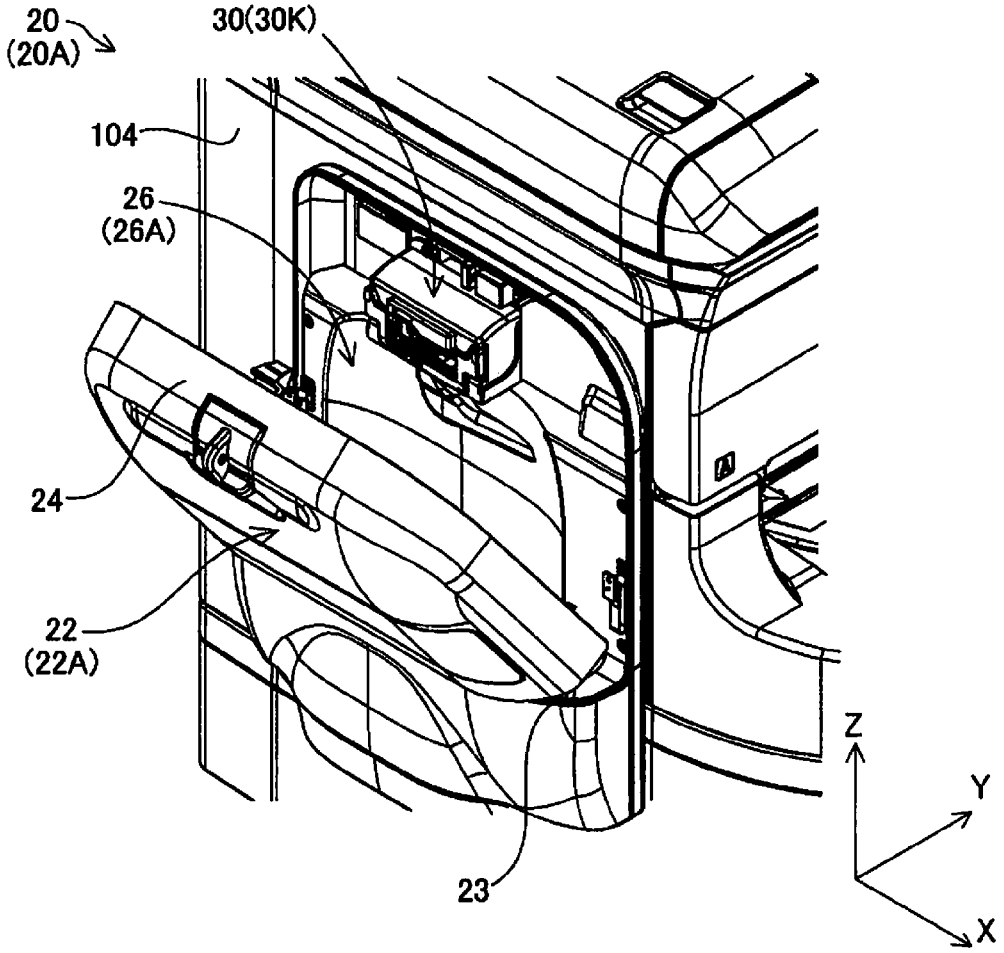
FIG. 3 is a diagram describing containing of a liquid container.

As shown in FIG. 1, the first liquid supply apparatus 20A is provided with one cover member 22, one liquid container 50 (refer to FIG. 6 and FIG. 7), and one attaching and detaching unit 30 (refer to FIG. 3). In FIG. 2, the liquid container 50 is not shown in the drawings since it is covered by the cover member 22. As shown in FIG. 2, the second liquid supply apparatus 20B is provided with one cover member 22, three liquid containing bodies 50, and three attaching and detaching units 30 which respectively correspond to the liquid containing bodies 50 (refer to FIG. 4). Below, reference numerals "22A" and "22B" are used in a case of the cover members 22 being used so as to be distinguishable. Reference numerals "50K", "50C", "50M", and "50Y" are used in a case of the four liquid containing bodies 50 being used so as to be distinguishable. Reference numerals "30K", "30C", "30M", and "30Y" are used in a case of the four attaching and detaching units 30 being used so as to be distinguishable.

The four liquid containing bodies 50 contain ink of colors which are each different to each other. In the first embodiment, inks of yellow (Y), magenta (M), cyan (C), and black (K) are respectively contained in the liquid containing bodies 50 which are different. The liquid container 50K contains black ink, the liquid container 50C contains cyan ink, the liquid container 50M contains magenta ink, and the liquid container 50Y contains yellow ink.

Figure 4:
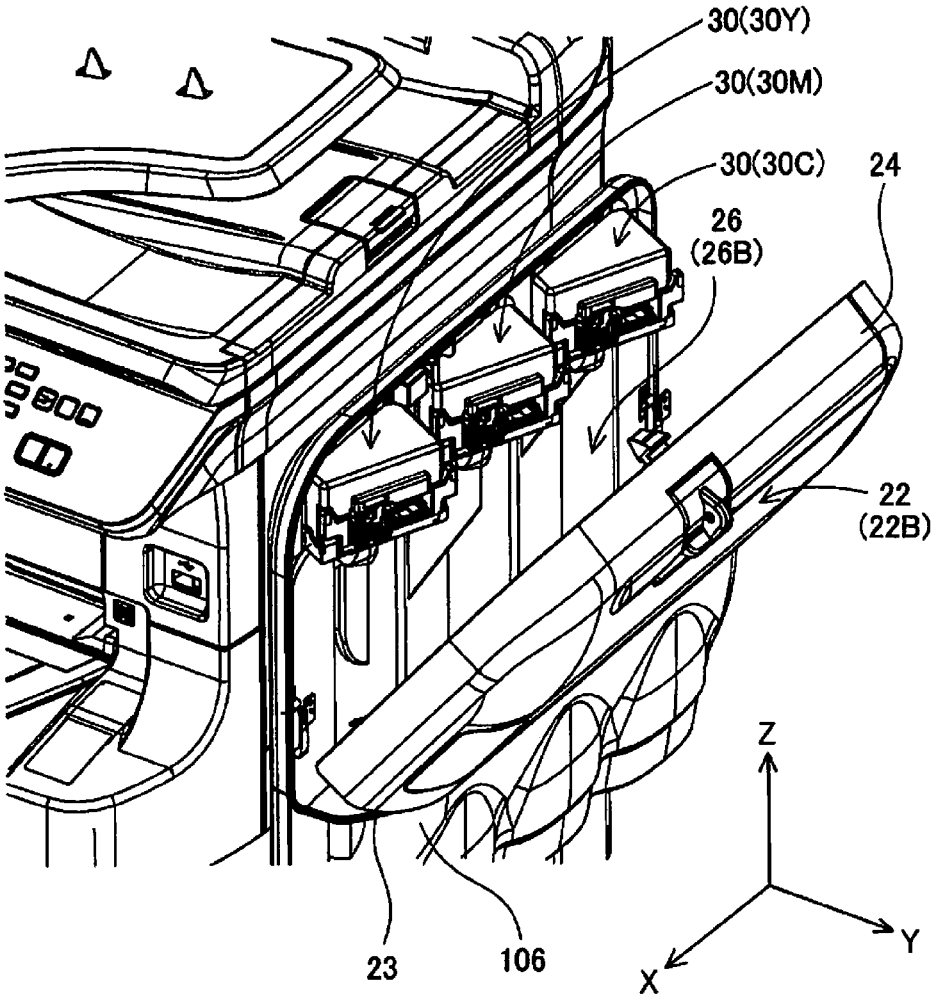
FIG. 4 is a diagram describing containing of a liquid container.

FIG. 3 and FIG. 4 are diagrams describing containing of the liquid container 50. FIG. 3 and FIG. 4 illustrate a state where the liquid container 50 is removed. As shown in FIG. 3 and FIG. 4, the liquid containing bodies 50 are contained in containing space sections 26 which are partitioned by the cover members 22. In detail, the liquid container 50K is contained in a containing space section 26A (FIG. 3) and the liquid containing bodies 50C, 50M, and 50Y are contained in a containing space section 26B (FIG. 4). Here, a state is shown where the attaching and detaching unit 30 shown in FIG. 3 and FIG. 4 is pushing against a movable member 40 (refer to FIG. 37 to FIG. 42). The movable member 40 is in a state of being pulled out in a case where the liquid container 50 is mounted.

The liquid container 50 is mounted in the attaching and detaching unit 30 shown in FIG. 3 and FIG. 4 so as to be freely attached and detached. The attaching and detaching unit 30K is arranged at the inner side of the cover member 22A. The attaching and detaching units 30C, 30M, and 30Y are arranged at the inner side of the cover member 22B. As shown in FIG. 3, the attaching and detaching unit 30K is provided on the second apparatus-surface 104 of the printer 10. As shown in FIG. 4, the attaching and detaching units 30C, 30M, and 30Y are provided on the third apparatus-surface 106 of the printer 10. Ink which is contained in the liquid container 50 is supplied to the recording head of the printer 10 in a case where the liquid container 50 is mounted in the attaching and detaching unit 30.

The cover member 22 is configured to as to be freely opened and closed. As shown in FIG. 3 and FIG. 4, opening and closing are realized by rotating an other end portion 24 which is on the +Z axis direction side with a one end portion 23 which is on the −Z axis direction side as a support point. When the cover member 22 is open, an upper portion is open and it is possible to remove the liquid container 50 from the attaching and detaching unit 30 in an upward direction and to mount the liquid container 50 into the attaching and detaching unit 30 from an upward direction. The liquid container 50 is replaced in a case where the remaining amount of ink which is contained in the liquid container 50 is negligible. Replacing is realized by a user opening the cover member 22, mounting the liquid container 50 which is new in the attaching and detaching unit 30, and closing the cover member 22.

Figure 5:
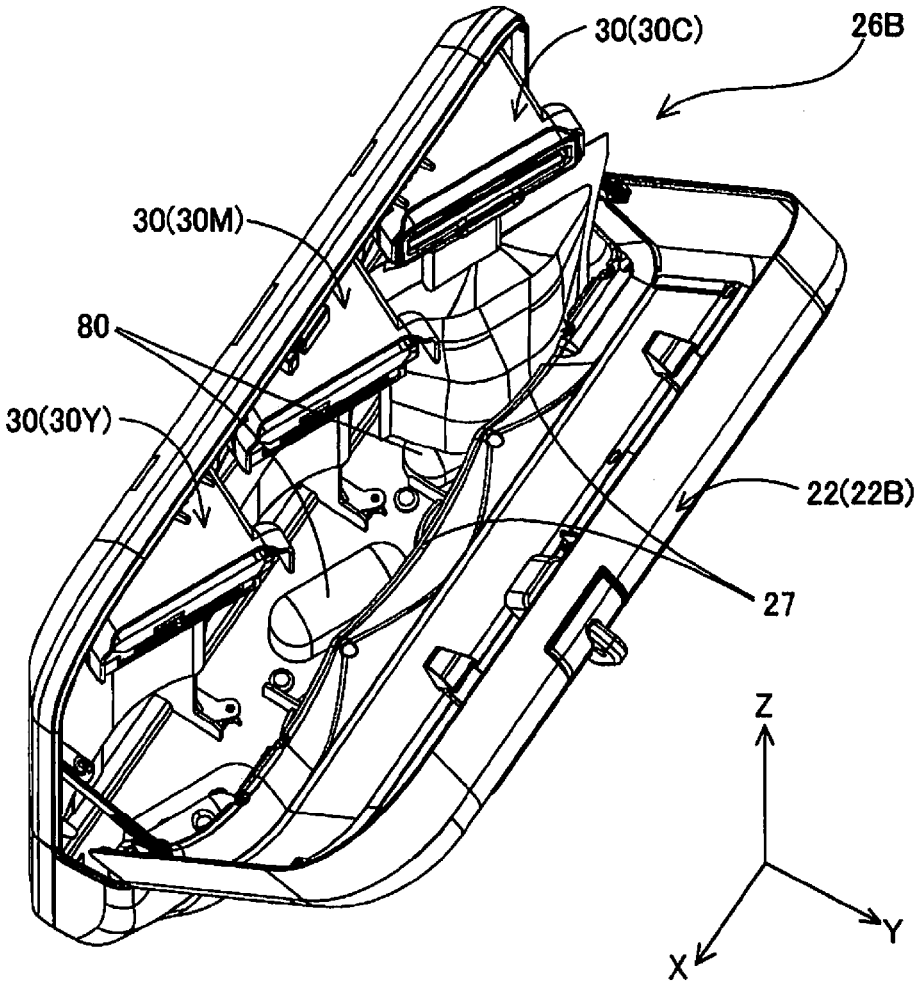
FIG. 5 is a perspective diagram illustrating a containing space section.

FIG. 5 is a perspective diagram illustrating the containing space section 26B (a containing part). FIG. 5 illustrates a state where the liquid container 50C is contained in the containing space section 26B. As shown in FIG. 5, the containing space section 26B is provided with a guide section 27 and an contacting part 80. The guide section 27 and the contacting part 80 are provided in each of the three attaching and detaching units 30. The contacting part 80 is provided integrally with the containing space section 26B. The contacting part 80 abuts with the liquid container 50 in a state where the liquid container 50 is mounted in the attaching and detaching unit 30. The contacting part 80 is a convex shape which is curved (a convex curved surface) as shown in FIG. 5 or a protrusion in order to suppress damage to the liquid container 50. The contacting part 80 will be described later along with FIG. 44 to FIG. 50.

When a user inserts the liquid container 50 into the containing space section 26B from the outside, the guide section 27 guides the insertion of the liquid container 50. Guiding is executed such that a third film 523 (refer to FIG. 6), which is at a bottom portion of the liquid container 50, abuts with the contacting part 80. The guide section 27 has a concave shape, which is curved as shown in FIG. 5, in order to carry out guiding. Here, the containing space section 26A is also provided with the guide section 27 and the contacting part 80 in the same manner as the containing space section 26B.

Configuration of Liquid Container 50

Figure 6:
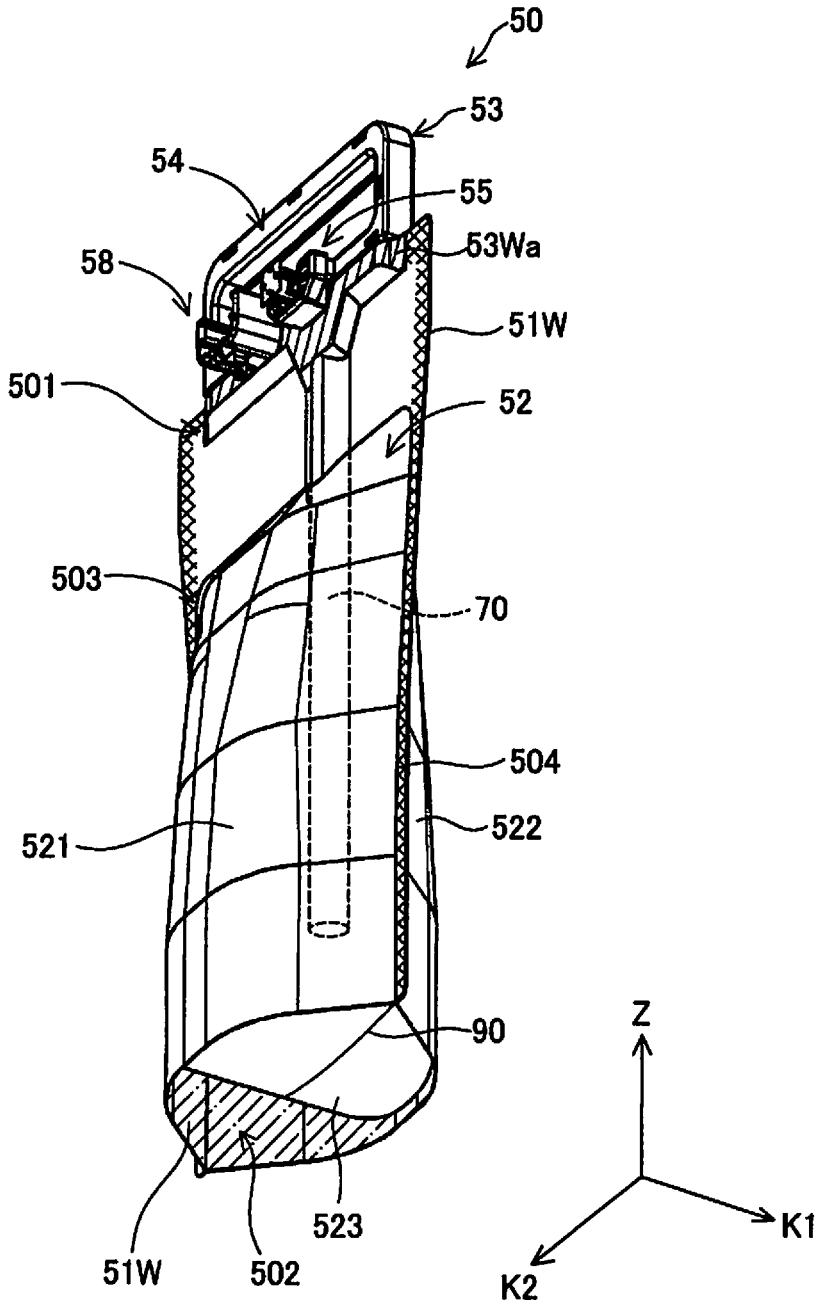
FIG. 6 is a perspective diagram illustrating the outer appearance of a liquid container.
Figure 7:
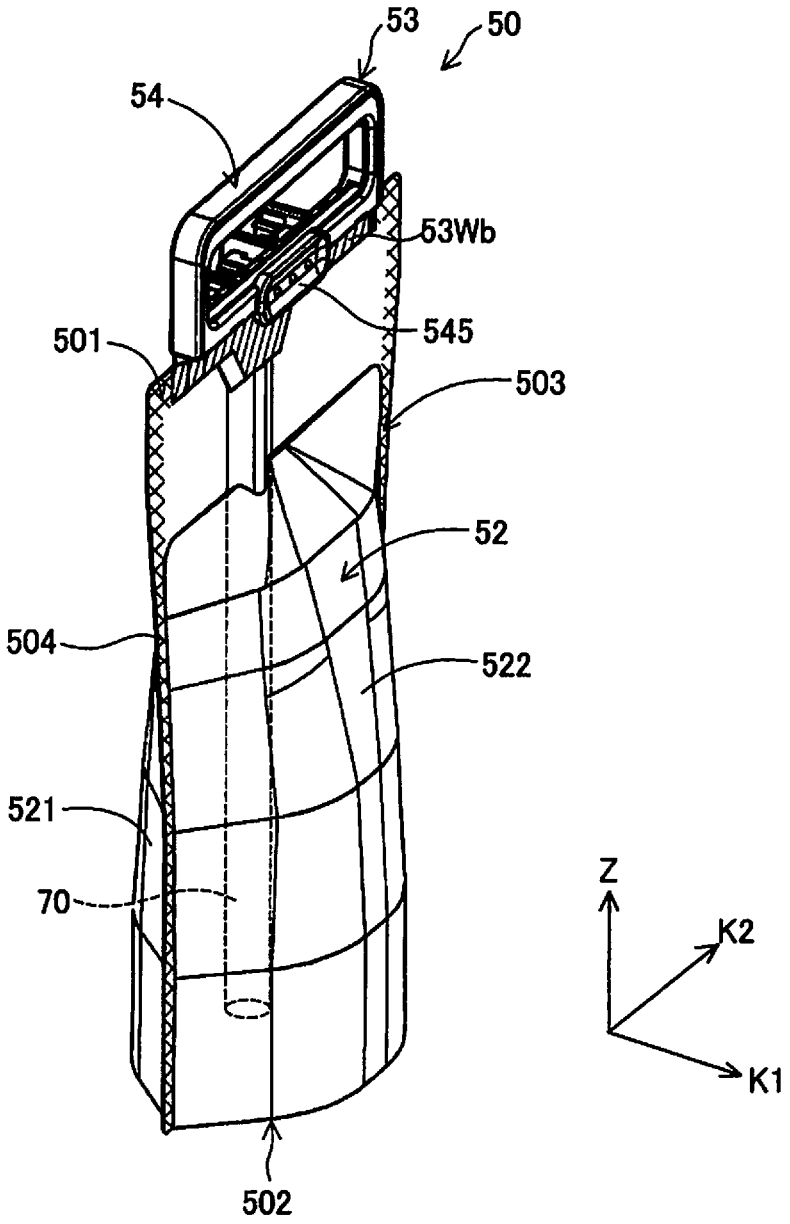
FIG. 7 is a perspective diagram illustrating the outer appearance of a liquid container.
Figure 8:
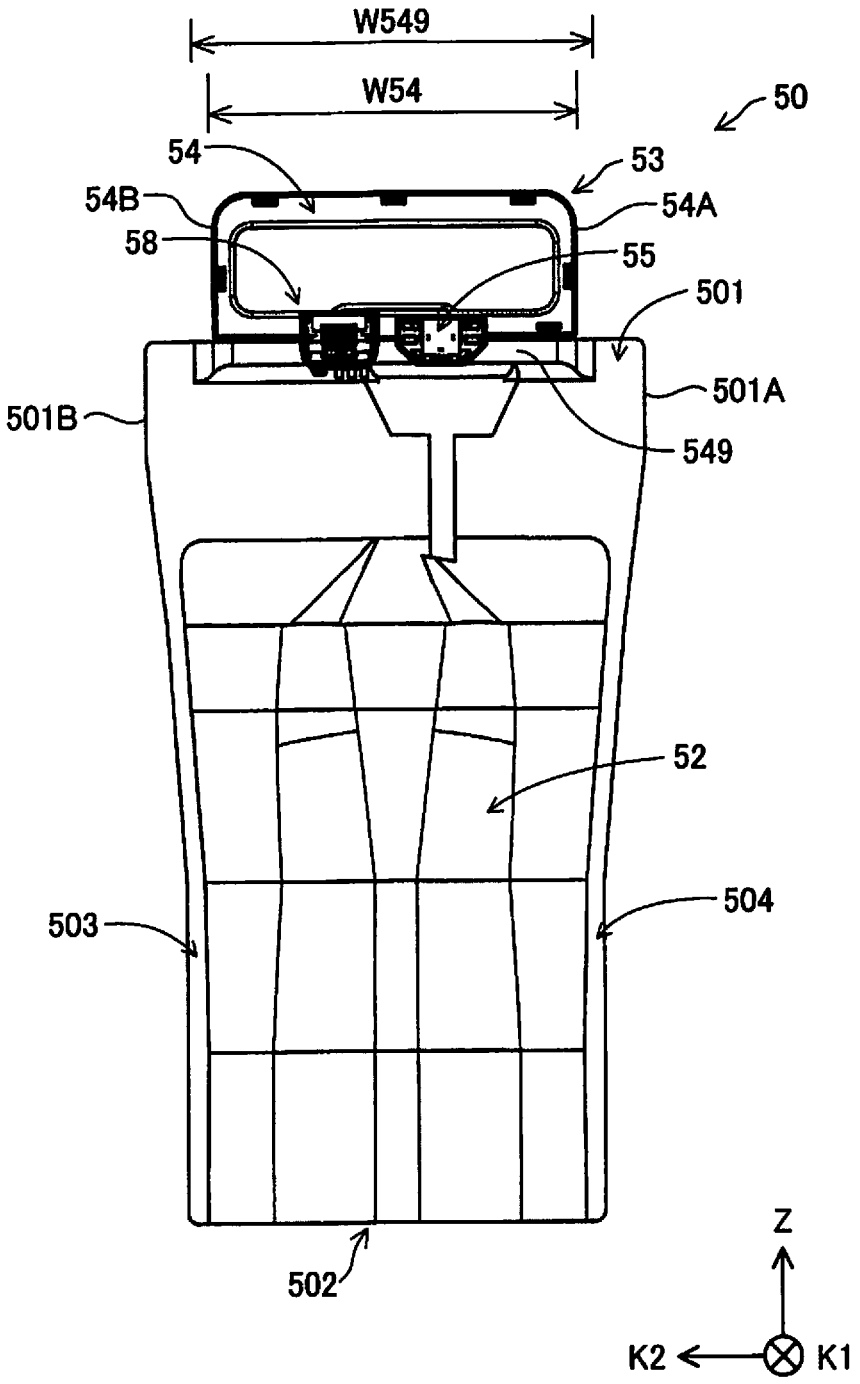
FIG. 8 is a front surface diagram illustrating the outer appearance of a liquid container.

FIG. 6 and FIG. 7 are perspective diagrams illustrating the outer appearance of the liquid container 50. FIG. 8 is a front surface diagram illustrating the outer appearance of the liquid container 50. FIG. 6, FIG. 7, and FIG. 8 illustrate the Z axis, a K1 axis, and a K2 axis in a state where the liquid container 50 is mounted in the attaching and detaching unit 30 (the mounting state). The Z axis is the same as the Z axis shown in FIG. 1 and FIG. 2.

FIG. 6 and FIG. 7 illustrate a state before the liquid container 50 is filled with ink and mounted in the attaching and detaching unit 30. As shown in FIG. 6 and FIG. 7, the liquid container 50 is provided with a liquid containing bag 52 and an operation member 53. The operation member 53 is provided with a grasping portion 54, a liquid supply unit 55, a substrate unit 58, and a pushing portion 545. The grasping portion 54 is a part for a user to grasp the liquid container 50.

It is possible for ink to be contained in the liquid containing bag 52. The liquid containing bag 52 is attached to the operation member 53 in a state where a bag surface is exposed. That is, the liquid containing bag 52 is not contained in a casing or the like and is configured such that it is possible for ink in the liquid containing bag 52 to be visually recognizable from the outside.

In the liquid containing bag 52, a side where the operation member 53 is attached is defined as a one end 501 and the opposite side to the one end 501 is defined as an other end 502. In the liquid containing bag 52, an end on the +K2 axis direction side is defined as a first side end 503 side and an end on the −K2 axis direction side is defined as a second side end 504 side.

As shown in FIG. 8, the liquid supply unit 55 and the substrate unit 58 are positioned on the one end 501 side of the liquid containing bag 52. As shown in FIG. 8, when viewing the liquid container 50 along the K1 axis direction, the liquid containing unit 55 and the substrate unit 58 are positioned so as to overlap with each other over at least a portion of the one end 501. That is, lower ends of each of the liquid supply unit 55 and the substrate unit 58 are positioned more to the −Z axis direction side than the upper end of the one end 501.

The liquid containing bag 52 has a first film 521, a second film 522 (FIG. 6), and the third film 523. The first to third films 521 to 523 partition space sections for containing ink at the inner side. As shown in FIG. 6 and FIG. 7, the first film 521 and the second film 522 configure a side surface of the liquid containing bag 52. As shown in FIG. 6, the third film 523 configures the bottom surface of the liquid containing bag 52. The first film 521 and the second film 522 are arranged so as face each other. A portion of circumferential regions 51W of the first film 521 and the second film 522 are welded to each other. In detail, out the circumferential regions 51W, the one end 501 side part, the first side end 503 side part, and the second side end 504 side part are welded. The cross hatching which is applied in FIG. 6 and FIG. 7 indicates parts where the first and second films 521 and 522 are welded.

Figure 15:
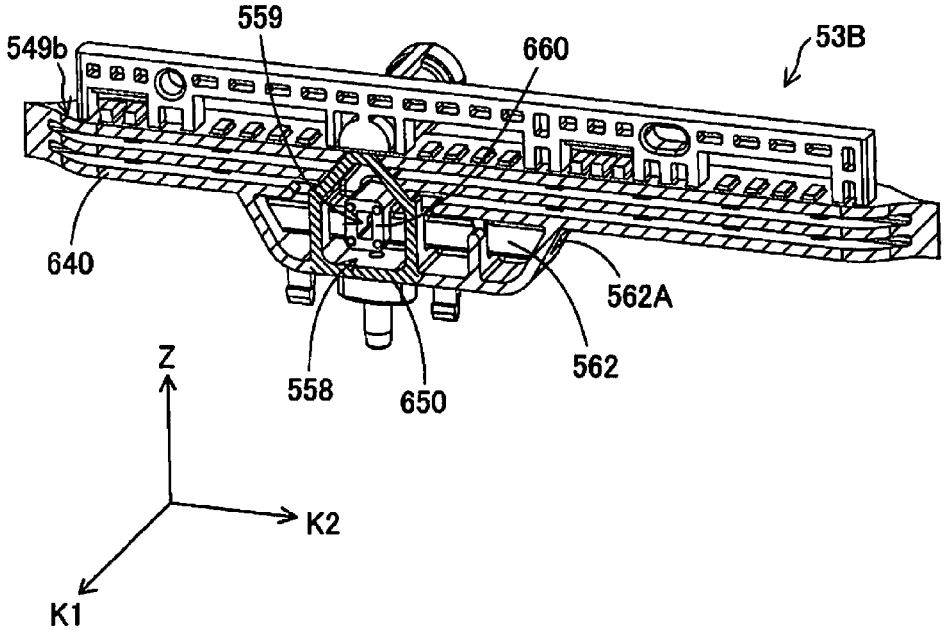
FIG. 15 is a perspective diagram of a liquid supply portion.
Figure 16:
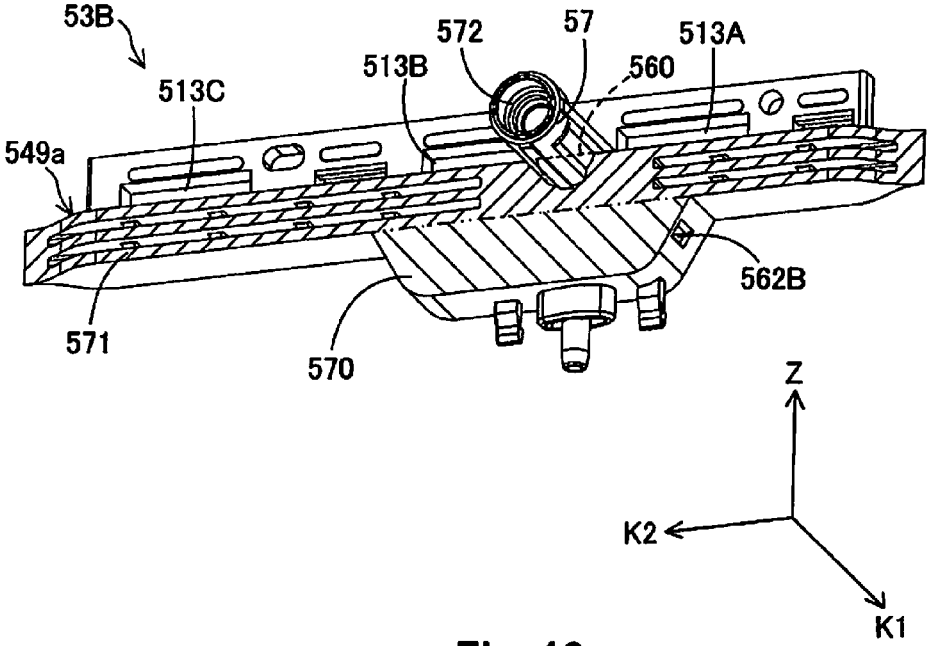
FIG. 16 is a perspective diagram of a liquid supply portion.

The one end 501 of the liquid containing bag 52 (in detail, one end of the first and second films 521 and 522) is welded to a joining portion 549 of the operation member 53 (refer to FIG. 15 and FIG. 16). In detail, a liquid supply portion (liquid supply structure) 53B of the operation member 53 is interposed between the first film 521 and the second film 522 which configure the one end portion 501 of the liquid containing bag 52, a joining portion 549*a* of the liquid supply portion 53B is joined to the inner side surface of the first film 521, and a joining portion 549*b* of the liquid supply portion 53B is joined to the inner side surface of the second film 522. In this manner, the operation member 53 is a member which is able to be attached to the one end 501 of the liquid containing bag 52. The solid line single hatching which is applied in FIG. 6 and FIG. 7 indicates a peripheral region 53W which is a part where the operation member 53 and the first and second films 521 and 522 are welded.

In the third film 523, the boundary region 51W of the third film 523 and a portion of the boundary region 51W of the first film 521 and the second film 522 are welded. The dashed line single hatching which is applied in FIG. 6 indicates a part where the third film 523 is welded with the first and second films 521 and 522. The third film 523 functions as a gusset portion.

The first to third films 521 to 523 each have flexibility. For example, polyethylene terephthalate (PET), nylon, polyethylene, and the like are used as materials for the first to third films 521 to 523. Due to the flexibility, the capacity of an interior of the liquid containing bag 52 is reduced in accompaniment with a reduction in the amount of ink which is contained.

The liquid container 50 has a flow path member 70 for ink, which is contained in the liquid containing bag 52, to flow into the liquid supply unit 55 (in detail, the liquid supply portion 53B which will be described later). The flow path member 70 is arranged at the inner side of the liquid containing bag 52.

The relationship between each section of the liquid container 50 will be described using FIG. 8. The width of the grasping portion 54 along the K2 axis direction of the one end 501 of the liquid containing bag 52 is a width W54. The width of the joining portion 549 along the K2 axis direction of the joining portion 549 is a width W549. The width W54 is the distance between the one end portion 54A and the other end portion 54B of the grasping portion 54 in the K2 axis direction. In this case, the width W54 is shorter than the width W549. The liquid supply unit 55 and the substrate unit 58 are positioned between both end portions 54A and 54B of the grasping portion 54 in the K2 axis direction.

Figure 9:
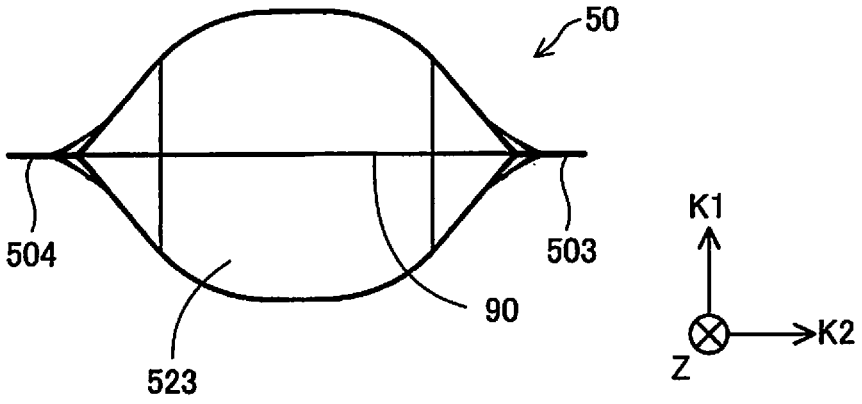
FIG. 9 is a bottom surface diagram illustrating the outer appearance of a liquid container.

FIG. 9 is a bottom surface diagram illustrating the outer appearance of the liquid container 50. As shown in FIG. 9, a fold 90 is applied to the third film 523. As shown in FIG. 9, the fold 90 is provided so as to link up the first side end 503 and the second side end 504. When the capacity of the interior of the liquid containing bag 52 is reduced, the third film 523 folds along the fold 90. The reduction of capacity of the interior of the liquid containing bag 52 smoothly progresses due to the third film 523 folding in this manner. As a result, the amount of remaining ink is reduced. The remaining ink is ink which remains in the liquid containing bag 52 which is detached (removed) when the liquid container 50 is replaced.

Figure 10:
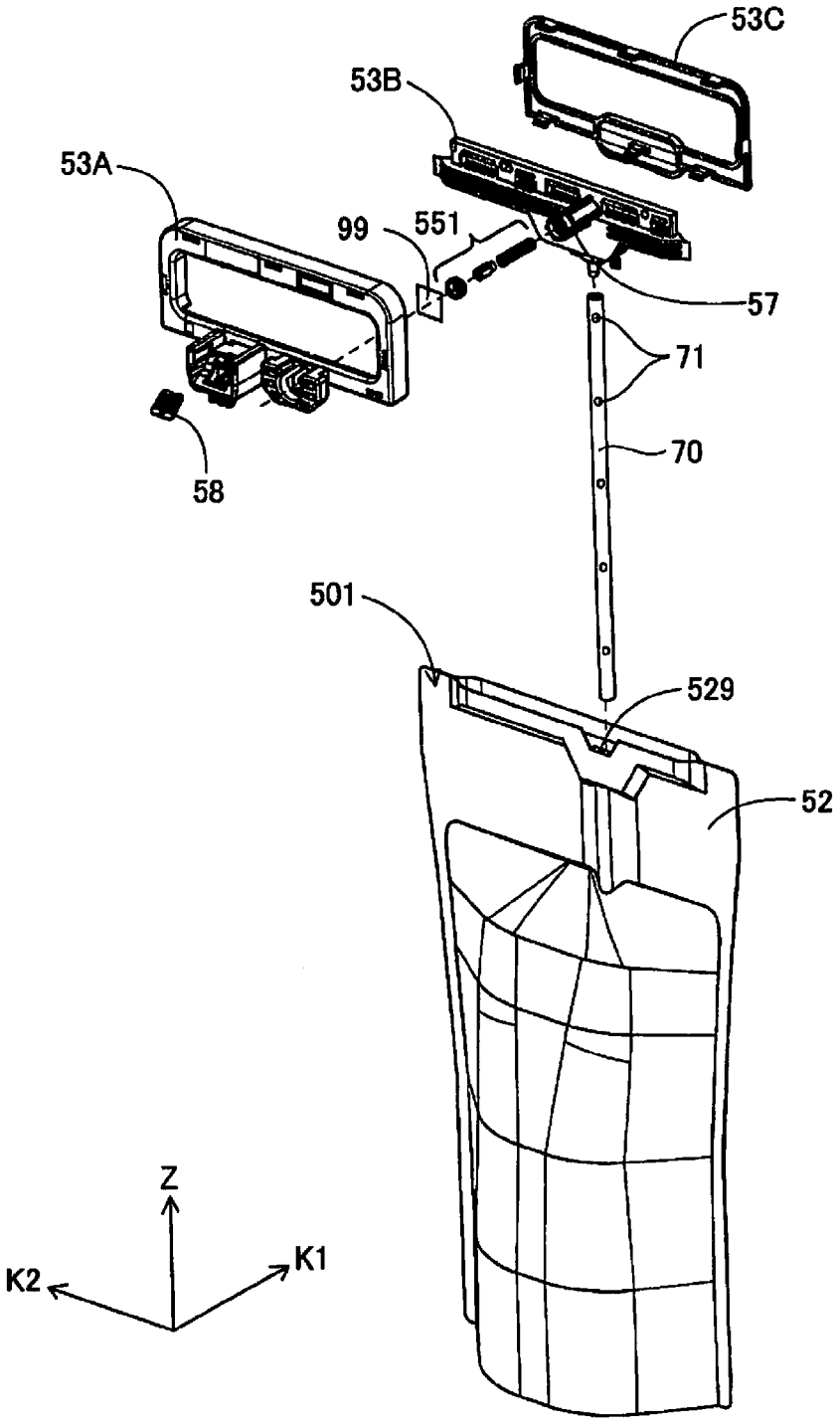
FIG. 10 is a perspective diagram illustrating a state where a liquid container is dismantled.

FIG. 10 is a perspective diagram illustrating a state where the liquid container 50 is dismantled. The liquid container 50 is provided with the liquid containing bag 52, a coupling member 53A, the liquid supply portion 53B, a pushing member 53C, the substrate unit 58, the flow path member 70, a sealing film 99, and a valve mechanism 551.

The liquid containing bag 52 is provided with a notch section 529. The notch section 529 is a notch which is provided in the one end 501. When the liquid supply pipe portion 53B and the liquid containing bag 52 are welded, the notch section 529 is provided in order to avoid interference between a liquid supply pipe portion 57 and the one end 501.

The flow path member 70 is a member with a pipe shape where ink flows in an interior. The flow path member 70 is provided with a plurality of holes 71. The holes 71 are holes which pass through an outer wall and an inner wall of the flow path member 70. By the holes 71 being provided, it is possible for ink to flow in and flow out of not only the open ends of the flow path member 70 but also the holes 71.

Figure 11:
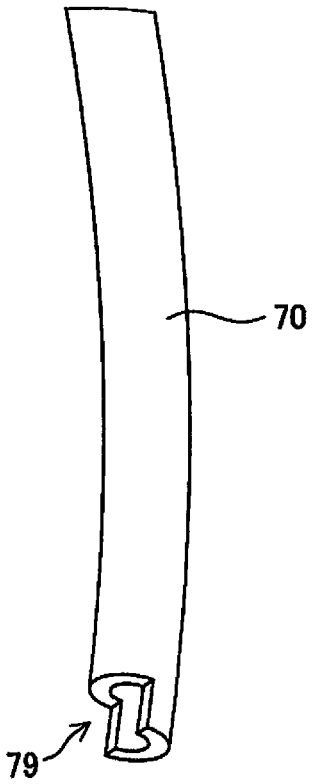
FIG. 11 is a perspective diagram illustrating the vicinity of an open end of a flow path member.

FIG. 11 illustrates the vicinity of an open end of the flow path member 70. The flow path member 70 is provided with a cut section 79 at a lower end. The cut section 79 is a surface which is formed by a portion of the wall of the flow path member 70 being cut in the vicinity of the open end. Due to the cut section 79 being provided, it is easy for ink in the vicinity of a bottom portion inside the liquid containing bag 52 to flow into the open end of the flow path member 70 in a case where the remaining amount of ink is particularly small.

Figure 12:
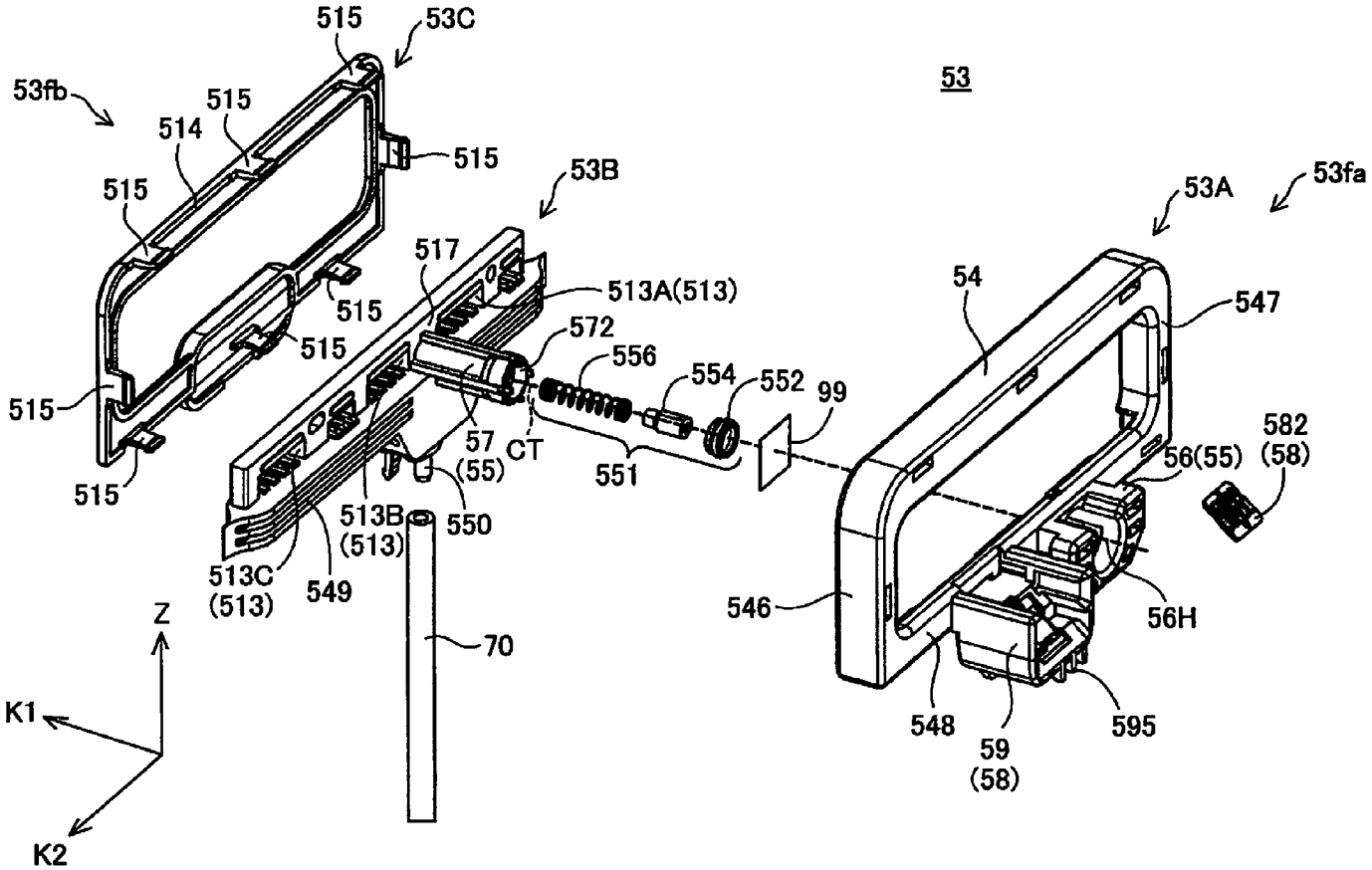
FIG. 12 is a perspective diagram illustrating a state where an operation member is dismantled.
Figure 13:
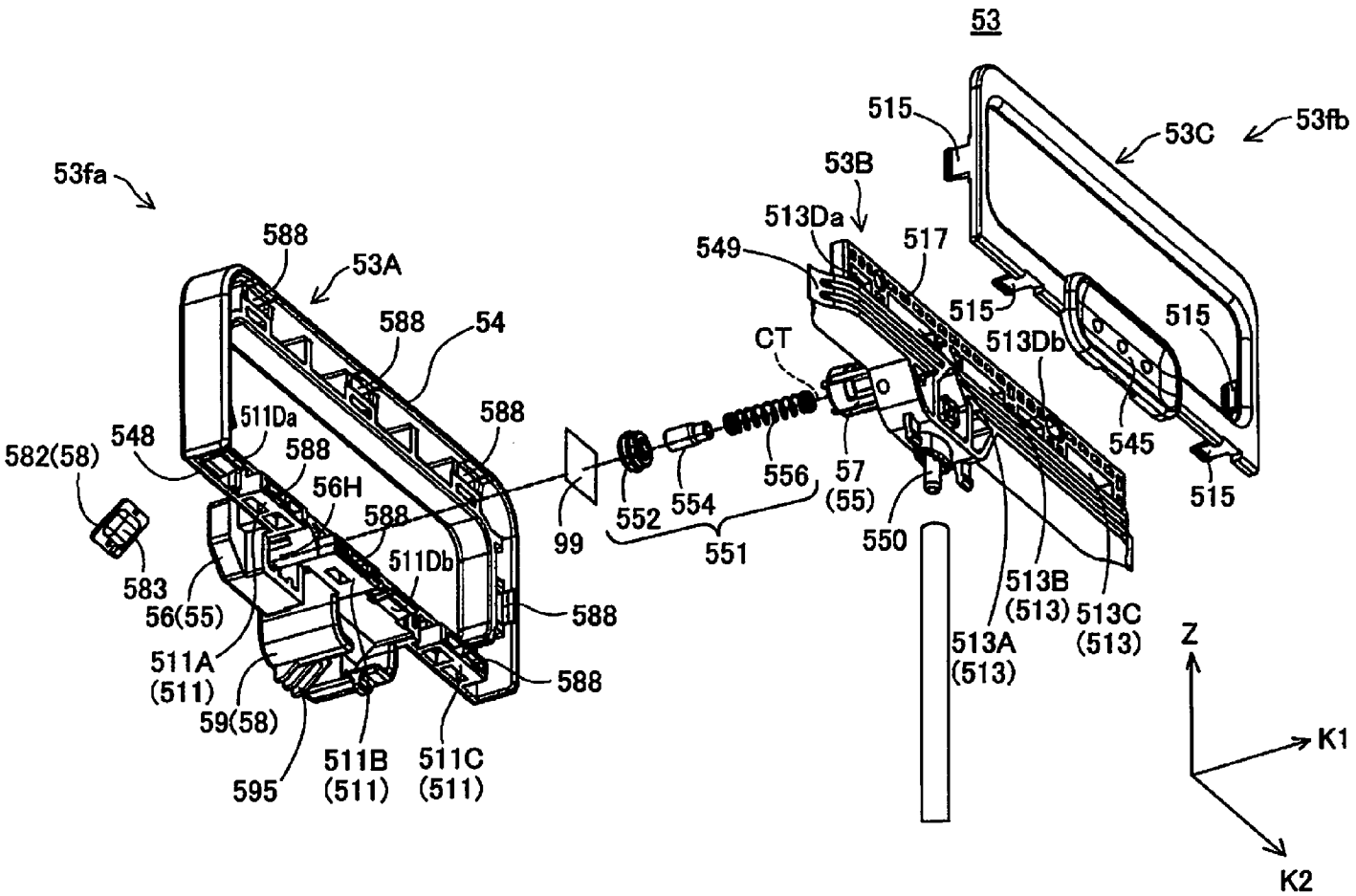
FIG. 13 is a perspective diagram illustrating a state where an operation member is dismantled.

FIG. 12 and FIG. 13 are perspective diagrams illustrating a state where the operation member 53 is dismantled. As shown in FIG. 12 and FIG. 13, the operation member 53 is provided with the coupling member 53A, the liquid supply portion 53B, and the pushing member 53C. The coupling member 53A and the pushing member 53C are combined so as to interpose the liquid supply portion 53B. The coupling member 53A, the liquid supply portion 53B, and the pushing member 53C are manufactured using a resin mold. In the first embodiment, materials which are different from each other are used for the resin molds of the coupling member 53A, the liquid supply portion 53B, and the pushing member 53C. A material which has higher mechanical rigidity than the liquid supply portion 53B is used as the material of the coupling member 53A.

As shown in FIG. 12 and FIG. 13, the −K1 axis direction side is defined as a first side 53*fa* of the operation member 53 and the +K1 axis direction side is defined as a second side 53*fb* of the operation member 53.

The coupling member 53A includes the grasping portion 54. The shape of the grasping portion 54 is a frame shape. The coupling member 53A is a member with a plate shape along a flat plane which is perpendicular to the K1 axis direction (a central axis CT direction of the liquid supply pipe portion 57). A positioning portion 56 and a circuit board holding portion 59 are connected by being integrally molded in a base portion 548 (in detail, the first side 53*fa* part of the base portion 548) in the coupling member 53A.

As shown in FIG. 13, the coupling member 53A has three engaging portions 511A, 511B, and 511C in the second side 53*fb*. The engaging portions 511A, 511B, and 511C are members for coupling (connecting) the coupling member 53A and the liquid supply portion 53B by engaging with the liquid supply portion 53B. The engaging portion 511 is a convex section which protrudes from the base portion 548 to the liquid supply portion 53B side (in the +K1 axis direction). The three engaging portions 511A, 511B, and 511C are arranged to line up along the K2 axis direction (a direction in which the positioning portion 56 and the circuit board holding portion 59 line up). The reference numeral "511" is used in a case where the three engaging portions 511A, 511B, and 511C are used without needing to be distinguishable.

The engaging portion 511 is provided on the second side 531*b* side of the base portion 548. The shape of the engaging portion 511 is a substantially rectangular cube shape. That is, the contours of the engaging portion 511 have a substantially rectangular shape and have a shape which surrounds a virtual straight line along the K1 axis direction.

As shown in FIG. 13, the coupling member 53A is provided with eight (only seven are shown in the diagram) member engaging portions 588 at the second side 53*fb*. The member engaging portions 588 have a concave shape and are for coupling the coupling member 53A and the pushing member 53C by engaging with the pushing member 53C.

As shown in FIG. 12 and FIG. 13, the liquid supply portion 53B is provided with the liquid supply pipe portion 57 and the joining portion 549. The liquid supply pipe portion 57 and the joining portion 549 are integrally formed as a portion of the liquid supply portion 53B.

The liquid supply portion 53B has three engaging portions 513A, 513B, and 513C. The engaging portions 513A, 513B, and 513C are for attaching the coupling member 53A to the liquid supply portion 53B by engaging with the engaging portion 511. The reference numeral "513" is used in a case where the three engaging portions 513A, 513B, and 513C are used without needing to be distinguishable.

The three engaging portions 513A, 513B, and 513C are provided to correspond to the three engaging portions 511A, 511B, and 511C of the coupling member 53A. The engaging portion 513 is a hole which passes through in the K1 axis direction. The outer shape of the engaging portion 513 is a shape where it is possible for the engaging portion 511 to fit. The outer shape of the engaging portion 513 has a substantially rectangular shape and has a shape which surrounds a direction (the K1 axis direction) along the K1 axis direction (the central axis CT direction of the liquid supply pipe portion 57).

Enclosing Ink in Liquid Container 50

Figure 14:
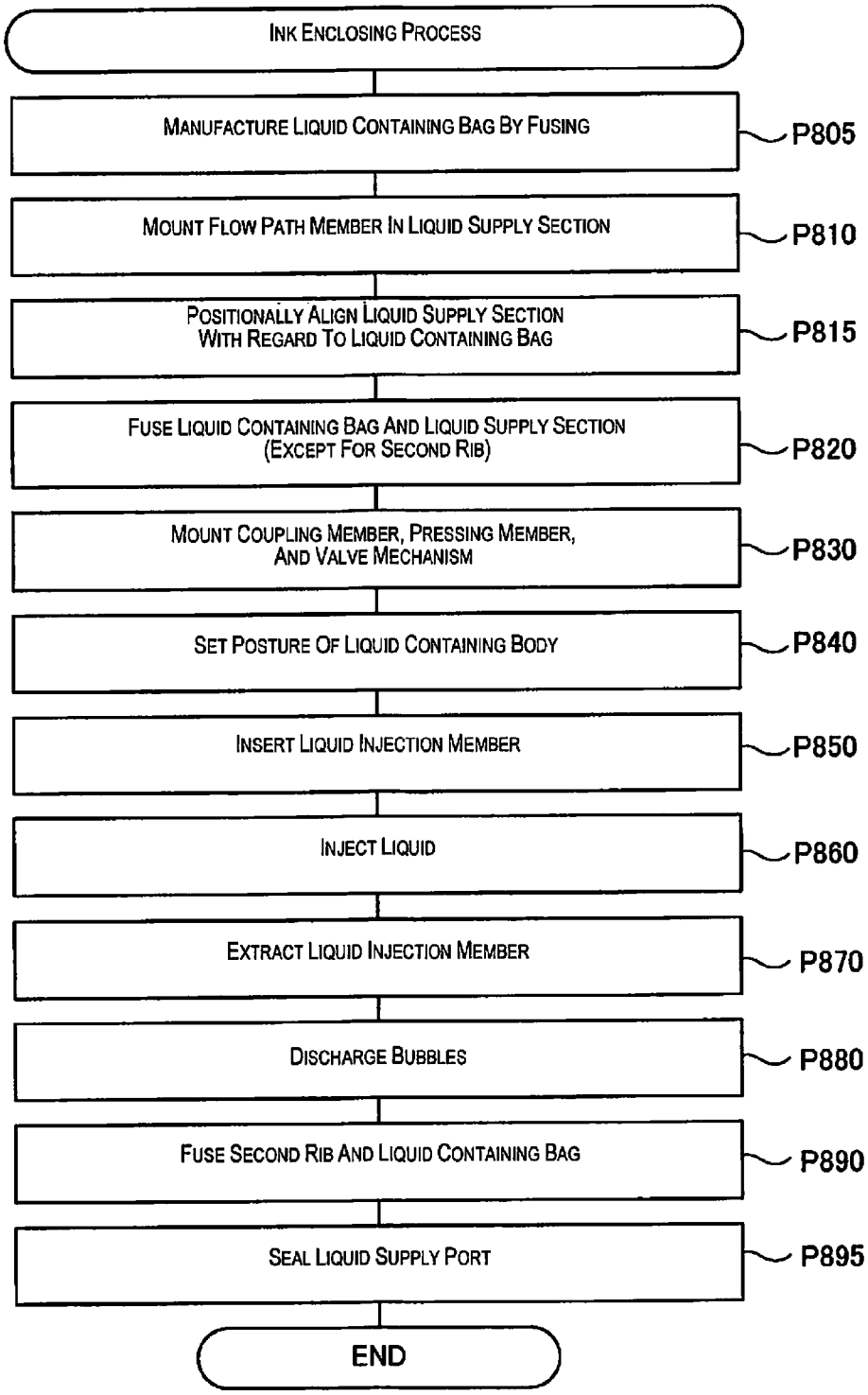
FIG. 14 is a process diagram illustrating an ink enclosing process.

FIG. 14 is a process diagram illustrating an ink enclosing process. The ink enclosing process is a process where the liquid container 50 which contains ink is completed from the dismantled state as shown in FIG. 10.

First, the liquid containing bag 52 is manufactured by welding (process P805). In detail, the liquid containing bag 52 is manufactured by welding the circumferential regions 51W of the first to third films 521 to 523. Next, the flow path member 70 is mounted on the liquid supply portion 53B (process P810). In detail, a lead element 550 is inserted into an interior of the flow path member 70 (refer to FIG. 12 and FIG. 13).

Next, the liquid supply portion 53B is positioned with regard to the liquid containing bag 52 (process P815). In detail, the flow path member 70 which is mounted is inserted into an interior of the liquid containing bag 52, and the joining portion 549 of the liquid supply portion 53B is positioned with regard to the first and second films 521 and 522. Positional alignment is executed such that the liquid supply pipe portion 57 is in contact with the notch section 529. Positional alignment is implemented for the subsequent welding.

Next, the liquid containing bag 52 and the liquid supply portion 53B are welded (process P820). However, welding of a second rib 660 (refer to FIG. 15) is not implemented in process P820.

FIG. 15 and FIG. 16 are perspective diagrams of the liquid supply portion 53B. Joining portions 549*a* and 549*b* are parts, which are welded with the liquid containing bag 52, of the liquid supply portion 53B. The liquid supply portion 53B has a shape substantially in the shape of a boat when viewed in the −Z axis direction. The shape of a boat is a shape such that the thickness gets gradually thinner at both end portions in the longitudinal direction. The liquid supply portion 53B has two surfaces which are opposed in a direction which is orthogonal to the Z axis, in more detail, in the K1 axis direction. One of the two surfaces has the joining portion 549*a* and the other of the two surfaces has the joining portion 549*b*.

The joining portion 549*b* (FIG. 15) includes an upper end joining portion 640, a first rib 650, and the second rib 660. Welding in process P820 involves the upper end joining portion 640 and the first rib 650. The upper end joining portion 640 is indicated in FIG. 15 by hatching using lines from the upper right to the lower left. The first rib 650 is indicated in FIG. 15 by hatching using lines from the upper left to the lower right and has a substantially pentagonal shape. The one end 501 is sealed in the liquid containing bag 52 if welding of the first and second films 521 and 522 is implemented at the joining portion 549*a* and the joining portion 5496 excluding the second rib 660.

As shown in FIG. 15, the first rib 650 partitions a first chamber 558. The second rib 660 partitions the first chamber 558 and a second chamber 559. A bypass 562 shown in FIG. 15 is a flow path which links the second chamber 559 and the inside of the liquid containing bag 52. The second chamber 559 communicates with the first chamber 558 if the second rib 660 is not welded. As such, the bypass 562 communicates with the first chamber 558 if the second rib 660 is not welded. The details of the bypass 562 will be descried later along with FIG. 25 to FIG. 27.

As shown in FIG. 16, the joining portion 549*a* is a part which is matched to the surfaces which are indicated by the two types of hatching. As shown in FIG. 16, a hollow section 560 is provided on the joining portion 549*a*. The hollow section 560 is a part where the joining portion 549*a* is hollowed out in the surface direction. The liquid supply pipe portion 57 is arranged so as to be in contact with the hollow section 560. In other words, the lower end (the end in the −Z axis direction) of the liquid supply pipe portion 57 is positioned lower (in the −Z axis direction) than the upper end (the end in the +Z axis direction) of the joining portion 549*a*.

As shown in FIG. 16, the joining portion 549*a* includes an overhanging section 570 and a main joining surface 571. The main joining surface 571 is the main joining surface in the joining portion 549*a*. The overhanging section 570 is a part which overhangs from the main joining surface 571 in the −Z axis direction and is indicated by hatching using lines from the upper left to the lower right. As shown in FIG. 15, the first chamber 558, the second chamber 559, the bypass 562, and the like are provided in the overhanging section 570 on the rear side (in the −K1 axis direction) of the welding surface.

Figure 17:
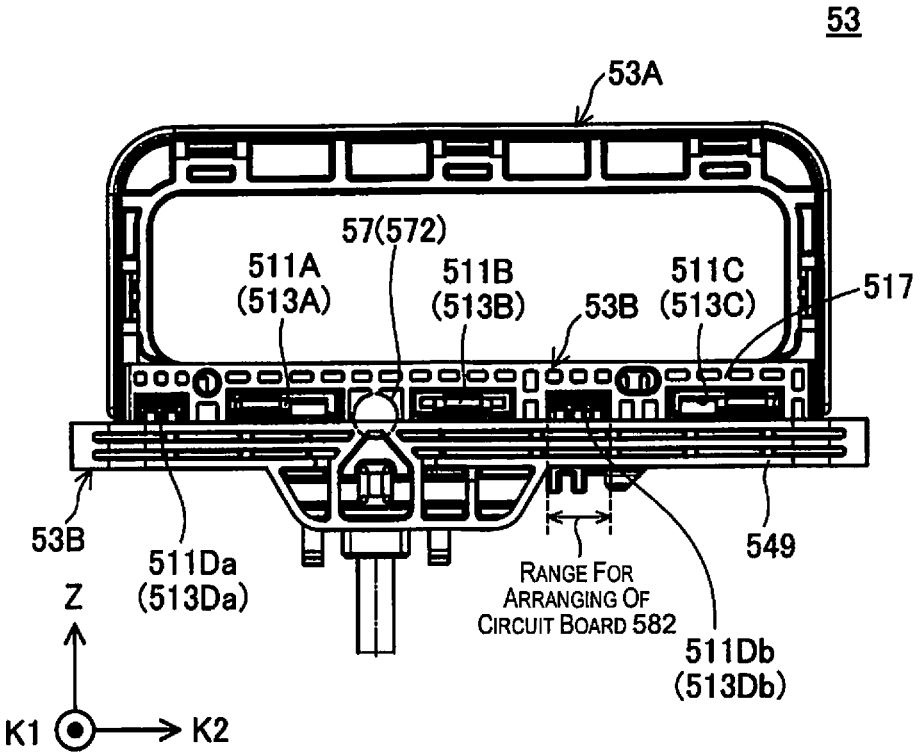
FIG. 17 is a rear surface diagram illustrating a state where a coupling member and a liquid supply portion are assembled.

After welding described above, the coupling member 53A, the pushing member 53C, the valve mechanism 551, and substrate 582 which includes a memory apparatus 583 are assembled (process P830). Assembling will be described below in detail. FIG. 17 is a rear surface diagram illustrating a state where the coupling member 53A and the liquid supply portion 53B are assembled. That is, FIG. 17 illustrates a state where the pushing member 53C is not assembled. Illustration of the liquid containing bag 52 is omitted in FIG. 17.

As shown in FIG. 17, the liquid supply portion 53B is attached to the coupling member 53A by the engaging portions 511A, 511B, and 511C fitting together with the engaging portions 513A, 513B, and 511C which are through holes which correspond to the engaging portions 511A, 511B, and 511C. A protruding section 517 which is provided in the engaging portion 513 is exposed at the outside of the liquid containing bag 52 in a state where the joining portion 549 is welded to the liquid containing bag 52.

The three engaging portions 511A, 511B, and 511C of the coupling member 53A support the weight due to the liquid containing bag 52 by engaging with the liquid supply portion 53B which is attached to the liquid containing bag 52.

As shown in FIG. 17, movement of the liquid supply portion 53B in the K2 axis direction and in the Z axis direction is limited with regard to the coupling member 53A due to engaging of the engaging portion 511B and the engaging portion 513B. Movement of the liquid supply portion 53B in the Z axis direction is limited with regard to the coupling member 53A due to engaging of the engaging portion 551A and the engaging portion 513A and engaging of the engaging portion 511C and the engaging portion 513C. That is, due to the engaging portion 511 and the engaging portion 513 each having an outer shape which surrounds a direction (the K1 axis direction) along the central axis CT direction (the K1 axis direction), it is possible to suppress positional deviation between the coupling member 53A and the liquid supply portion 53B in a surface direction which is orthogonal to the central axis CT direction (a surface direction which is specified by the Z axis direction and the K2 axis direction).

As shown in FIG. 17, the liquid supply pipe portion 57 is provided such that at least a portion overlaps with the joining portion 549*b* when viewed from the joining portion 549*b* side along the K1 axis direction. In other words, the liquid supply port 572 is provided such that at least a portion overlaps with the joining portion 549*b* when viewed from the joining portion 549*b* side along the K1 axis direction.

As shown in FIG. 13, the coupling member 53A further has locking claws 511Da and 511Db with a convex shape. The locking claws 511Da and 511Db are provided on the coupling member 53A at the second side 53*fb* of the base portion 548. The liquid supply portion 53B has through holes 513Da and 513Db at positions which correspond to the locking claws 511Da and 511Db with a convex shape.

Figure 18:
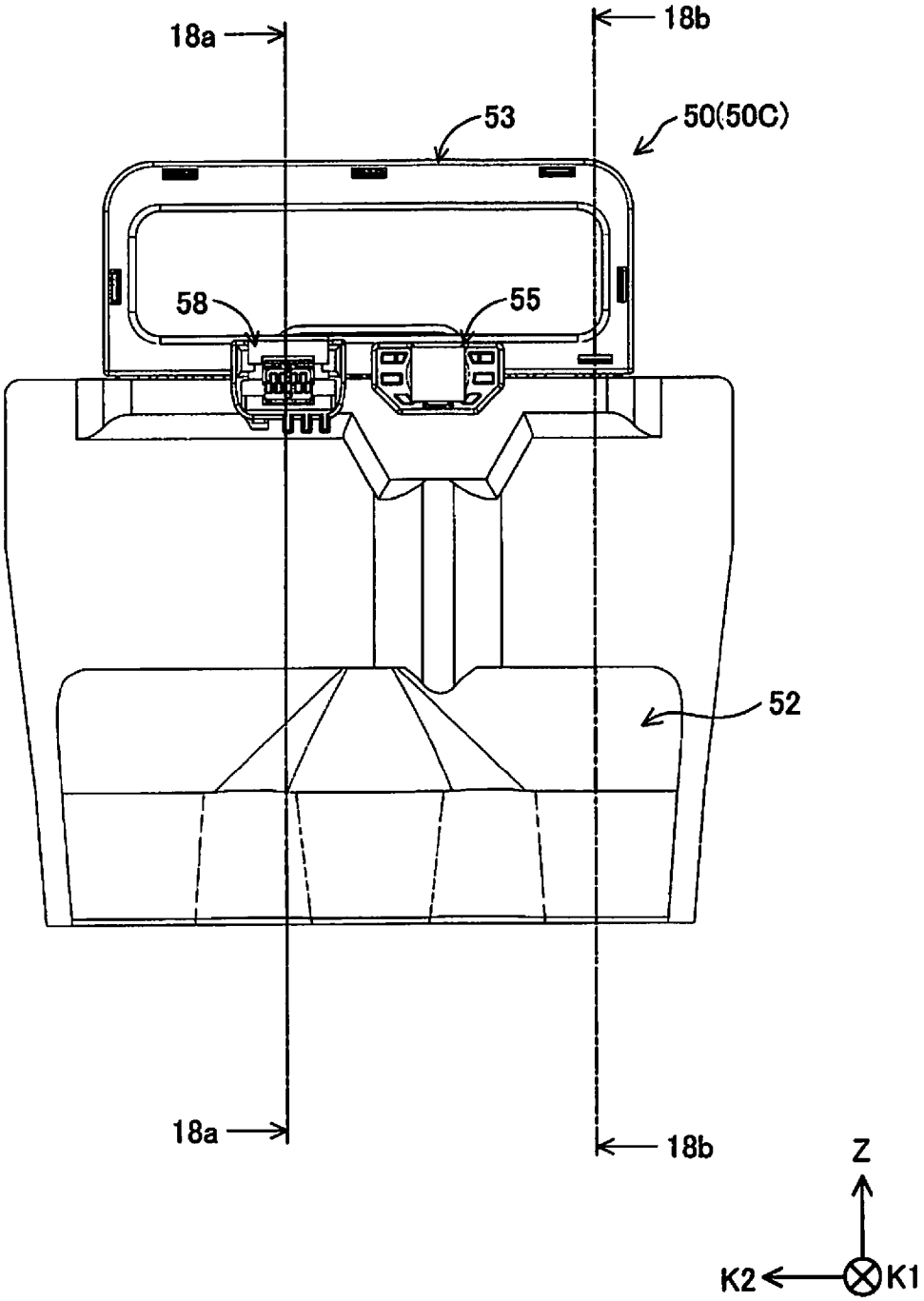
FIG. 18 is a front surface diagram illustrating a liquid container.
Figure 19:
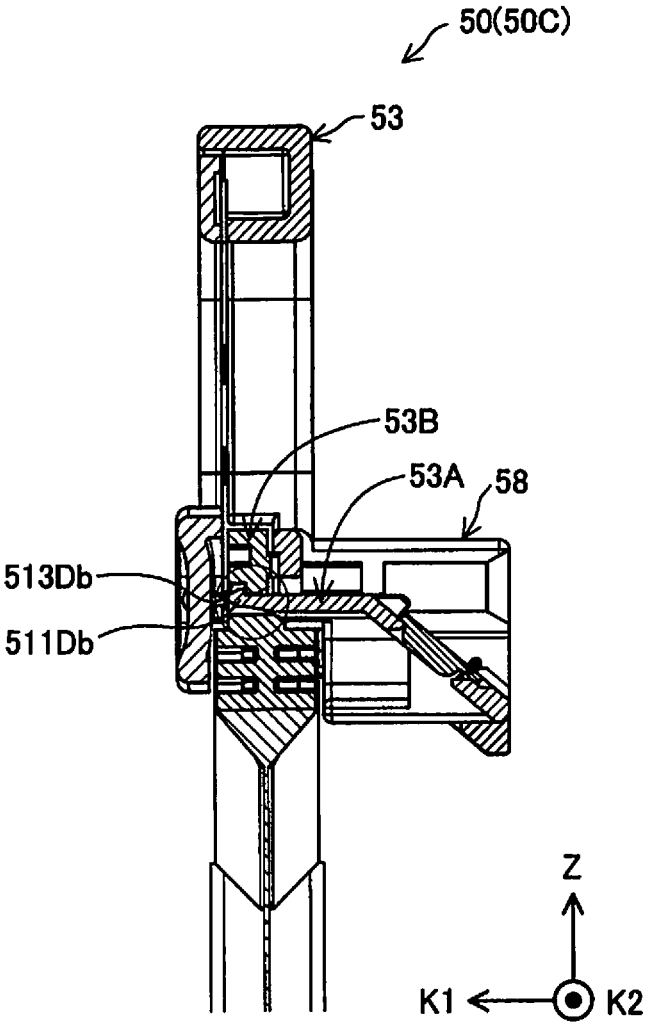
FIG. 19 is a partial cross sectional diagram of FIG. 18.
Figure 20:
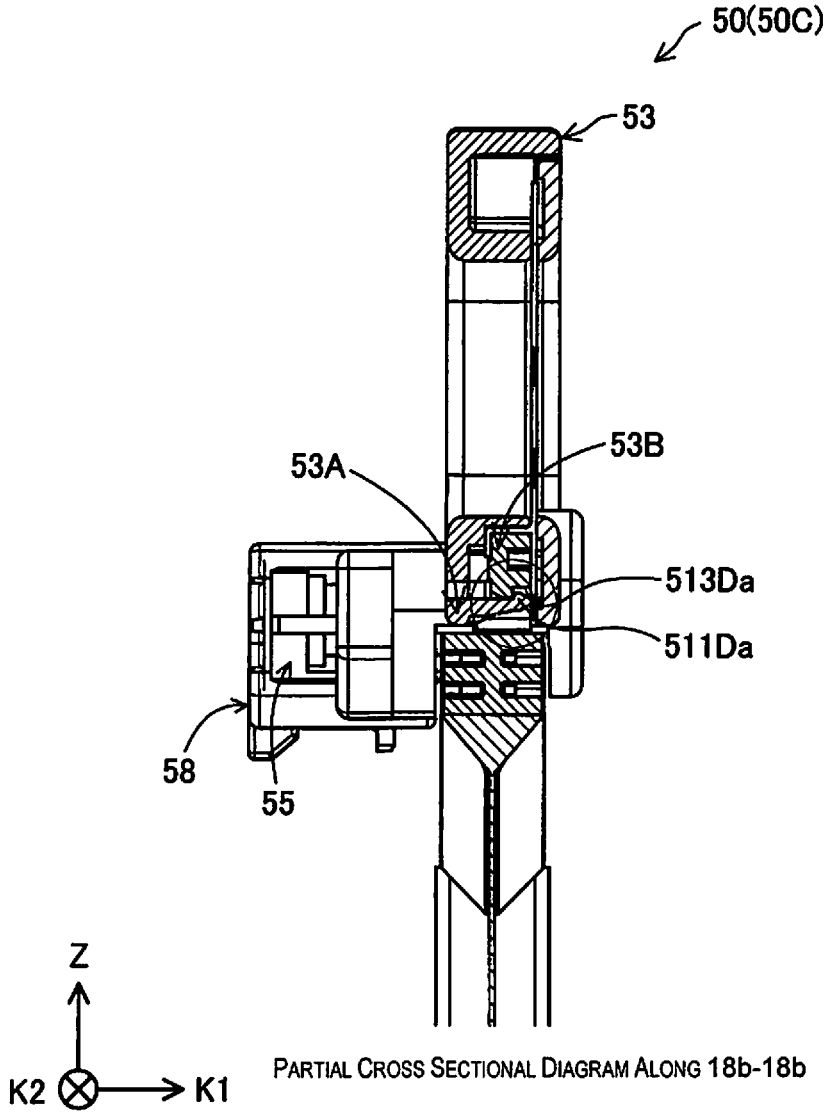
FIG. 20 is a partial cross sectional diagram of FIG. 18.

FIG. 18 is a front surface diagram illustrating the liquid container 50. FIG. 18 illustrates a state of assembly where the pushing member 53C is also included. FIG. 19 is a partial cross sectional diagram along 18*a*-18*a* of FIG. 18. FIG. 20 is a partial cross sectional diagram along 18*b*-18*b* of FIG. 18.

As shown in FIG. 19 and FIG. 20, due to the locking claws 511Da and 511Db locking with a member which forms the through holes 513Da and 513Db, movement of the liquid supply portion 53B in the +K1 axis direction is limited with regard to the coupling member 53A. In addition, movement of the liquid supply portion 53B in the −K1 axis direction is limited with regard to the coupling member 53A due to a portion of the liquid supply portion 53B abutting with a portion of the coupling member 53A.

As above, positional alignment between both of the members 53A and 53B is performed by the engaging portion 511 of the coupling member 53A engaging with the engaging portion 513 of the liquid supply portion 53B. The circuit board holding portion 59 is engaged with the coupling member 53A and the liquid supply pipe portion 57, which is connected with the printer 10, is engaged with the liquid supply portion 53B. As such, the position between the liquid supply pipe portion 57 and the circuit board holding portion 59 is determined due to engaging of the engaging portion 511 of the liquid supply portion 53A and the engaging portion 513 of a second member.

As shown in FIG. 17, the engaging portion 511A and the engaging portion 511B are arranged at positions which interpose the liquid supply pipe portion 57 in the K2 axis direction of the joining portion 549. The engaging portion 511A and the engaging portion 511C are arranged at positions which interpose the liquid supply pipe portion 57 in the K2 axis direction. The engaging portion 511B and the engaging portion 511C are arranged at positions which interpose a circuit board 582 in the K2 axis direction. The engaging portion 511A and the engaging portion 511C are arranged at positions which interpose the circuit board 582 in the K2 axis direction.

As shown in FIG. 13, the pushing member 53C includes the pushing portion 545. The pushing member 53C forms a frame which corresponds to the shape of the coupling member 53A. The pushing member 53C is a member with a frame shape along a flat plane which is perpendicular to the K1 axis direction (the central axis CT direction). Eight engaging portions 515 are provided in the pushing member 53C at the first side 53*fa* part. The coupling member 53A and the pushing member 53C are linked due to the engaging portions 515 engaging with the member engaging portion 588 shown in FIG. 13.

The pushing member 53C is colored with the color of ink which is contained in the liquid containing bag 52. The pushing member 53C is colored with, for example, yellow in the case of the liquid container 50Y which contains yellow ink.

After the coupling member 53A and the pushing member 53C are mounted, the posture of the liquid container 50 is set (process P840). Next, a liquid filling member 13 is inserted into the liquid supply pipe portion 57 (process P850). Processes P840 and P850 are implemented in order to inject ink (process P850).

Figure 21:
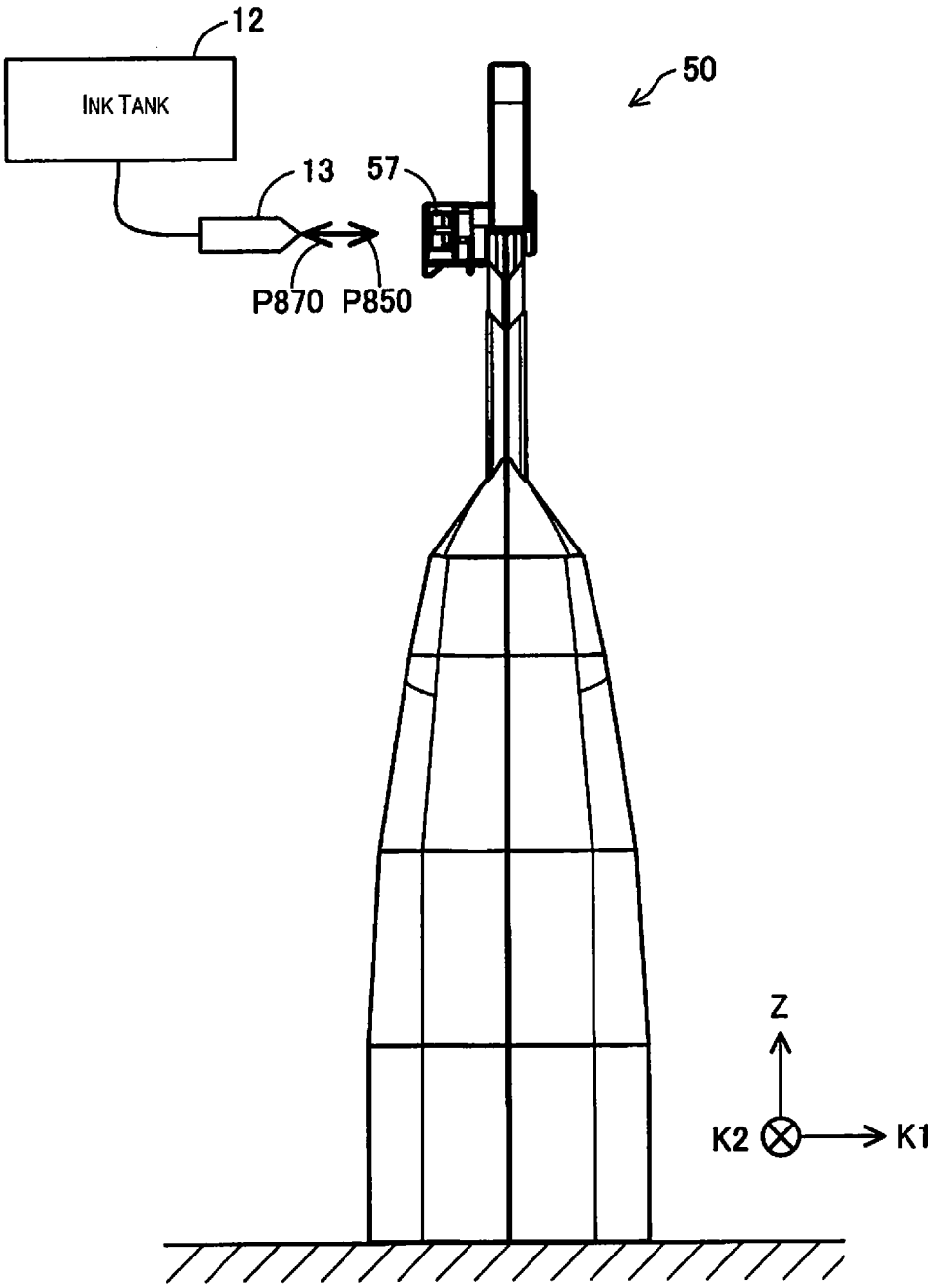
FIG. 21 is a side surface diagram illustrating a liquid container where the posture is set.

FIG. 21 is a side surface diagram illustrating the liquid container 50 where the posture is set. In the first embodiment, the posture during filling of ink is set to the same posture as a state of being attached to the attaching and detaching unit 30. That is, the liquid containing bag 52 is positioned more to the −Z axis direction side than the operation member 53, and the liquid supply pipe portion 57 has an orientation which intersects with the Z axis direction, in detail, is set with the posture so as to face in the horizontal direction.

Since the liquid container 50 has the gusset portion as described above, it is possible to set the posture of the liquid container 50 simply by placing the liquid container 50 on the horizontal plane as shown in FIG. 21 as long as the amount of ink which is contained is sufficient. However, since ink is not contained at the time of process P840, process P840 is implemented by fixing the position of the operation member 53 using a jig 14 (refer to FIG. 22).

Next, ink is injected into the liquid container 50 (process P860). The ink which is injected is retained in an ink tank 12. Injecting is executed via the liquid filling member 13 which is inserted.

Figure 22:
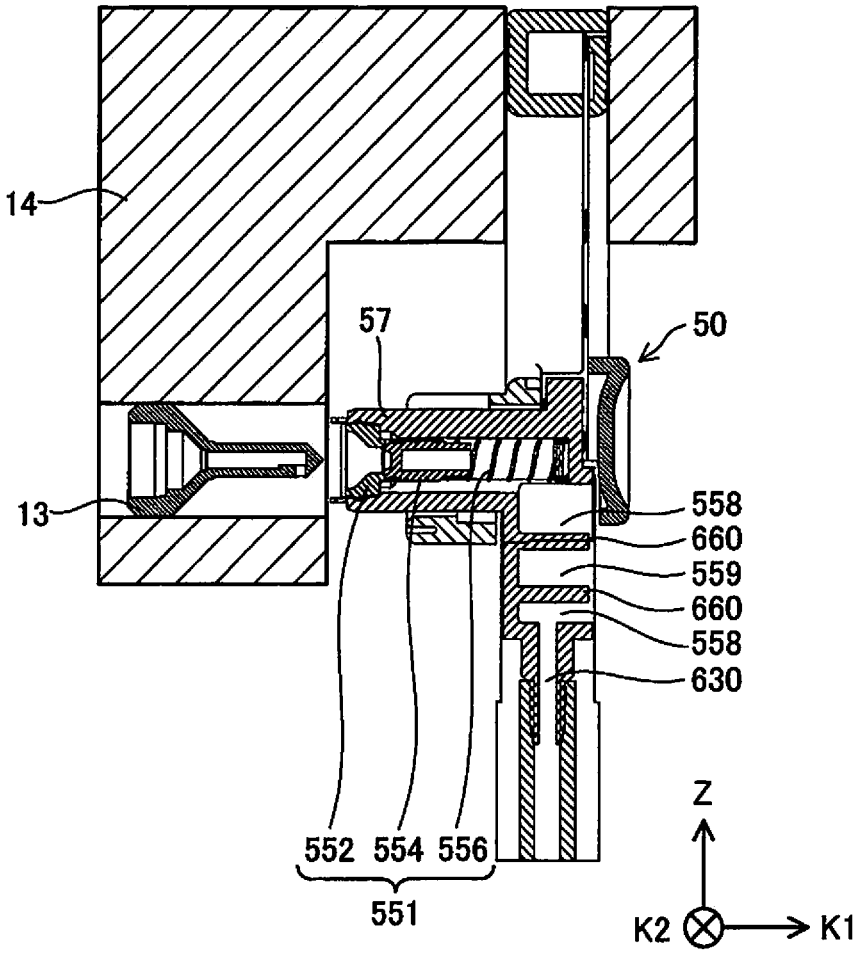
FIG. 22 is a cross sectional diagram of a flow path during injection (before insertion).

FIG. 22 is a cross sectional diagram of the liquid filling member 13, the jig 14, and the liquid container 50. The cross section in FIG. 22 is a surface which includes a central axis line of the liquid supply pipe portion 57 and is orthogonal to the horizontal plane (a cross section along 47-47 of FIG. 47).

FIG. 22 is a cross sectional diagram illustrating a state before the liquid filling member 13 is inserted into the liquid supply pipe portion 57. The jig 14 positions the liquid supply pipe portion 57 due to being inserted between by the coupling member 53A and the pushing member 53C. The jig 14 positions the liquid filling member 13 on the K2-Z horizontal plane using a through hole which is provided at an interior.

As shown in FIG. 22, the valve mechanism 551 is arranged at an interior of the liquid supply pipe portion 57. The valve mechanism 551 is for opening and closing a flow path which is formed at an interior of the liquid supply pipe portion 57. The valve mechanism 551 is provided with a valve seat 552, a valve body 554, and a spring 556.

The valve seat 552 is a member with a substantially annular shape. The valve seat 552 is configured by, for example, an elastic body such as rubber or an elastomer. The valve seat 552 is pushed into at an interior of the liquid supply pipe portion 57. The valve body 554 is a member with a substantially cylindrical shape. The valve body 554 blocks off a hole (a valve hole) which is formed in the valve seat 552 in a state before the liquid container 50 is mounted in the attaching and detaching unit 30 (the state shown in FIG. 22). A spring 556 is a compression coil spring. The spring 556 exerts a force on the valve body 554 in the orientation toward the valve seat 552.

Figure 23:
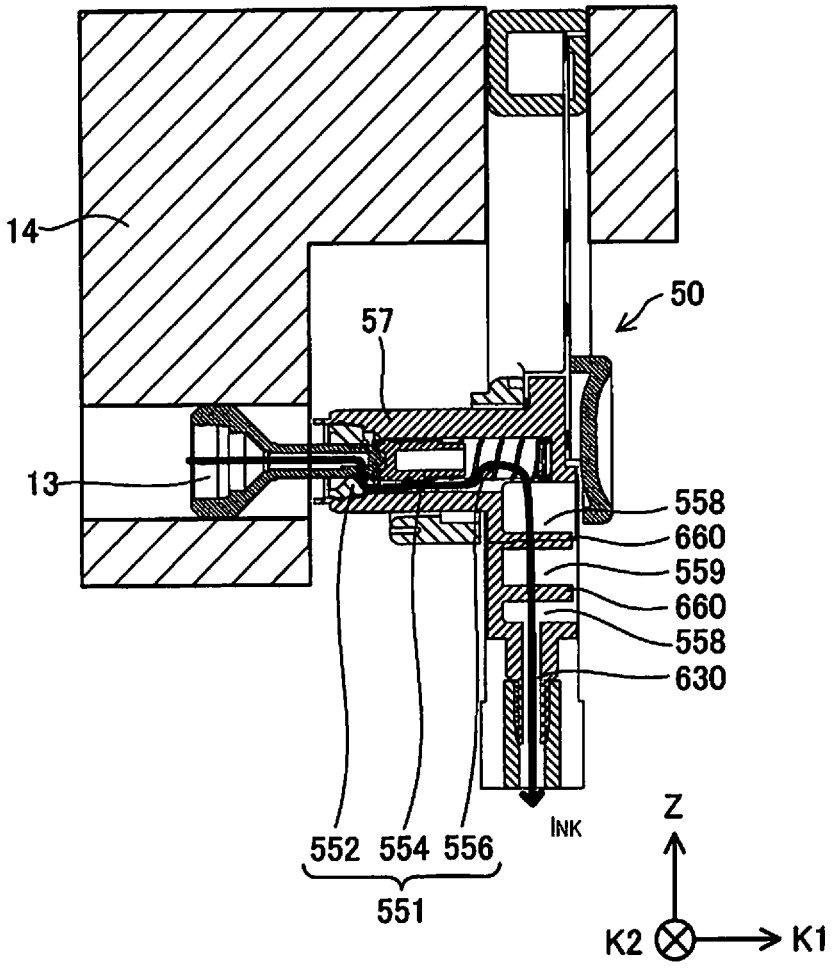
FIG. 23 is a cross sectional diagram of a flow path during injection (after insertion).

FIG. 23 is a cross sectional diagram illustrating a state where the liquid filling member 13 is inserted into the liquid supply pipe portion 57. In this state, the seal between the valve seat 552 and the valve body 554 is released due to a leading end of the liquid filling member 13 moving the valve body 554 in the +K1 direction, and the liquid supply pipe portion 57 and an opening portion at the leading end of the liquid filling member 13 communicate as a flow path. When the flow path communicates in this manner, it is possible to inject ink inside the liquid containing bag 52.

In addition to the flow path which is connected in FIG. 23, filling of ink is implemented via the bypass 562. Since filling of ink via a plurality of flow paths is implemented in this manner, flow path resistance is reduced and smooth filling is realized.

Since the posture which is set in process P840 is also maintained in process P860, the liquid supply pipe portion 57 is positioned more to the upper side than the liquid containing bag 52 in the direction of gravity. As such, flowing of ink into the liquid containing bag 52 is smoothly implemented.

Figure 24:
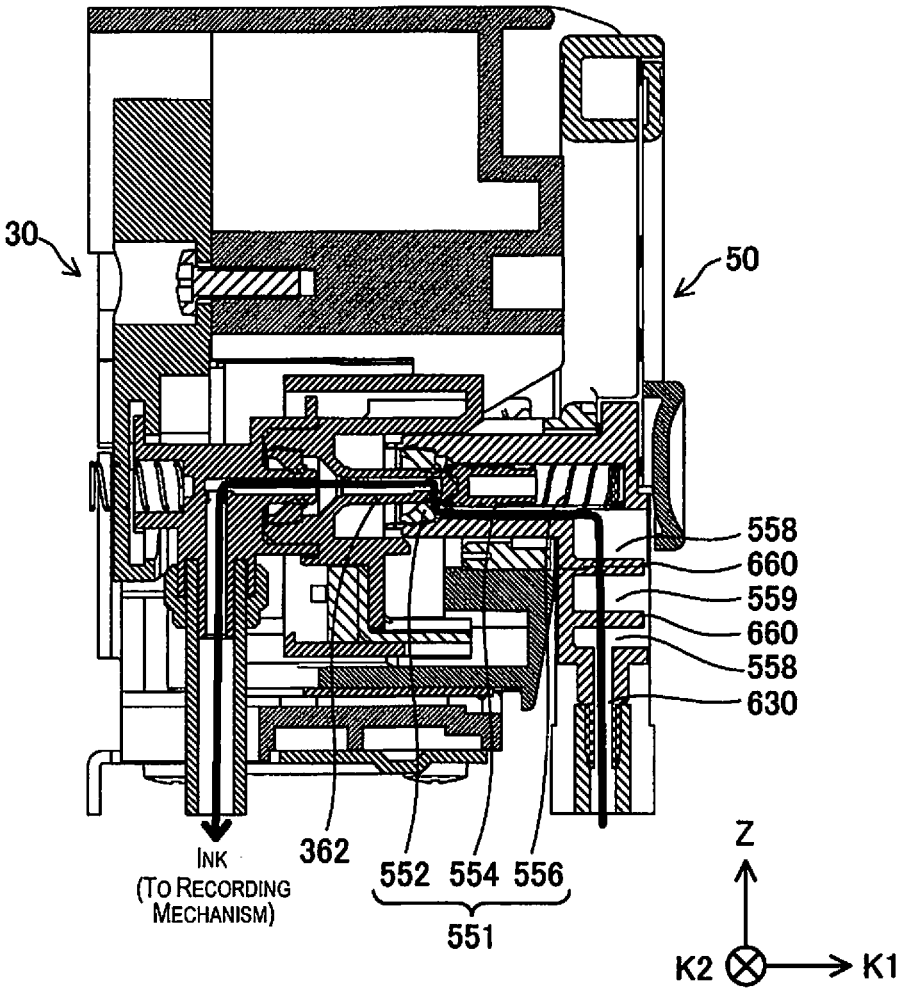
FIG. 24 is a cross sectional diagram of an attaching and detaching unit and a liquid container.

FIG. 24 is a cross sectional diagram illustrating a state where the liquid container 50 is mounted in the attaching and detaching unit 30. Mounting will be described in detail below, but mounting is described simply here since securing of the flow path is the same as filling of ink. It is possible to supply ink with regard to the printer 10 when the liquid container 50 is mounted in the attaching and detaching unit 30. Securing of the flow path is realized by inserting a liquid introducing portion 362 into the liquid supply pipe portion 57. The liquid introducing portion 362 has the same shape as the liquid filling member 13 and the flow path which is at an interior communicates with the recording mechanism 11.

After filling of ink, the liquid filling member 13 is extracted from the liquid supply pipe portion 57 (process P870). Process P870 is implemented without any changes to the posture which is set in process P840. That is, in process P870, the liquid supply pipe portion 57 protrudes out in the horizontal direction and the liquid filling member 13 is extracted in the horizontal direction. As such, a possibility that ink is adhered to the liquid container 50 is low even if ink drips from the liquid filling member 13 when the liquid filling member 13 is extracted from the liquid supply pipe portion 57.

After the liquid filling member is extracted, bubbles are discharged from inside the liquid containing bag 52 (process P880). Discharging is realized by discharging a predetermined amount of ink which is contained in the liquid containing bag 52 from the liquid supply pipe portion 57 while maintaining the posture which is set in process P840. A syringe (which is not shown in the drawings) is used in discharging. The syringe has the same shape as the liquid filling member 13 and draws in ink in a state of being inserted into the liquid supply pipe portion 57. Bubbles are discharged via the second chamber 559 and the bypass 562. The bypass 562 will be described next.

Figure 25:
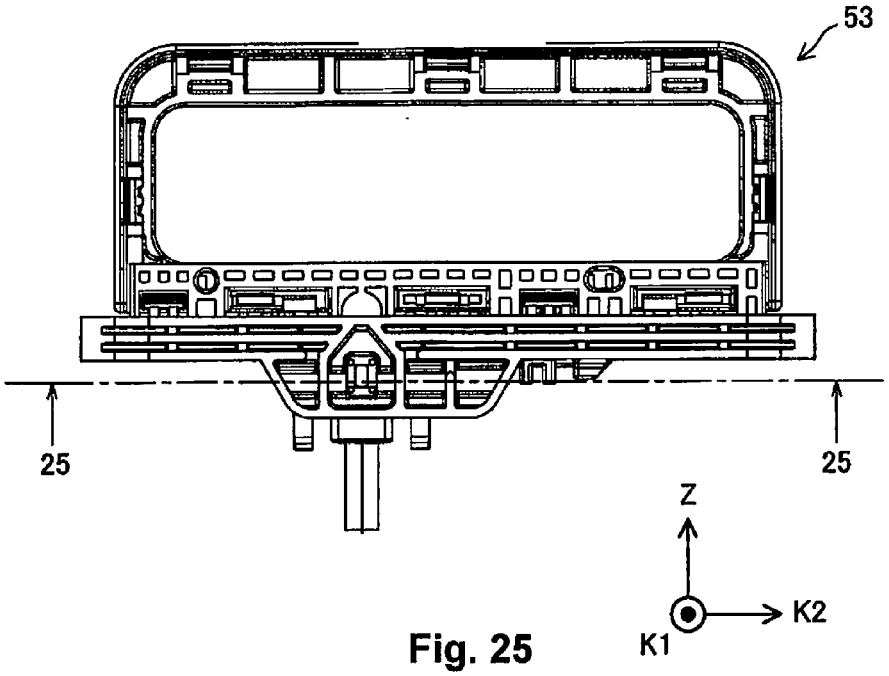
FIG. 25 is a rear view diagram illustrating a state where a coupling member and a liquid supply portion are assembled.
Figure 26:
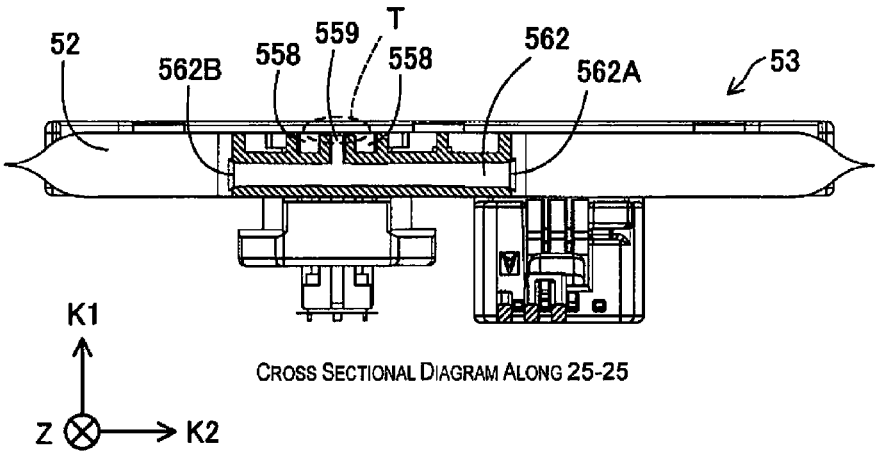
FIG. 26 is a cross sectional diagram of FIG. 25.
Figure 27:
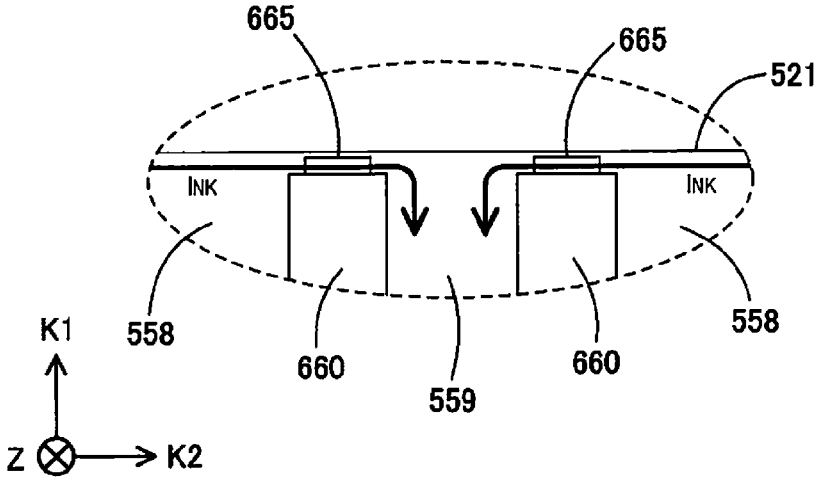
FIG. 27 is an enlarged diagram of FIG. 26.
Figure 56:
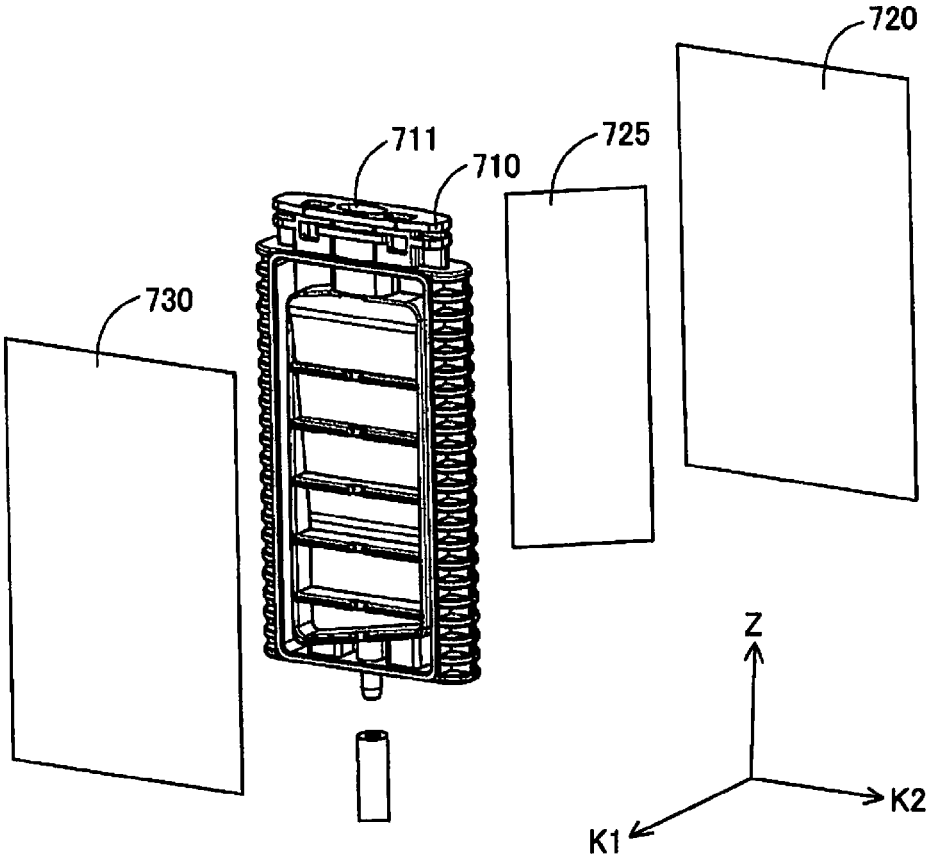
FIG. 56 is a perspective diagram illustrating a state where a filter unit is dismantled.

FIG. 25 is a rear surface diagram illustrating a state where the coupling member 53A and the liquid supply portion 53B are assembled. FIG. 26 is a cross sectional diagram along 25-25 of FIG. 25. FIG. 27 is an enlarged diagram of a T section in FIG. 26. Here, illustration of the liquid containing bag 52 shown in FIG. 56 is omitted in FIG. 25. The pushing member 53C is omitted in FIG. 25.

As shown in FIG. 26, the bypass 562 has opening portions 562A and 562B. The opening portions 562A and 562B are openings in the vicinity of the one end 501 inside the liquid containing bag 52. That is, the opening portions 562A and 562B are positioned in the vicinity of the upper end inside the liquid containing bag 52.

As shown in FIG. 26, the bypass 562 communicates with the second chamber 559. As shown in FIG. 27, it is possible for ink to flow between the first film 521 and the second rib 660 in a state where the first film 521 and the second rib 660 are not welded. That is, the bypass 562 communicates with the first chamber 558 via the second chamber 559 at the time of process P880.

As shown in FIG. 27, a protrusion 665 is provided on the end surface of the second rib 660. The protrusion 665 is for securing flow path area between the first film 521 and the second rib 660.

The bypass 562 is utilized in discharging of gas in process P880. That is, bubbles, which are retained inside the liquid containing bag 52 in the vicinity of the upper end, flow into the opening portions 562A and 562B and are discharged by passing through the bypass 562, the second chamber 559, the first chamber 558, and the liquid supply pipe portion 57 in order.

After discharging of bubbles, the liquid containing bag 52 and the end surface of the second rib 660 are welded (process P890). When the second rib 660 is welded, the protrusion 665 melts away and disappears.

Figure 28:
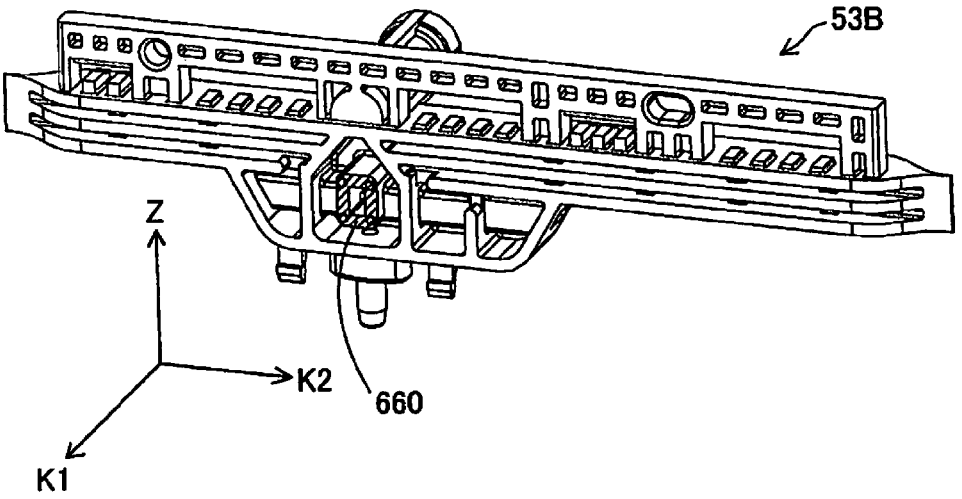
FIG. 28 is a perspective diagram illustrating a liquid supply portion.

FIG. 28 is a perspective diagram illustrating the liquid supply portion 53B. The hatching shown in FIG. 28 indicates the end surface of the second rib 660. When the liquid containing bag 52 and the end surface of the second rib 660 are welded, it is not possible for ink to flow from the second chamber 559 to the first chamber 558. As a result, supplying of ink from the liquid containing bag 52 to the liquid supply pipe portion 57 is implemented via the flow path member 70.

Finally, the liquid supply port 572 is sealed by a sealing film 99 (refer to FIG. 12) (process P895). The sealing film 99 prevents ink from leaking from the liquid supply port 572 to the outside before the liquid container 50 is mounted in the attaching and detaching unit 30. Additionally, the sealing film 99 prevents the valve seat 522 and the valve body 554 from moving in the −K1 axis direction and from coming out from the liquid supply pipe portion 57 due to the pushing force of the spring 556. The sealing film 99 is torn by the liquid introducing portion 362 when the liquid container 50 is mounted in the attaching and detaching unit 30.

Configuration of Operation Member 53

Figure 33:
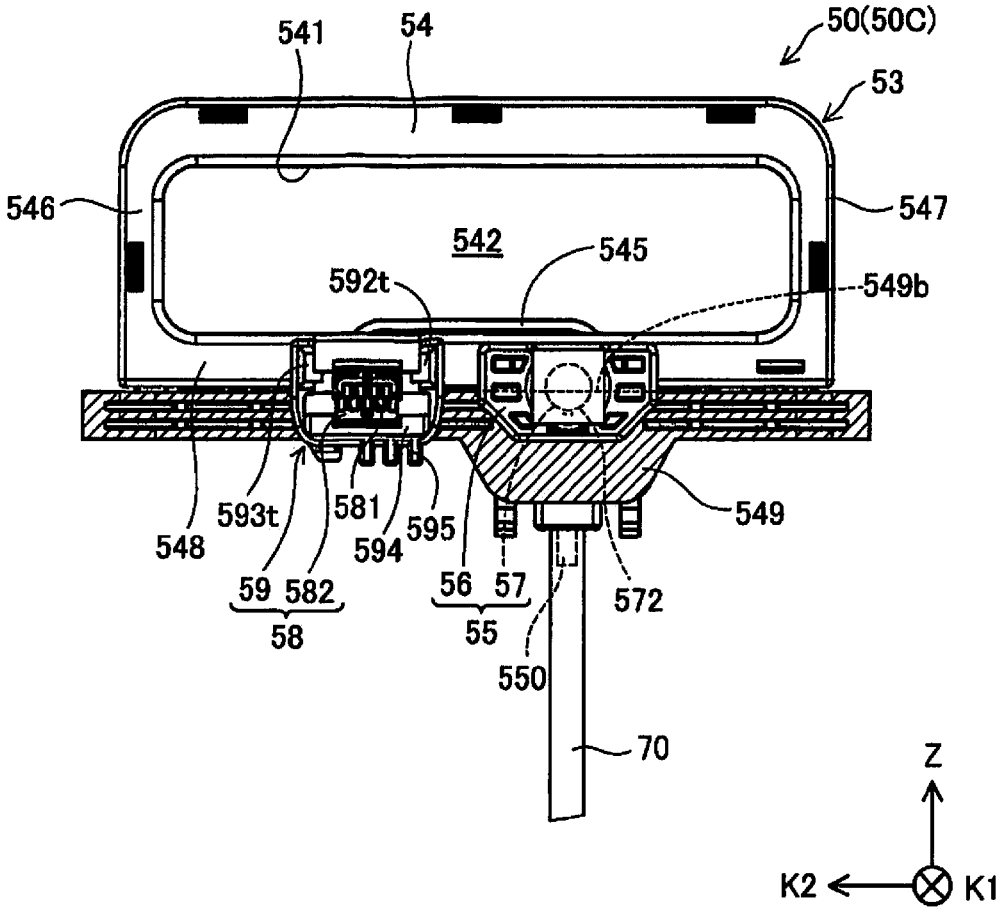
FIG. 33 is a front surface diagram illustrating one part of a liquid container.
Figure 34:
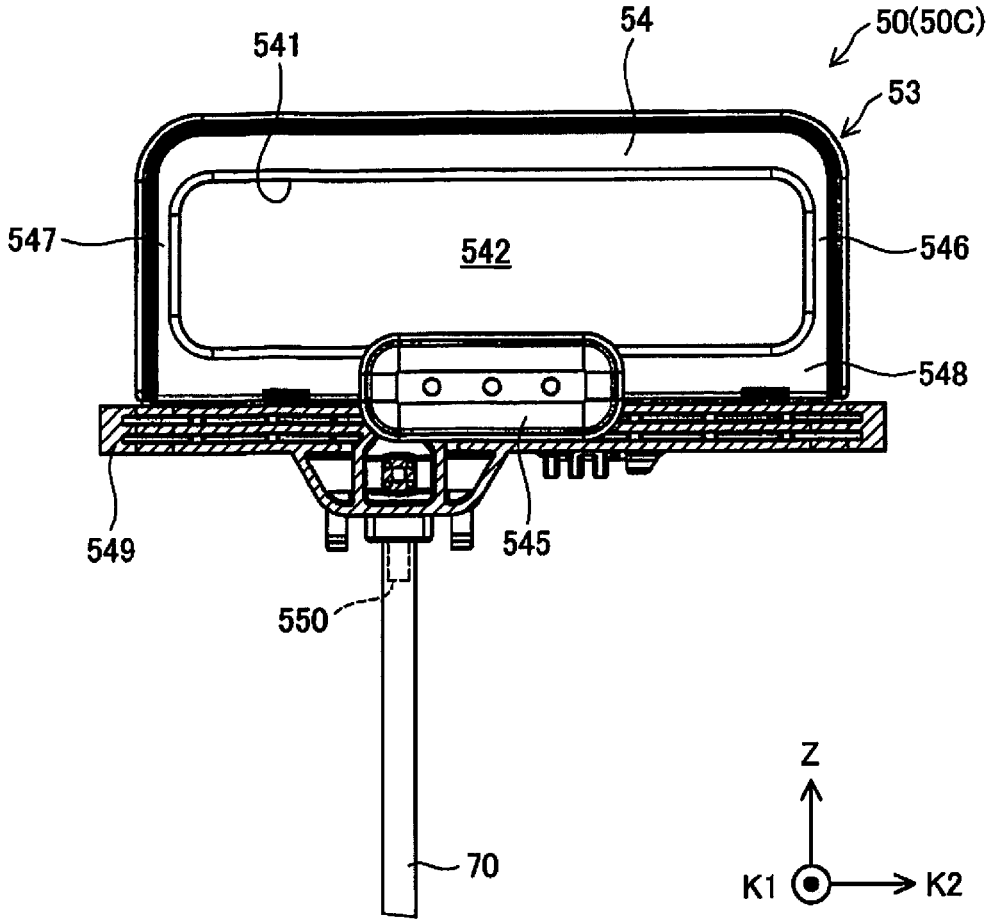
FIG. 34 is a rear surface diagram of one part of a liquid container.
Figure 35:
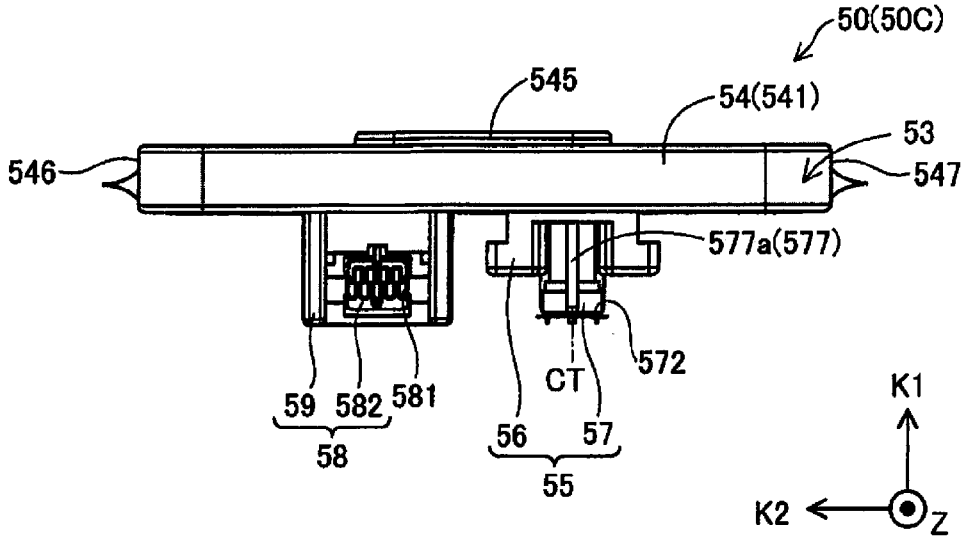
FIG. 35 is an upper surface diagram of one part of a liquid container.
Figure 36:
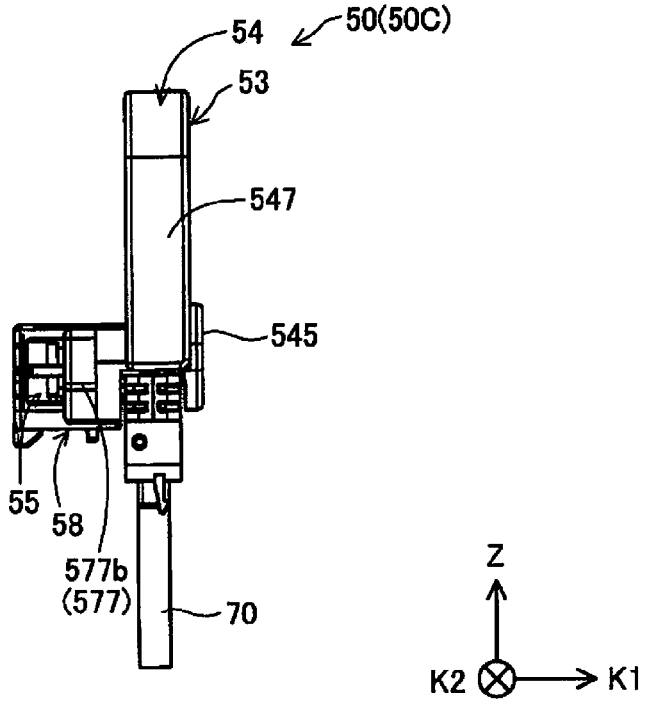
FIG. 36 is a right side surface diagram of one part of a liquid container.

FIG. 29, FIG. 30, FIG. 31, and FIG. 32 are perspective diagrams illustrating one part of the liquid container 50. The one part is a part which excludes a portion of the flow path member 70 and the liquid containing bag 52. FIG. 33 is a front surface diagram of the one part of the liquid container 50. FIG. 34 is a rear surface diagram of the one part of the liquid container 50. FIG. 35 is an upper surface diagram of the one part of the liquid container 50. FIG. 36 is a right side surface diagram of the one part of the liquid container 50.

Figure 29:
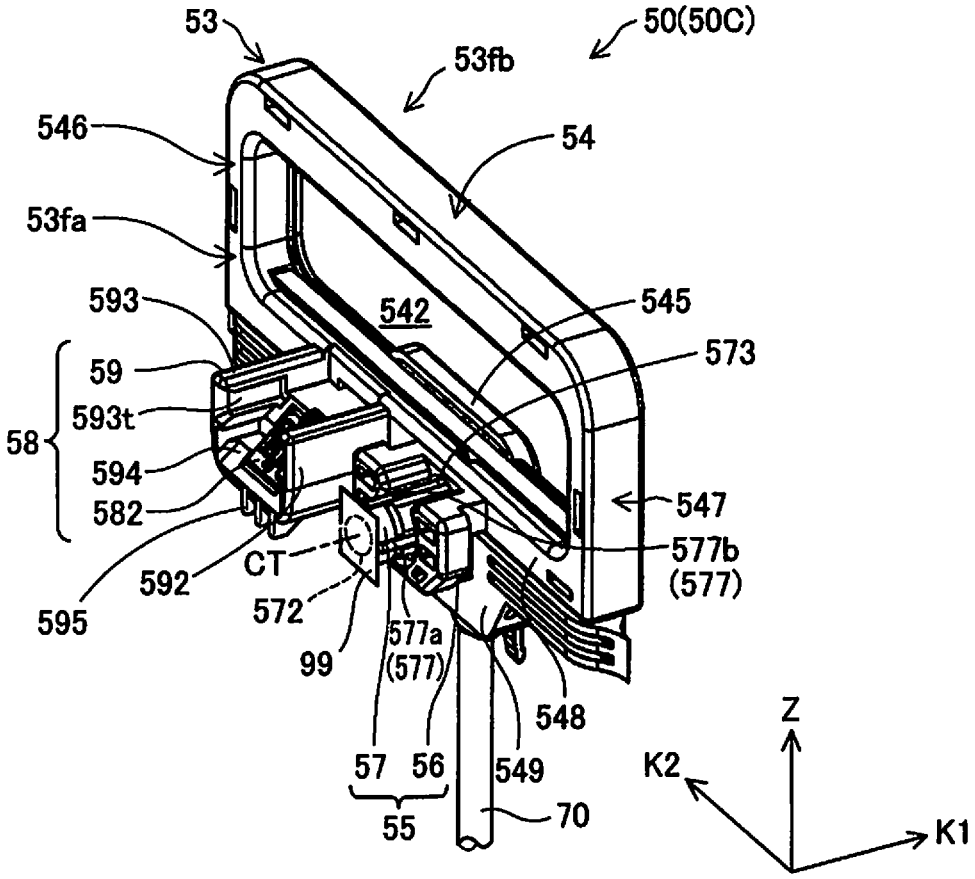
FIG. 29 is a perspective diagram illustrating one part of a liquid container.
Figure 30:
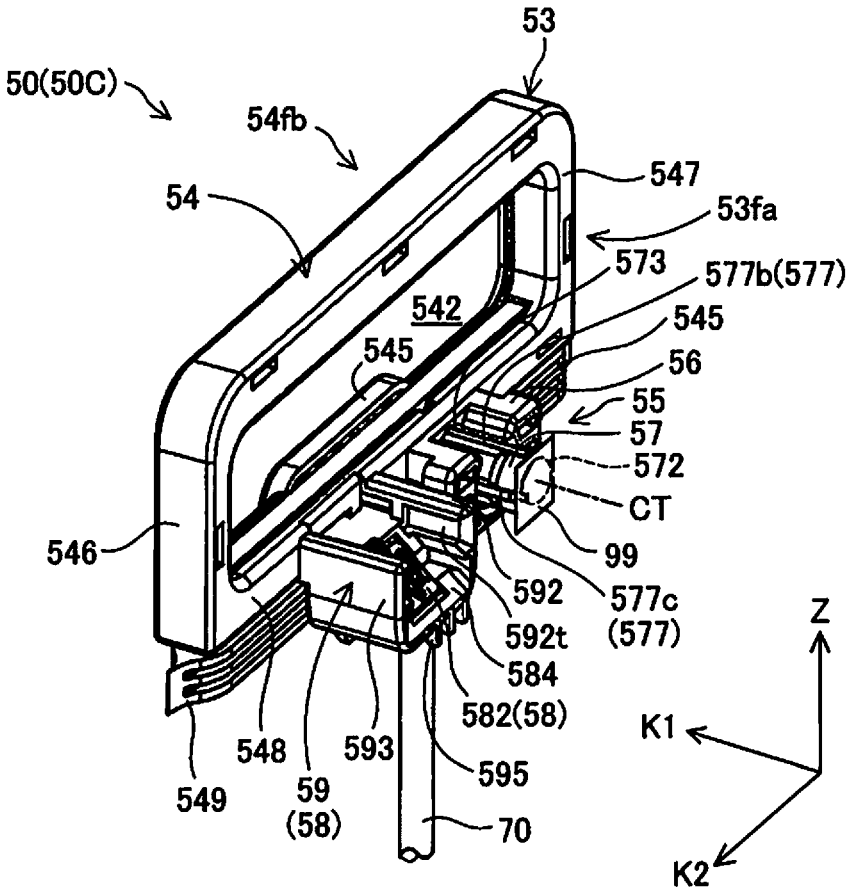
FIG. 30 is a perspective diagram illustrating one part of a liquid container.

As shown in FIG. 29 and FIG. 30, the operation member 53 is provided with the grasping portion 54, a first connecting section 546, a second connecting section 547, the base portion 548, and the joining portion 549.

The grasping portion 54, the first connecting section 546, the second connecting section 547, and the base portion 548 form a frame. A receiving space section 542 is formed due to the frame. The receiving space section 542 is a space where a hand of a user is inserted.

Figure 31:
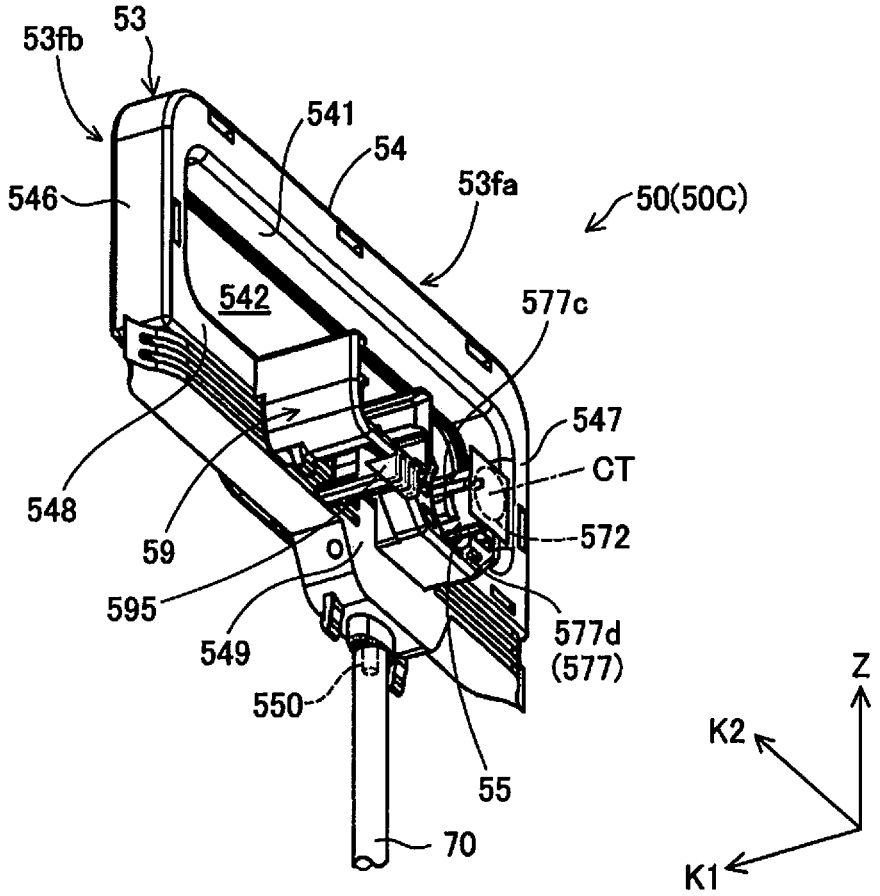
FIG. 31 is a perspective diagram illustrating one part of a liquid container.

The grasping portion 54 is a part which is grasped by a user. The grasping portion 54 extends along the K2 axis direction. As shown in FIG. 31, the grasping portion 54 has a grasping surface 541 which is in contact with the receiving space section 542. The grasping surface 541 is a part which is grasped by a user. The grasping surface 541 is substantially horizontal in the mounting state.

As shown in FIG. 29, the first connecting section 546 is a member which extends from one end portion of the grasping portion 54 to the base portion 548 side (in the −Z axis direction on the liquid containing bag 52 side) in the K2 axis direction. The second connecting section 547 is a member which extends from the other end portion of the grasping portion 54 to the base portion 548 side (in the −Z axis direction on the liquid containing bag 52 side) in the K2 axis direction.

The base portion 548 is a part which opposes the grasping portion 54 so as to interpose the receiving space section 542. The base portion 548 extends along the K2 axis direction. The positioning portion 56, the circuit board holding portion 59, and the pushing portion 545 (FIG. 32) are attached to the base portion 548. That is, the liquid supply unit 55 and the circuit board holding portion 59 are coupled to each other via the base portion 548. Coupling has the meaning of members which are coupled being connected so as to move by being interlocked with each other. Due to this, it is possible for not only the operation member 53 but also the liquid container 50 to move integrally.

The joining portion 549 is positioned on the opposite side to a side where the grasping portion 54 is positioned so as to interpose the base portion 548. The joining portion 549 is adjacent to the base portion 548. The joining portion 549 extends along the K2 axis direction. As described above, the joining portion 549 is a part which is joined to the one end 501 of the liquid containing bag 52 (FIG. 7) by welding or the like. The single hatching which is applied in FIG. 33 and FIG. 34 indicates a joining surface with the liquid containing bag 52.

As shown in FIG. 29 and FIG. 30, the liquid supply unit 55 has the liquid supply pipe portion 57 and the positioning portion 56. The liquid supply unit 55 is provided so as to protrude outward (in the −K1 axis direction) from the operation member 53.

As shown in FIG. 33, the grasping surface 541 is arranged more to the +Z axis direction side than the liquid supply pipe portion 57. As shown in FIG. 35, the liquid supply port 572 is provided so as to be offset in the −K1 axis direction with regard to the grasping portion 54. In other words, the liquid supply port 572 does not overlap with the grasping surface 541 in a case where the liquid container 50 is viewed in a direction which is orthogonal to the grasping surface 541 and in an orientation from the grasping surface 541 to the liquid supply pipe portion 57 (in the −Z axis direction). That is, the grasping surface 541 and the liquid supply port 572 do not overlap in a case where the liquid container 50 is projected onto a surface which is orthogonal to the grasping surface 541. As shown in FIG. 33, the liquid supply pipe portion 57 is provided such that a portion overlaps with the joining portion 549*b* when viewed from the liquid supply port 572 side along the K1 axis direction. In other words, the liquid supply port 572 is provided such that at least a portion overlaps with the joining portion 549*b* when viewed from the liquid supply port 572 side along the K1 axis direction.

The positioning portion 56 performs positional alignment of the liquid container 50 which includes the liquid supply port 572 to a certain degree with regard to the printer 10 when the liquid container 50 is connected with the printer 10. The positioning portion 56 is provided integrally with the coupling member 53A. In the first embodiment, the positioning portion 56 is provided integrally with the coupling member 53A due to being formed by being integrally molded with the coupling member 53A.

As shown in FIG. 29 and FIG. 30, the positioning portion 56 is arranged in the surroundings of the liquid supply pipe portion 57 which is centered on the central axis CT. The central axis CT is a virtual central axis line of the liquid supply pipe portion 57. The central axis CT is parallel to the K1 axis direction. However, the positioning portion 56 is not arranged on the grasping portion 54 side out of the surroundings of the liquid supply pipe portion 57. The positioning portion 56 is arranged on the inner side of a supply section support portion 42 which is provided in the attaching and detaching unit 30 when the liquid container 50 is connected with the attaching and detaching unit 30 (refer to FIG. 37 to FIG. 43).

As shown in FIG. 29 and FIG. 30, the substrate unit 58 is provided with the circuit board 582 and the circuit board holding portion 59. The substrate unit 58 is provided so as to protrude outward from the operation member 53 (in the −K1 axis direction). The protruding direction of the substrate unit 58 is the same as the protruding direction of the liquid supply pipe portion 57 (the −K1 axis direction). Here, the protruding direction of the substrate unit 58 and the protruding direction of the liquid supply pipe portion 57 need not be the same and it is sufficient if the protruding directions are substantially parallel. The substrate unit 58 and the liquid supply pipe portion 57 protrude from the operation member 53 in the same orientation with regard to the operation member 53 (in the −K1 axis direction).

As shown in FIG. 35, the substrate unit 58 is provided so as to line up with the liquid supply unit 55 in a direction which is parallel with the grasping surface 541. In detail, the substrate unit 58 and the liquid supply unit 55 are provided so as to line up in a direction which is parallel to the grasping surface 541 and in a direction which is orthogonal to the central axis CT (in the K2 axis direction).

As shown in FIG. 29, the circuit board holding portion 59 positions the circuit board 582 with regard to the attaching and detaching unit 30 when the liquid container 50 is connected with the attaching and detaching unit 30. The circuit board holding portion 59 is provided integrally with the operation member 53. In the first embodiment, the circuit board holding portion 59 is provided integrally with the coupling member 53A due to being formed by being integrally molded as a portion of the coupling member 53A.

The circuit board holding portion 59 has a concave shape. As shown in FIG. 21, concave shape has the meaning that the rough contours are seen as a concave shape in a front surface diagram. The bottom portion 594 which is equivalent to the hollow in the concave shape is inclined with regard to the grasping surface 541. The circuit board 582 is held by the circuit board holding portion 59 so as to be inclined due to the circuit board 582 being attached to the bottom portion 594.

The circuit board holding portion 59 has the first side wall section 592 and the second side wall section 593 which respectively extend from both sides of the bottom portion 594 in the K2 axis direction to the +Z axis direction side. As shown in FIG. 30, the first side wall section 592 has a groove section 592*t*. As shown in FIG. 29, the second side wall section 593 has a groove section 593*t*. The groove sections 592*t* and 593*t* are utilized in positional alignment of the circuit board holding portion 59.

As shown in FIG. 33, the circuit board 582 has a plurality of terminals 581 on the front surface. In the first embodiment, nine of the terminals 581 are arranged to correspond to the number (nine) of apparatus side terminals 381. In the first embodiment, the outer shape of the terminal 581 is substantially rectangular. In addition, the memory apparatus 583 (FIG. 13) is arranged on the rear surface of the circuit board 582. The memory apparatus 583 stores information which relates to the liquid container 50 (for example, ink color and date of manufacture). The memory apparatus 583 and the plurality of terminals 581 are electrically connected. In the mounting state, the plurality of terminals 581 are respectively electrically connected with the apparatus side terminals 381 which are provided in the printer 10 (refer to FIG. 37 to FIG. 42).

As shown in FIG. 35, the grasping surface 541 is arranged at a direction (the +Z axis direction) side which is perpendicular to the central axis CT direction of the liquid supply pipe portion 57. The substrate unit 58 is provided so as to be offset in the central axis CT direction with regard to the operation member 53 which includes the grasping surface 541. In other words, the substrate unit 58 is arranged at a position which does not overlap with the grasping surface 541 (the operation member 53) when the liquid container 50 is viewed in a direction which is orthogonal to the grasping surface 541 and in an orientation from the grasping surface 541 to the liquid supply pipe portion 57 (the −Z axis direction). That is, there is a positional relationship where the grasping surface 541 and the substrate unit 58 do no overlap when the liquid container 50 is projected onto a surface which is perpendicular to the grasping surface 541.

Figure 32:
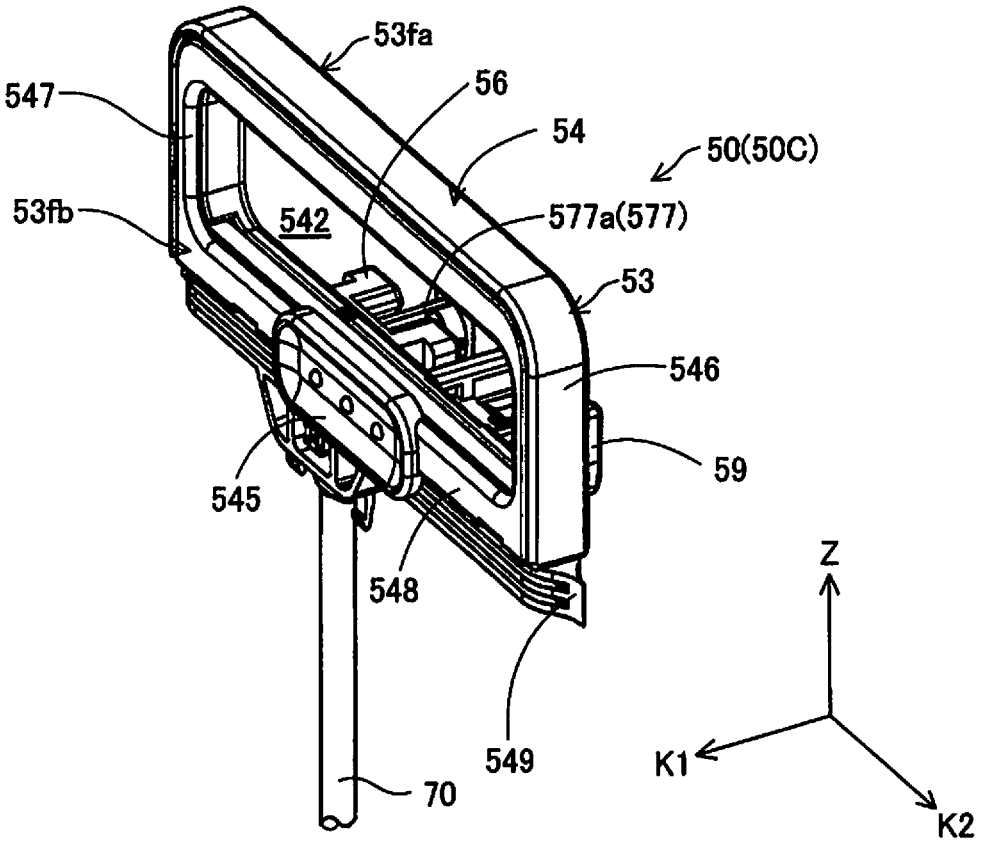
FIG. 32 is a perspective diagram illustrating one part of a liquid container.

As shown in FIG. 31 and FIG. 32, the circuit board holding portion 59 and the positioning portion 56 are provided on the first side 53*fa* which is the same side.

As shown in FIG. 32, the pushing portion 545 is provided on the front surface of the second side 53*fb* as shown in FIG. 32 in contrast to the positioning portion 56 and the circuit board holding portion 59 being provided on the front surface of the first side 53*fa* as shown in FIG. 31.

The pushing portion 545 is a part which is pressed by a user when the liquid container 50 is connected with the printer 10. A user moves the movable member 40 (refer to FIG. 37 to FIG. 42), where the liquid container 50 is set, to the −K1 axis direction side by pushing the pushing portion 545 to the −K1 axis direction side.

The pushing portion 545 is provided so as to protrude outward (in the +K1 axis direction) from the operation member 53. Due to this, it is easy to identify the pushing portion 545 and other parts. As a result, it is possible for a user to be prompted to carry out an operation of pushing the pushing portion 545 when the liquid container 50 is connected with the printer 10.

As shown in FIG. 34, a portion of the outer shape of the pushing portion 545 sticks out more to the outer side than the base portion 548 in the Z axis direction when the operation member 53 is viewed from a direction along the K1 axis direction. Since the area is set to be large, the pushing portion 545 is easy to push in this manner.

As shown in FIG. 29 to FIG. 33, an identification rib 595 is provided at a lower section of the circuit board holding portion 59. The identification rib 595 has a shape which is different for each of the colors of inks which are contained. The attaching and detaching unit 30 is provided with an engaging groove 596 (FIG. 40) in order to receive only the liquid container 50 of the correct ink color.

Configuration of Attaching and Detaching Unit 30

Figure 37:
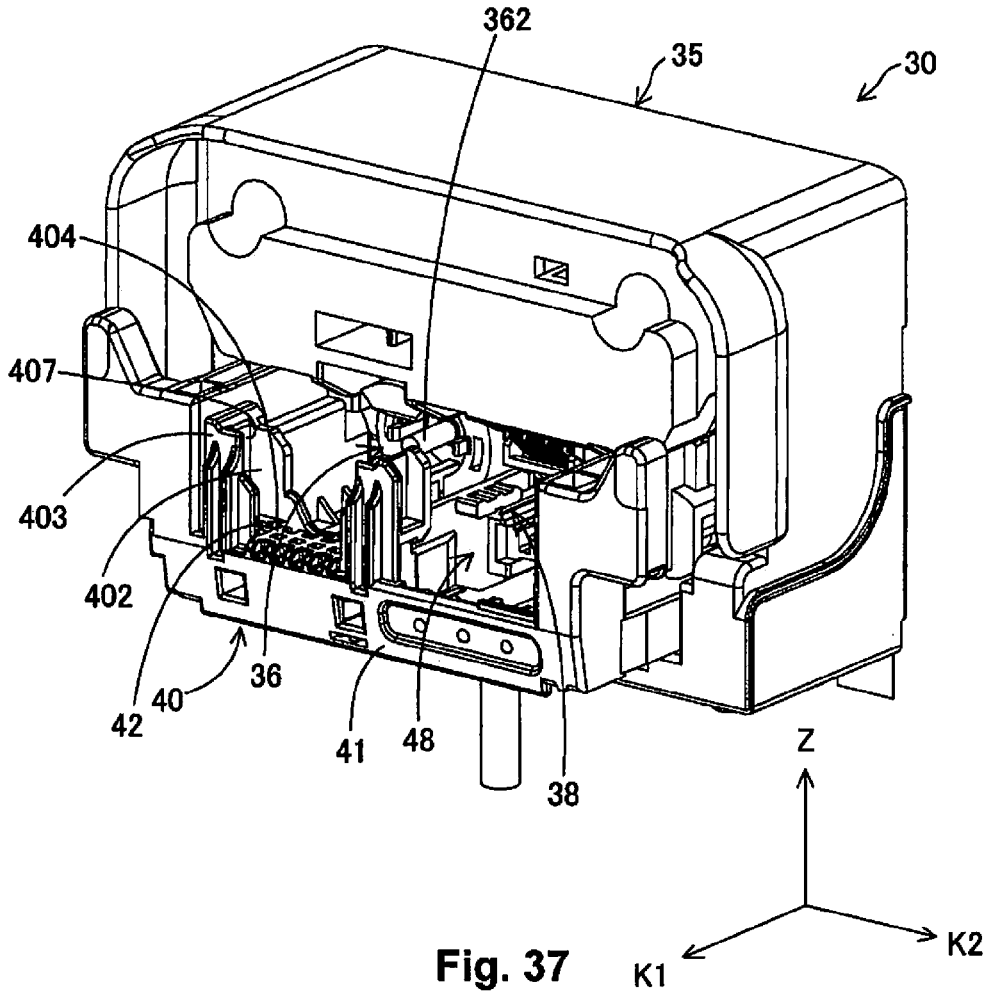
FIG. 37 is a perspective diagram for describing an attaching and detaching unit.
Figure 38:
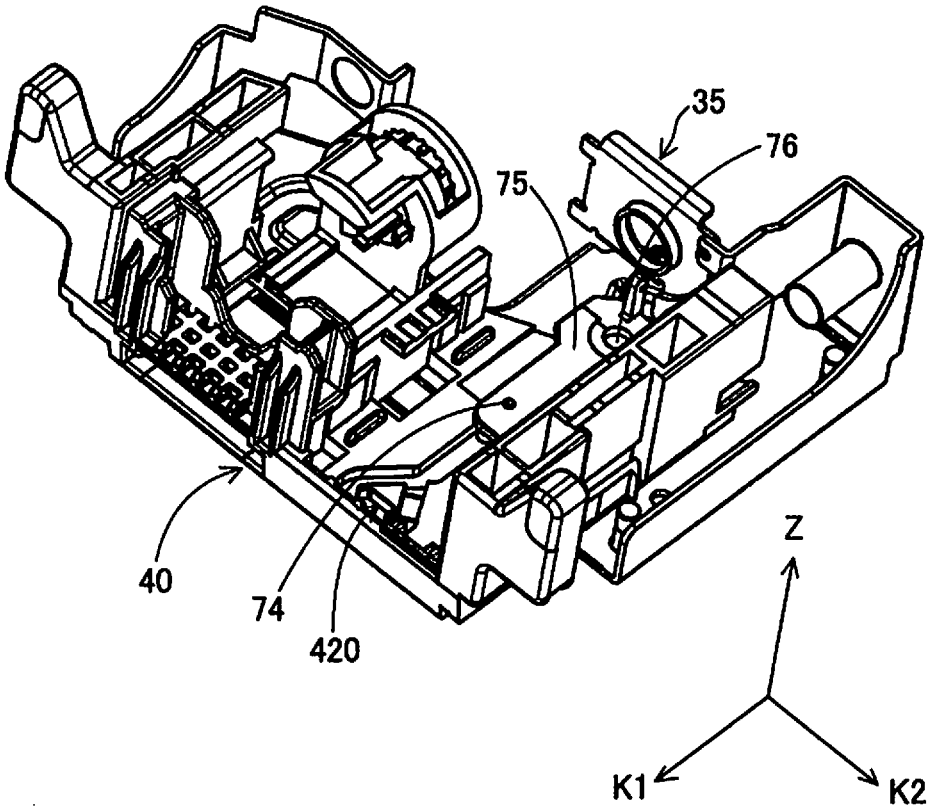
FIG. 38 is a perspective diagram for describing an attaching and detaching unit.
Figure 39:
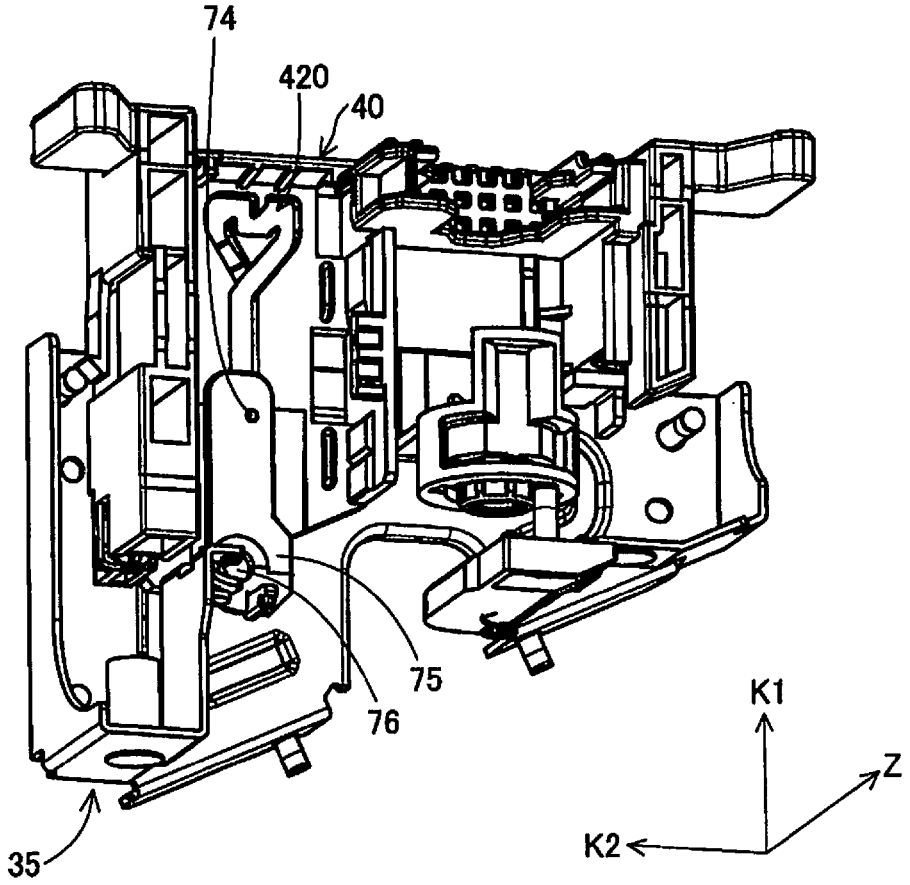
FIG. 39 is a perspective diagram for describing an attaching and detaching unit.
Figure 40:
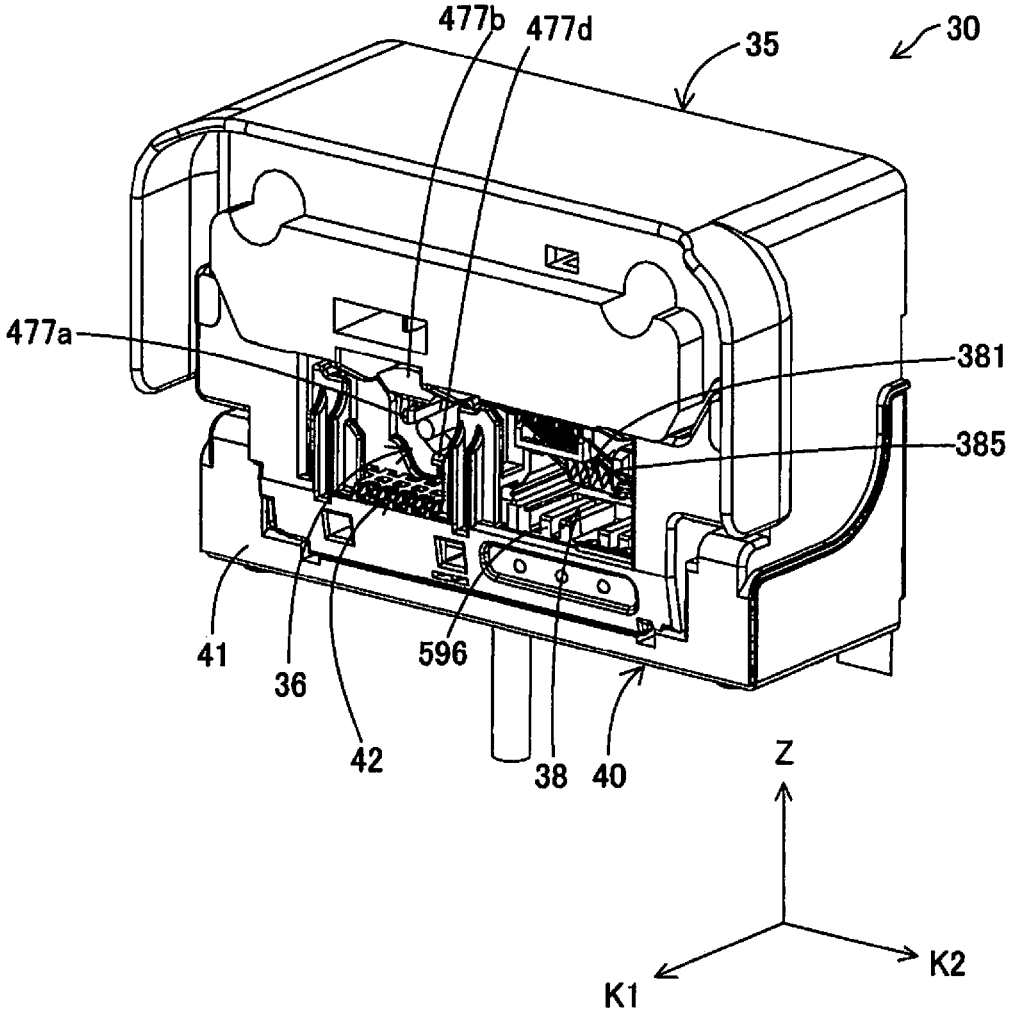
FIG. 40 is a perspective diagram for describing an attaching and detaching unit.

FIG. 37 to FIG. 42 are perspective diagrams for describing the attaching and detaching unit 30. FIG. 38, FIG. 39, FIG. 41, and FIG. 42 omit illustration of a portion of a fixing member 35. As shown in FIG. 37 and FIG. 40, the attaching and detaching unit 30 is provided with the fixing member 35 and the movable member 40. FIG. 37 to FIG. 39 are perspective diagrams illustrating the attaching and detaching unit 30 and illustrate a state where the movable member 40 protrudes to the outside with regard to the fixing member 35. In this state, a state where the liquid container 50 is set in the movable member 40 is referred to as a "set state". The "set state" is a state where the positioning portion 56 and the circuit board holding portion 59 are engaged with the movable member 40.

Figure 41:
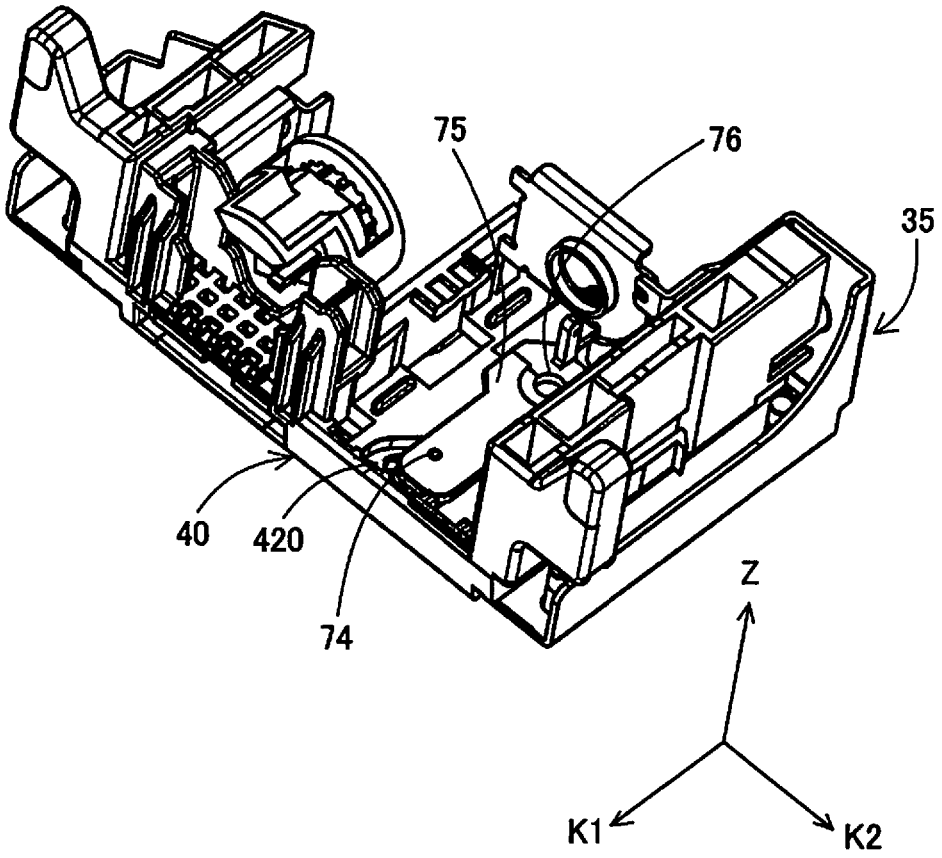
FIG. 41 is a perspective diagram for describing an attaching and detaching unit.
Figure 42:
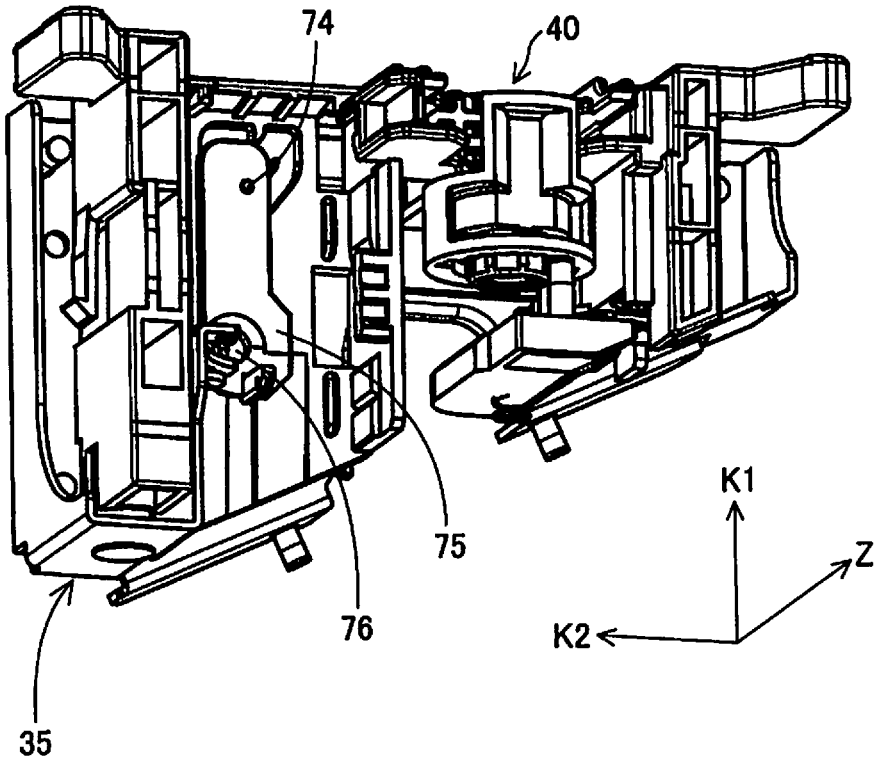
FIG. 42 is a perspective diagram for describing an attaching and detaching unit.

FIG. 40 to FIG. 42 are perspective diagrams illustrating the attaching and detaching unit 30 and illustrate a state where the movable member 40 is contained in the fixing member 35. The result is the mounting state after transitioning to this state from the set state.

The movable member 40 is colored in the corresponding color of ink. The corresponding color of ink is a color of the same group as the color of ink which is contained so as to be connected with the liquid containing bodies 50K, 50C, 50 M, or 50Y.

The fixing member 35 is provided with a liquid introduction structure 36 and a contact structure 38. The liquid introduction structure 36 and the contact structure 38 are arranged so as to line up along the K2 axis direction. The liquid introduction structure 36 has the liquid introducing portion 362.

The movable member 40 is configured so as to be able to move along the K1 axis direction with regard to the fixing member 35. The movable member 40 is provided with a base portion 41, the supply section support portion 42, and a substrate support portion 48. The supply section support portion 42 and the substrate support portion 48 are each connected with the base portion 41. The supply section support portion 42 and the supply section support portion 48 are each members which are provided on the +Z axis direction side with regard to the base portion 41.

As shown in FIG. 40, the contact structure 38 is provided with a plurality (nine in the first embodiment) of the apparatus side terminals 381 and a plurality (two in the first embodiment) of substrate positioning portions 385. In a state where the liquid container 50 is mounted, the apparatus side terminals 381 are electrically connected with the circuit board 582 of the liquid container 50. Due to this, it is possible transmit and receive various types of information (for example, ink color and date of manufacture of the liquid container 50) between the circuit board 582 and the printer 10. The apparatus side terminals 381 are formed using a flat spring.

The substrate positioning portion 385 is arranged at both sides (only one side is shown in FIG. 40) in the K2 axis direction (a direction where the liquid introduction structure 36 and the contact structure 38 are lined up). The substrate positioning portion 385 performs final positional alignment of the circuit board in the liquid container 50 with regard to the apparatus side terminals 381 when the liquid container 50 is mounted in the attaching and detaching unit 30. The substrate positioning portion 385 is a member which extends along the K1 axis direction.

The supply section support portion 42 is a member for determining the position of the liquid container 50 to a certain extent with regard to the liquid introducing portion 362. The supply section support portion 42 is provided at a position which overlaps with the liquid introducing portion 362 when the attaching and detaching unit 30 is viewed along the K1 axis direction.

The supply section support portion 42 is provided so as to be formed in a concave shape. Concave shape has the meaning that the contours have a rough concave shape when viewed from the front surface. Here, the front surface is a surface where the +Z axis direction faces upward and the −K1 axis direction faces inward. Groove sections 407 are formed at both sides of the supply section support portion 42 in the K2 axis direction. Movement of the liquid supply pipe portion 57 is limited due to the positioning portion 56 described above (FIG. 29 to FIG. 31) being pushed into the groove section 407 from above. That is, movement of the liquid supply pipe portion 57 is limited due to a plurality of surface sections (for example, a first support surface section 402, a second support surface section 403, and a third support surface section 404) which are formed so as to partition the supply section support portion 42. As a result, the liquid container 50 is positioned to a certain extent with regard to the attaching and detaching unit 30.

The positioning portion 56 is arranged at the inner side of the supply section support portion 42 when the liquid container 50 is connected with the printer 10. Due to this, the positioning portion 56 abuts with the plurality of surface sections (the first support surface section 402, the second support surface section 403, and the third support surface section 404 shown in FIG. 37), which are formed so as to partition the supply section support portion 42, in the set state. As a result, movement of the liquid supply pipe portion 57 is limited. Thus, the liquid container 50 is positioned to a certain extent in the K2-Z horizontal plane. Here, abutting may be positioning according to parallel movement (translation) in the K2-Z horizontal plane and need not be positioning according to rotation in the K2-Z horizontal plane.

The substrate support portion 48 is a member for determining the position of the circuit board 582 with regard to the contact structure 38. The substrate support portion 48 is provided at a position which overlaps with the contact structure 38 when the attaching and detaching unit 30 is viewed along the K1 axis direction. The substrate support portion 48 is provided so as to form the same concave shape as the supply section support portion 42. Movement of the circuit board in the liquid container 50 is limited by a plurality of surface sections (for example, a first substrate support surface section 482) which are formed so as to partition the substrate support portion 48.

Figure 46:
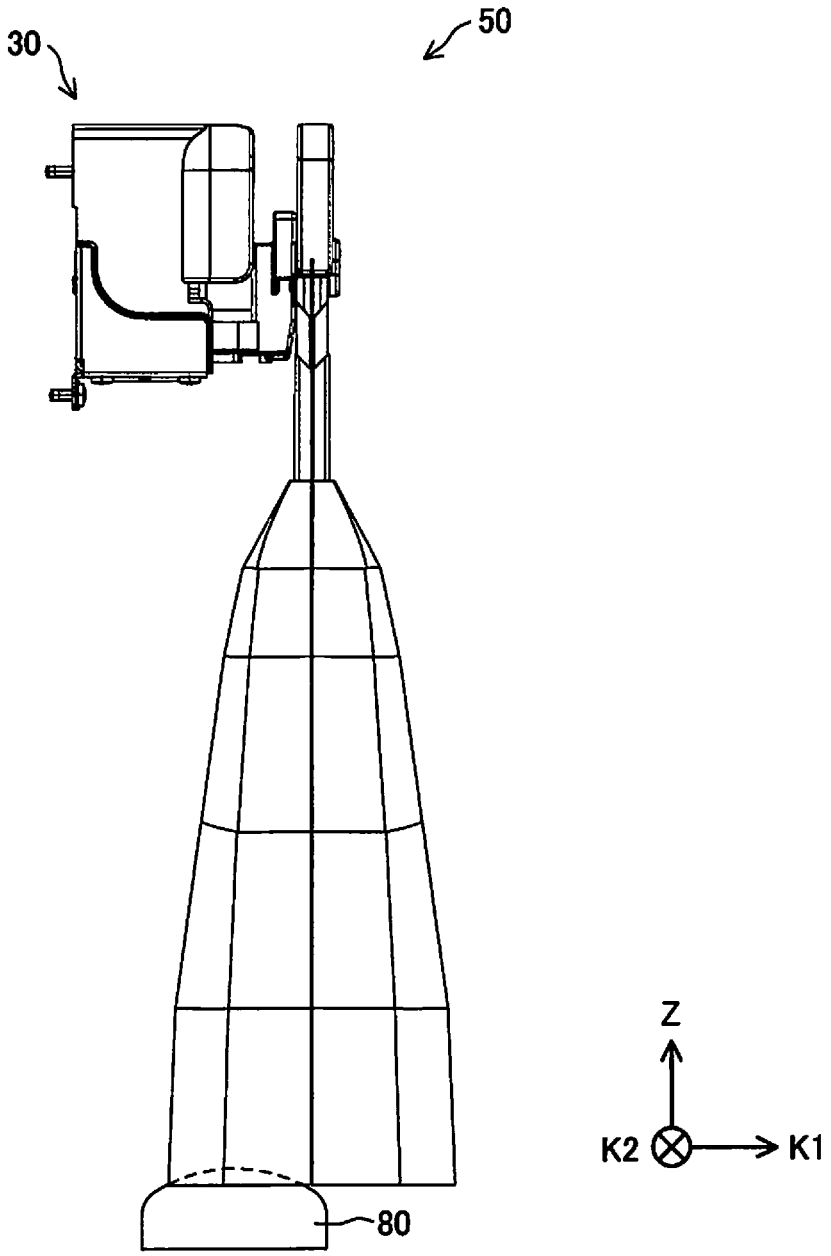
FIG. 46 is a side surface diagram illustrating an attaching and detaching unit, a liquid container, and an contacting part (in a set state).

The circuit board holding portion 59 is supported by the substrate support portion 48 (FIG. 37) when the liquid container 50 is newly mounted in the attaching and detaching unit 30. Due to this, the circuit board holding portion 59 and the circuit board 582 are positioned to a certain extent in the K2-Z horizontal plane with regard to the apparatus side terminals 381 (FIG. 46). Then, the substrate positioning portion 385 (FIG. 40) is pushed into the groove section 593*t* (FIG. 29) of the circuit board holding portion 59, and one more of the substrate positioning portions 385 (which is not shown in the drawings) is pushed into the groove section 592*t* (FIG. 30) of the circuit board holding portion 59 due to the movable member 40 being moved in the −K1 axis direction. Due to this, positional alignment of the circuit board holding portion 59 and the circuit board 582 is performed with regard to the apparatus side terminals 381.

When transitioning to the mounting state, the liquid supply port 572 is connected with the liquid introducing portion 362 in a state of being positioned by protrusions 577 (577*a*, 577*b*, 577*c*, and 577*d*, refer to FIG. 29 to FIG. 31) which are provided in the liquid supply pipe portion 57 abutting with positional alignment protrusions 477 (477*a*, 477*b*, 477*c*, and 477*d*, refer to FIG. 40) which are provided in the fixing member 35. The liquid introducing portion 362 is provided with a flow path at an interior in the same manner as the liquid filling member 13. Ink is supplied to the printer 10 through the flow path.

As shown in FIG. 38, FIG. 39, FIG. 41, and FIG. 42, the movable member 40 is provided with a heart-shaped cam 420, and the attaching and detaching unit 30 is provided with a follower 75. The follower 75 is provided with an engaging protrusion 74. The engaging protrusion 74 is a member which protrudes out in the −Z axis direction, but a part which engages with the follower 75 in the +Z axis direction is shown in FIG. 38, FIG. 39, FIG. 41, and FIG. 42. The follower 75 is a member which is coupled with the fixing member 35 via the connecting section 76. The follower 75 engages with the movable member 40 due to the engaging protrusion 74 engaging with the heart-shaped cam 420.

Figure 43:
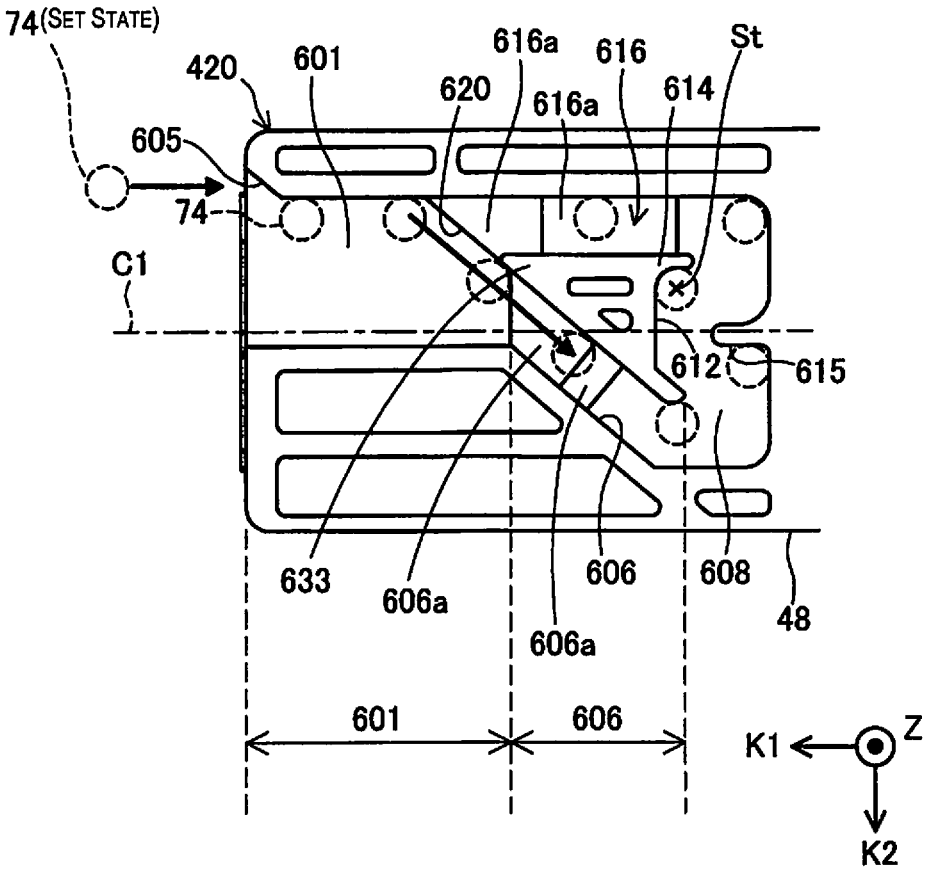
FIG. 43 is a diagram for describing maintaining of and transitioning between each state.

FIG. 43 is a diagram for describing maintaining of and transitioning between each state. Each state has the meaning of the set state and the mounting state described above. Transitioning from the set state to the mounting state is referred to below as a "mounting operation" and transitioning from the mounting state to the set state is referred to below as a "removal operation".

FIG. 43 schematically illustrates the heart-shaped cam 420. As shown in FIG. 43, the heart-shaped cam 420 is provided with a receiving section 601, a guiding section 606, a connecting section 608, an engaging portion 612, and an outlet section 616.

During the mounting operation, the engaging protrusion 74 moves in order between the receiving section 601, the guiding section 606, the connecting section 608, and the engaging portion 612. In the mounting state, the engaging protrusion 74 engages with the engaging portion 612 at a predetermined engaging position St in the engaging portion 612. During the removal operation, the engaging protrusion 74 moves in order between the engaging portion 612, the outlet section 616, and the receiving section 601.

The receiving section 601 forms an opening 605 and receives the engaging protrusion 74 from the opening 605. The receiving section 601 is deeper than the other sections 606, 608, 612, and 616 of the heart-shaped cam 420. "Deep" has the meaning of being positioned in the −Z axis direction.

The guiding section 606 is a part for leading the engaging protrusion 74 to the engaging position St (a position where the engaging portion 612 is formed). The guiding section 606 is connected with the receiving section 601. The guiding section 606 guides the engaging protrusion 74 diagonally with regard to the movement direction of the movable member 40 (the −K1 axis direction). The guiding section 606 has an inclination section 606*a*. A groove of the inclination section 606*a* becomes shallower in accompaniment with separation from the receiving section 601. There is no step at a boundary between the guiding section 606 and the receiving section 601.

The connecting section 608 connects the guiding section 606 and the engaging portion 612. The connecting section 608 has a protrusion wall 615. The protrusion wall 615 protrudes from a wall, which forms an impasse in the −K1 axis direction, to the +K1 axis direction side.

The engaging portion 612 opposes the protrusion wall 615. The engaging portion 612 has an engaging wall 614. The engaging wall 614 is formed by a wall section 633. The wall section 633 is one of a plurality of wall sections which are formed so as to partition the groove of the heart-shaped cam 420. The outlet section 616 connects the engaging portion 612 and the receiving section 601. The outlet section 616 has an inclination section 616*a*. A groove of the inclination section 616*a* becomes deeper in accompaniment with the receiving section 601 becoming closer. A step 620 is formed at the boundary between the outlet section 616 and the receiving section 601.

Movement of the engaging protrusion 74 inside the heart-shaped cam 420 will be described using FIG. 43. FIG. 43 illustrates relative movement of the engaging protrusion 74 with regard to the movable member 40. In practice, the movable member 40 moves in the K1 axis direction with regard to the fixing member 35 and the engaging protrusion 74 rotates centered on the connecting section 76.

The movable member 40 normally receives a force from the fixing member 35 in the +K1 axis direction due to an elastic force from an elastic member such as a spring (which is not shown in the drawings). The connecting section 76 normally has torque acting on the follower 75 while being connected with the follower 75 so as to be able to rotate. The rotation axis is the Z axis which passes through the connecting section 76. The orientation of the torque which is generated by the connecting section 76 is an orientation so that there is rotation when a right screw advances in the +Z axis direction.

The engaging protrusion 74 moves from the receiving section 601 to the guiding section 606 along the step 620 during the mounting operation. The engaging protrusion 74 reaches the connecting section 608 due to the movable member 40 being pushed along in a mounting direction (the −K1 axis direction) against the elastic force described above. The engaging protrusion 74 which reaches the connecting section 608 moves in a direction which includes a −K2 axis direction component due to the torque described above. Due to this, the engaging protrusion 74 collides with the protrusion wall 615 and stops. At this time, a click sound is generated. A user understands that it is not necessary to push further due to the click sound.

When the user stops pushing in the mounting direction, the movable member 40 is pushed back in a removal direction (in the +K1 axis direction) due to the elastic force described above. Due to this, engaging due to the protrusion wall 615 is released and the engaging protrusion 74 reaches the engaging portion 612. Then, the engaging protrusion 74 collides with the engaging wall 614 due to the torque described above. A click sound is generated due to the collision. A user understands that the mounting operation is completed due to the click sound.

The removal operation is realized by the following sequence. A user pushes against the movable member 40 in the mounting direction. Due to this, the engaging protrusion 74 is separated from the engaging wall 614. By doing this, the movable member 40 moves in the −K2 axis direction due to the torque described above and engaging is released. In accompaniment with this, the engaging protrusion 74 collides with the wall. A click sound is generated due to the collision. A user understands that it is not necessary to push further due to the click sound.

When a user stops pushing in the mounting direction in a state where engaging is released, the movable member 40 moves in the removal direction due to the torque described above and the engaging protrusion 74 reaches the receiving section 601 by passing thorough the outlet section 616. As a result, the removal operation is complete.

Mounting of Liquid Container 50 in Attaching and Detaching Unit 30

Figure 44:
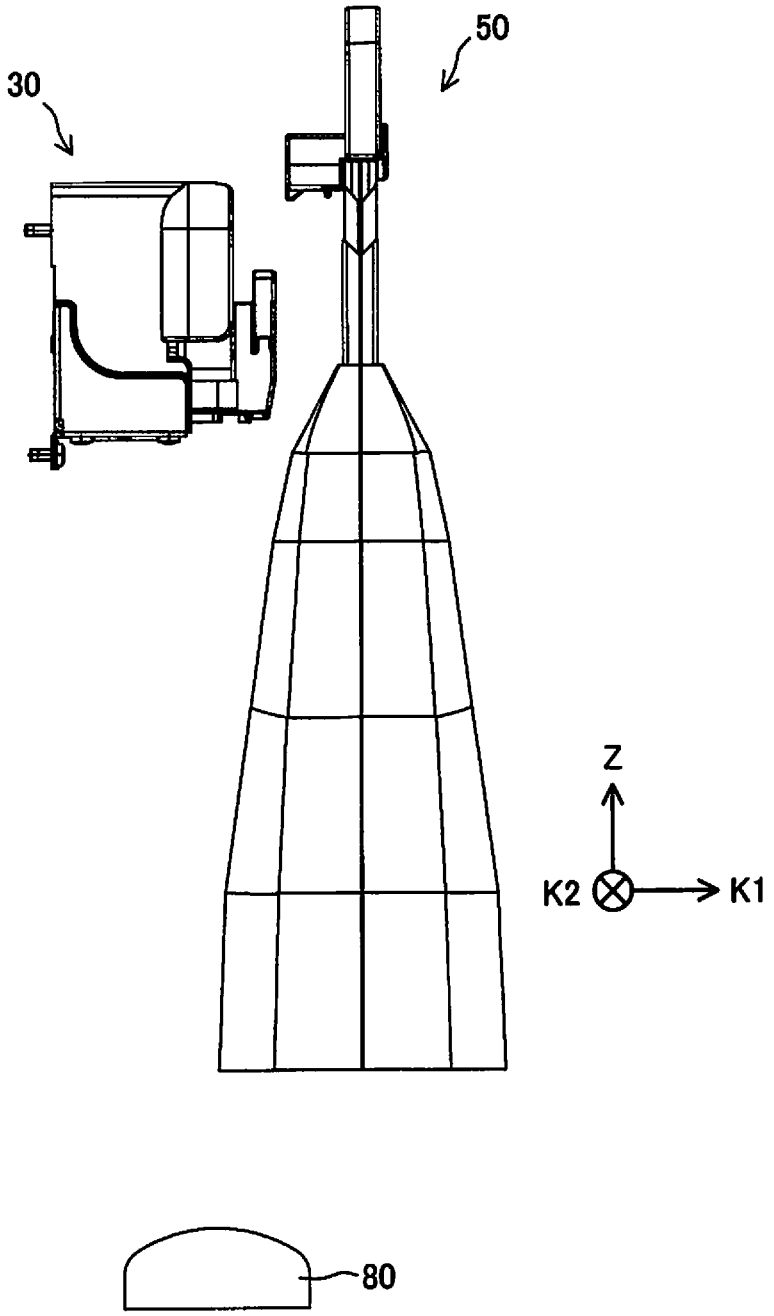
FIG. 44 is a side surface diagram illustrating an attaching and detaching unit, a liquid container, and an contacting part (in a non-contact state).
Figure 45:
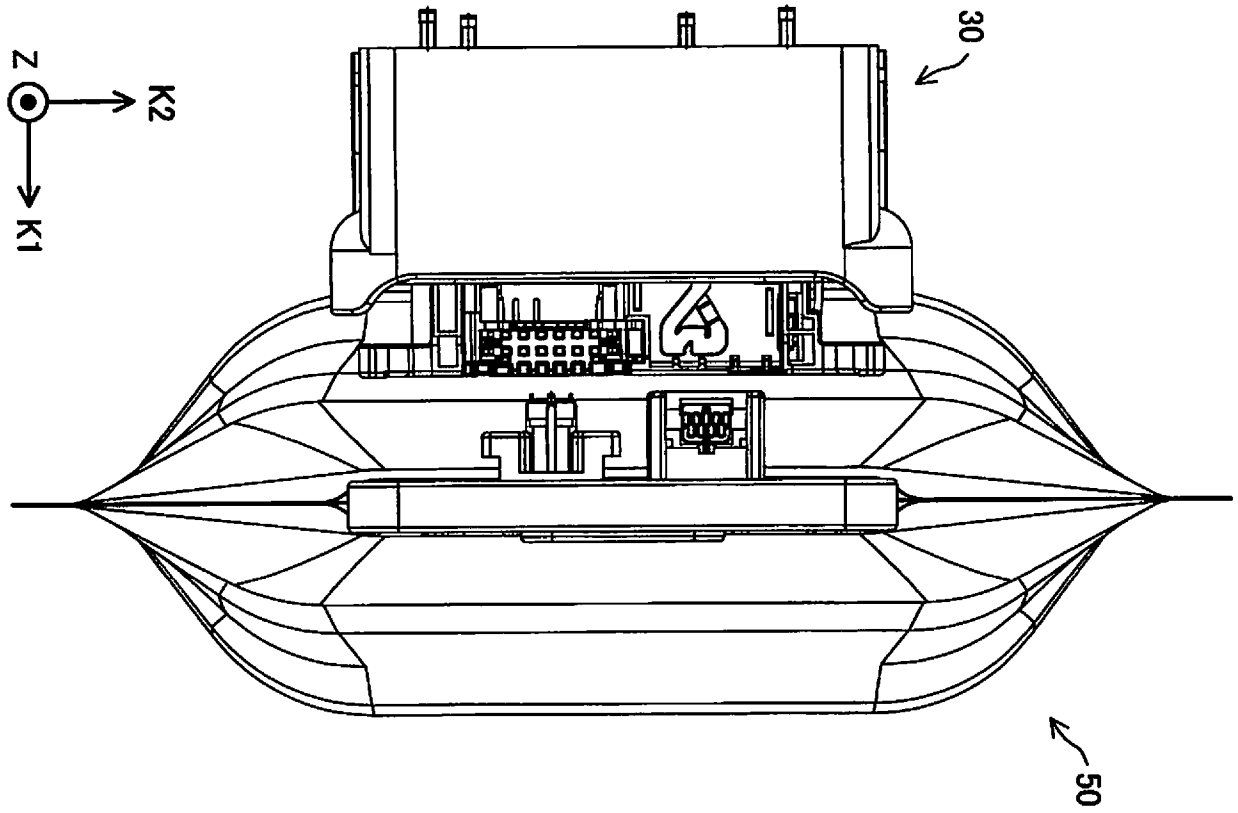
FIG. 45 is an upper surface diagram illustrating an attaching and detaching unit and a liquid container (in a non-contact state).
Figure 47:
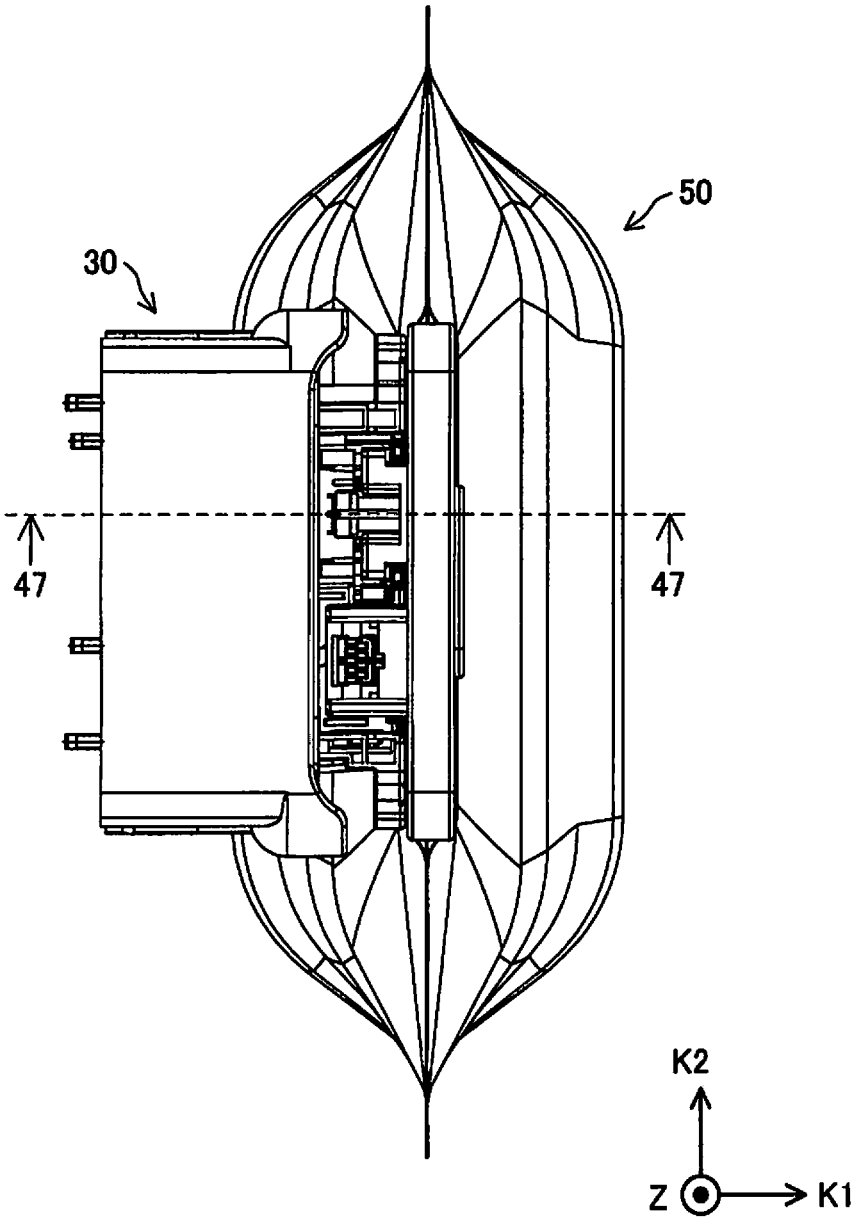
FIG. 47 is an upper surface diagram illustrating an attaching and detaching unit and a liquid container (in a set state).
Figure 48:
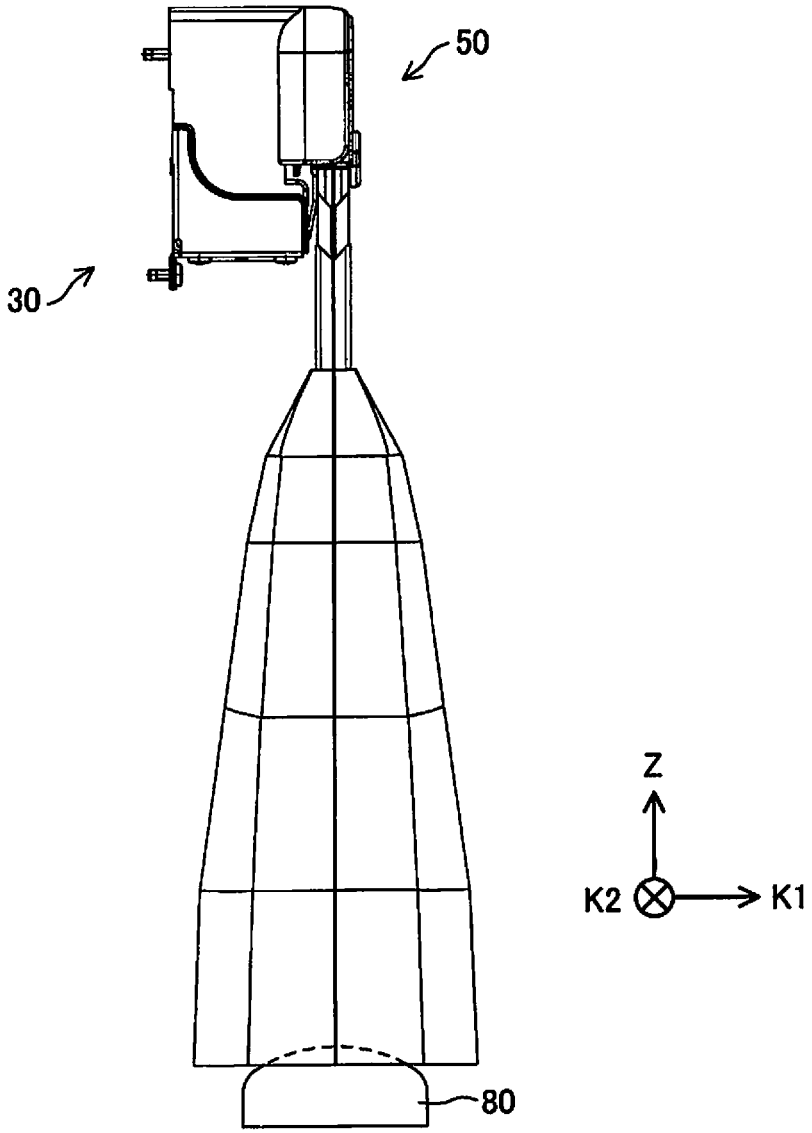
FIG. 48 is a side surface diagram illustrating an attaching and detaching unit, a liquid container, and an contacting part (in a mounting state).
Figure 49:
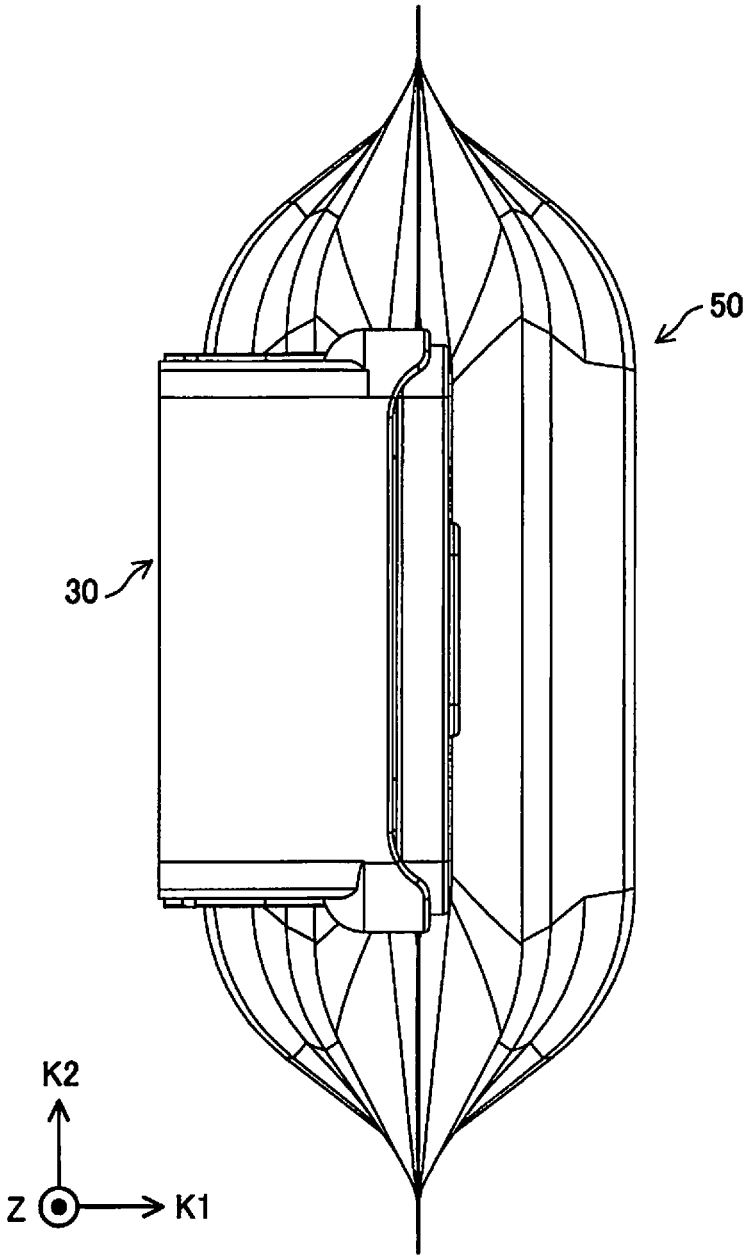
FIG. 49 is an upper surface diagram illustrating an attaching and detaching unit and a liquid container (in a mounting state).

The circumstances where the liquid container 50 is mounted in the attaching and detaching unit 30 will be described. FIG. 44, FIG. 46, and FIG. 48 are side surface diagrams illustrating the attaching and detaching unit 30, the liquid container 50, and the contacting part 80. FIG. 45, FIG. 47, and FIG. 49 are side surface diagrams illustrating the attaching and detaching unit 30 and the liquid container 50. FIG. 44 and FIG. 45 illustrate a state before the attaching and detaching unit 30 and the liquid container 50 come into contact (a non-contact state). FIG. 46 and FIG. 47 illustrate the set state. FIG. 48 and FIG. 49 illustrate the mounting state.

A user moves the liquid container 50 along the guide section 27 (which is not shown in FIG. 44 to FIG. 49, refer to FIG. 5) in order to transition from a non-contact state (FIG. 44 and FIG. 45) to the set state (FIG. 46 and FIG. 47). When transitioning to the set state, the positioning portion 56 is supported by the movable member 40 such that the liquid supply portion 53B is positioned further in the +Z axis direction than the liquid containing bag 52. Here "the liquid supply portion 53B is positioned further in the +Z axis direction than the liquid containing bag 52" includes a case where the liquid supply portion 53B is pushed into the liquid containing bag 52 in the Z axis direction as in the present embodiment. That is, a case, where a lower end of the liquid supply portion 53B is positioned further in the −Z axis direction than an upper end of the liquid containing bag 52, is included as in the present embodiment. When transitioning to the set state, the third film 523 which is a bottom portion of the liquid container 50 abuts with the contacting part 80 as shown in FIG. 46.

The contacting part 80 is arranged so as to not impede transitioning from the non-contact state to the set state. If it is assumed that when the contacting part 80 deviates significantly from the position which is indicated in FIG. 46 in the +Z axis direction, movement of the operation member 53 to the position which is the set state is impeded. The contacting part 80 is arranged in consideration of these circumstances. As a result, the contacting part 80 bears a portion of the weight of the liquid container 50 in the set state.

Since the contacting part 80 bears a portion of the weight of the liquid container 50 also during transition from the set state to the mounting state, the weight which is applied to the movable member 40 during transitioning becomes lighter. As a result, movement of the movable member 40 is smooth and durability of the movable member 40 is improved.

Figure 50:
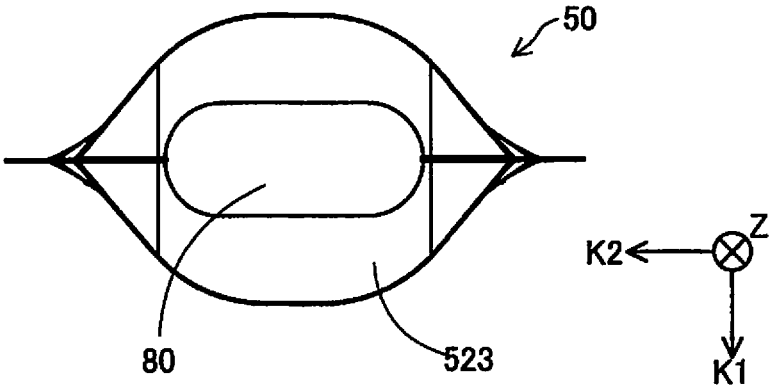
FIG. 50 is a lower surface diagram illustrating a liquid container and an contacting part in a mounting state.

FIG. 50 is a lower surface diagram illustrating the liquid container 50 and the contacting part 80 in the mounting state. As shown in FIG. 50, the contacting part 80 is positioned in the vicinity of the center of the third film 523 in the mounting state. In other words, the two dimensional center of gravity of the third film 523 and the two dimensional center of gravity of the contacting part 80 match or are close to each other as shown in FIG. 50. The two dimensional center of gravity is the center of gravity of a two dimensional shape where it is possible to project contours onto a horizontal plane.

Movement of the third film 523 outward (in the −Z axis direction) is limited due to the contacting part 80 abutting in the vicinity of the center of the third film 523 in the mounting state. With movement being limited in this manner, it is easy for the third film 523 to move inward when the liquid containing bag 52 contracts due to the remaining amount of ink being reduced. As a result, it is easy to reduce the amount of remaining ink.

Ink Reinjection

Figure 51:
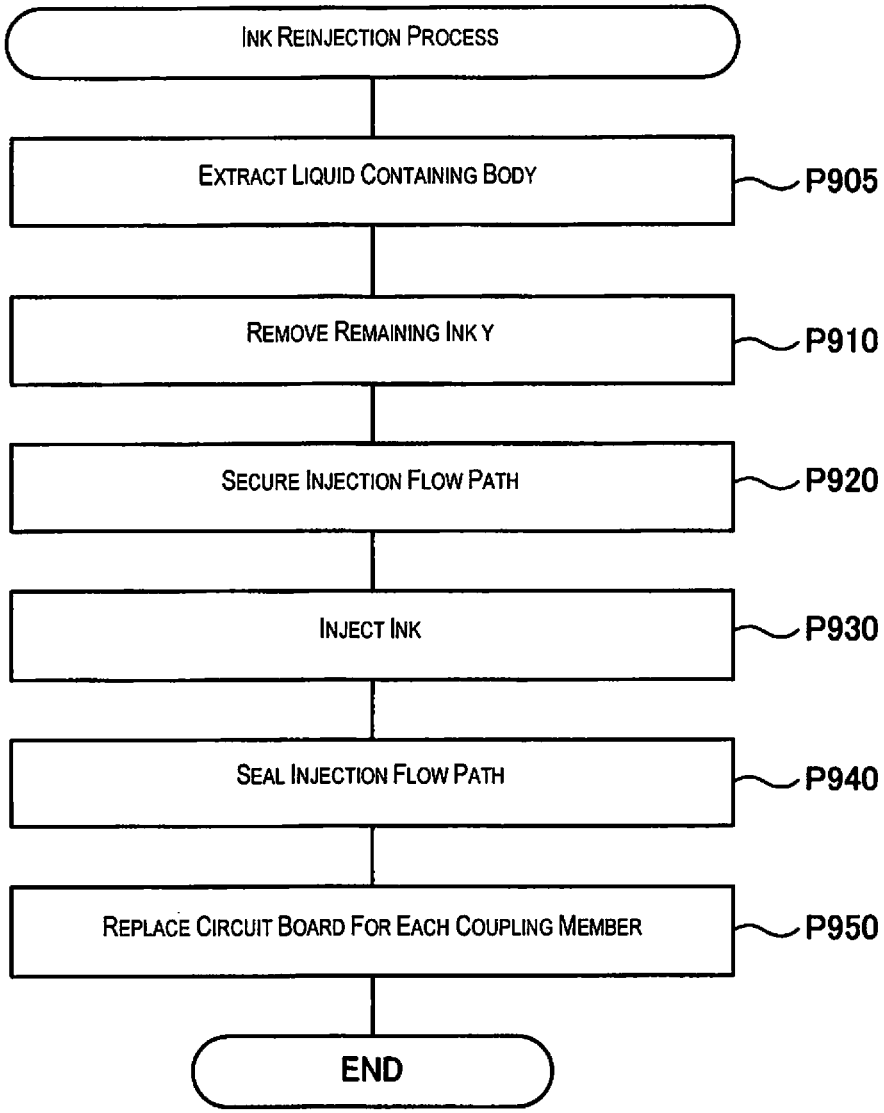
FIG. 51 is a process diagram illustrating an ink reinjection process.

FIG. 51 is a process diagram illustrating an ink reinjection process. Ink reinjection is filling ink again with regard to the liquid container 50 where the remaining amount of ink is small due to the ink being used up in printing.

First, the liquid container 50 is extracted from the liquid containing part 26 (process P905). Next, the remaining ink is removed (process 910). Next, an injection flow path is secured (process P920) and ink is injected (process P930).

It is possible to realize process P910 to process P930 using various methods. In the first embodiment, all of process P910 to process P930 are realized by utilizing the liquid supply pipe portion 57. In process P910 in the first embodiment, the syringe which is used in process P880 is inserted into an interior of the liquid supply pipe portion 57 and the remaining ink is drawn into the syringe. Process P920 and process P930 in the first embodiment are realized using the same method as process P850 and process P860 in the ink enclosing process.

Figure 52:
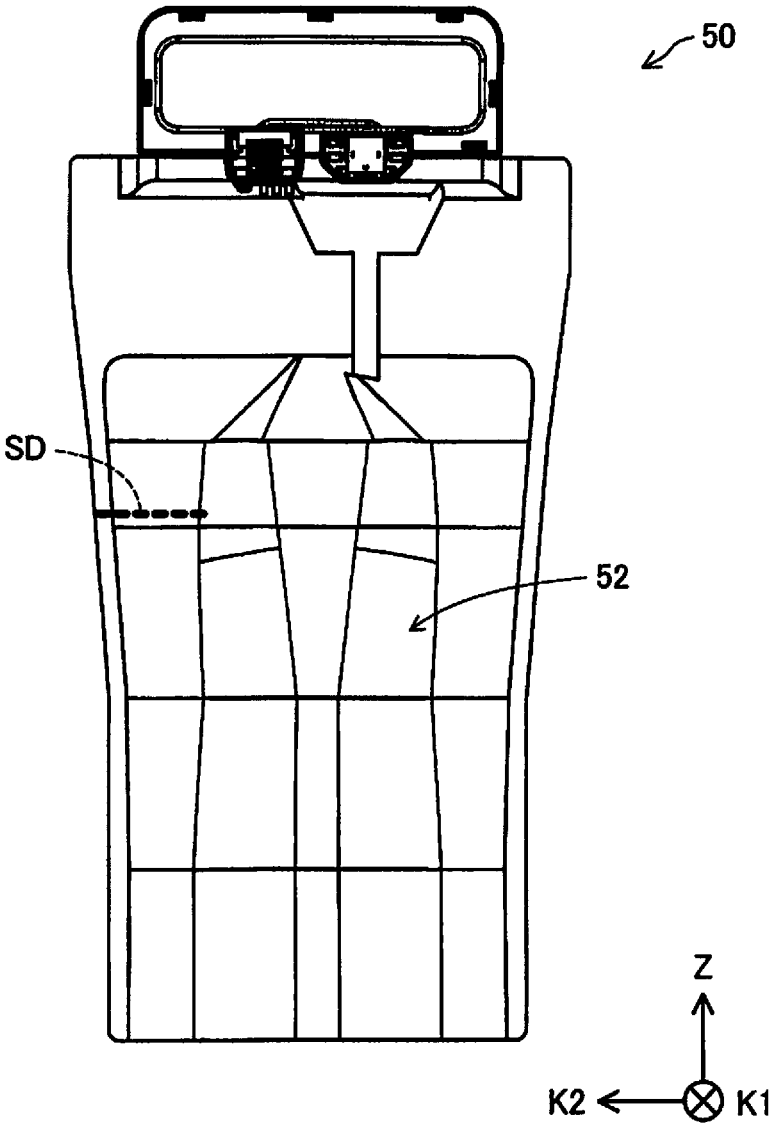
FIG. 52 is a diagram illustrating a cut surface for refilling ink.

In other embodiments, process P910 may be realized by, for example, cutting away a portion of the liquid containing bag 52 and discharging the remaining ink from the cut surface. FIG. 52 illustrates a cut surface SD for process P910. In a case where process P910 is realized in this manner, process P920 is realized at the same time. This is because the cut surface SD functions as the injection flow path. Process P930 is realized by filling ink from the cut surface. The operation member 53 aids forming of the cut surface SD. This is because it is possible to stabilize the posture of the liquid container 50 by grasping the operation member 53 when cutting.

After filling of ink, the injection flow path is sealed (process P940). Process P940 is implemented according to the method in process P920. In a case where the liquid filling member 13 is used in process P920, the injection flow path is sealed when the liquid filling member 13 is extracted. Furthermore, the liquid supply port 572 may be blocked off by the sealing film 99 or the like. In a case where cutting is used in process P920, process P940 is realized by the cut surface being blocked off by welding or the like.

Finally, the circuit board 582 is replaced for each of the coupling members 53A (process P950). The circuit board 582 after replacing stores information which relates to the replacing. The information which relates to the replacing is, for example, the date of replacing, the number of times of refilling, and the like. Easy replacement is possible since the coupling member 53A is a separate member to the liquid supply portion 53B which is involved in filling of ink.

Effects

According to the first embodiment, it is possible for at least the following effects to be obtained.

It is possible for a large amount of ink to be contained due to the third film 523 functioning as the gusset portion.

It is possible to reduce the amount of remaining ink due to the fold 90 being provided in the third film 523.

The amount of remaining ink is reduced since ink in the vicinity of the bottom portion of the liquid containing bag 52 is drawn out due to the flow path member 70 being provided.

It is possible to offset the liquid supply pipe portion 57 in the −Z axis direction compared to a case where the hollow section 560 is not provided due to a portion of the liquid supply pipe portion 57 being provided so as to be in contact with the hollow section 560. As a result, increasing of the height of the liquid container 50 (the length in the Z axis direction) is suppressed while the receiving space section 542 is secured in the grasping portion 54.

Simple execution is possible when positioning the liquid supply portion 53B with regard to the liquid containing bag 52 as preparation for welding since it is sufficient if the liquid supply pipe portion 57 is in contact with the notch section 529.

The area of the joining portion 549*a* increases due to the joining portion 549*a* having the overhanging section 570. As a result, increasing of the joining force is possible.

Enlarging of the liquid supply portion 53B in the Z axis direction is suppressed due to the first chamber 558, the second chamber 559, and the bypass 562 being provided on the rear side of the overhanging section 570.

Filling of ink is smooth due to the flow path member 70 having the holes 71.

Filling is smooth due to the lead element 550 and the bypass 562 functioning as the injection flow path during filling of ink.

Bonding of the second film 522 to the end surface of the second rib 660 is suppressed due to the protrusion 665 being provided. Due to this, flow between the first chamber 558 and the second chamber 559 is smooth.

The bypass 562 functions as the ink injection flow path and is sealed when the ink enclosing process is complete. While realizing this process, the possibility that the first and second films 521 and 522 are damaged or peel away is reduced since no part is welded two times or more. No part is welded two times or more because the welding surface of the second rib 660 is not a continuous surface with regard to the welding surface of the first rib 650.

When the liquid filling member 13 is extracted, it is difficult for ink which drips from the liquid filling member 13 or the liquid supply port 572 to adhere to the liquid container 50 since the liquid supply pipe portion 57 faces in the horizontal direction.

It is possible to stably execute filling of ink since the liquid filling member 13 and the liquid supply pipe portion 57 are positioned by the jig 14 from inserting to extracting of the liquid filling member 13. Additionally, since positional alignment does not generate considerable stress in the liquid supply portion 53B, it is not necessary for the entirety of the operation member 53 to have strength which is necessary for positional alignment.

Bonding of the first film 521 and the second film 522 is suppressed since the flow path member 70 is inserted into an interior of the liquid containing bag 52 during filling of ink. When the each sheet is bonded together, there are cases where filling of ink is impeded.

It is possible to discharge gas which is mixed in along with ink by utilizing the bypass 562.

It is possible for a user to simply insert the liquid container 50 into the containing space section 26 due to guiding using the guide section 27.

Damage to the third film 523 is suppressed due to the contacting part 80 having a convex shape which is curved at a part which abuts with the third film 523.

In the set state, the liquid supply pipe portion 57 is positioned to be higher than the liquid containing bag 52 while also facing the horizontal direction. In the set state, an upper portion of the cover member 22 is open. Due to this positional relationship, it is possible for the liquid supply pipe portion 57 and the liquid introducing portion 362 to be easily visually recognizable to a user and for the mounting operation to be easily executed.

In the set state, the mounting state, or when transitioning from either of the two states to the other state, the weight which is applied to the attaching and detaching unit 30 is reduced due to the contacting part 80 abutting with the third film 523. As a result, damage to the attaching and detaching unit 30 is suppressed. Additionally, it is easy for the movable member 40 to be moved while transitioning between states.

It is possible for a user to easily execute the mounting operation since it is possible to move the movable member 40 and the liquid container 50 if the pushing member 53C is pushed in the mounting operation.

It is possible to reduce the amount of remaining ink in the mounting state by the contacting part 80 abutting with the third film 523.

Ink is stably supplied since the liquid supply pipe portion 57 is positioned in the mounting state.

It is possible to easily discharge the remaining ink due to the flow path member 70 being provided.

Since it is possible to replace the substrate unit 58 by replacing the coupling member 53A, an operation where the substrate unit 58 is removed from the coupling member 53A is unnecessary.

Second Embodiment

Figure 53:
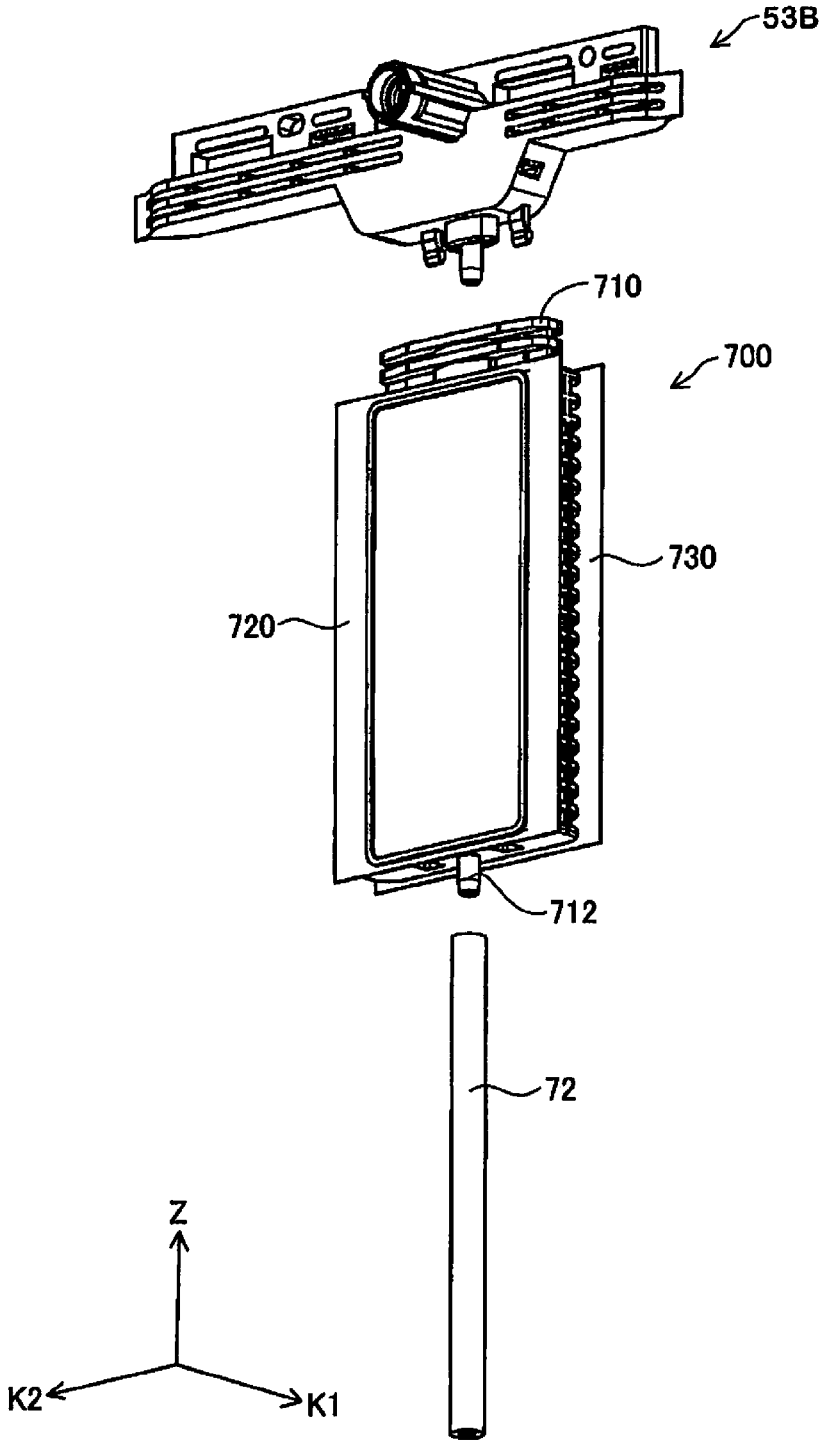
FIG. 53 is a perspective diagram illustrating a preparation phase for an ink enclosing process.
Figure 54:
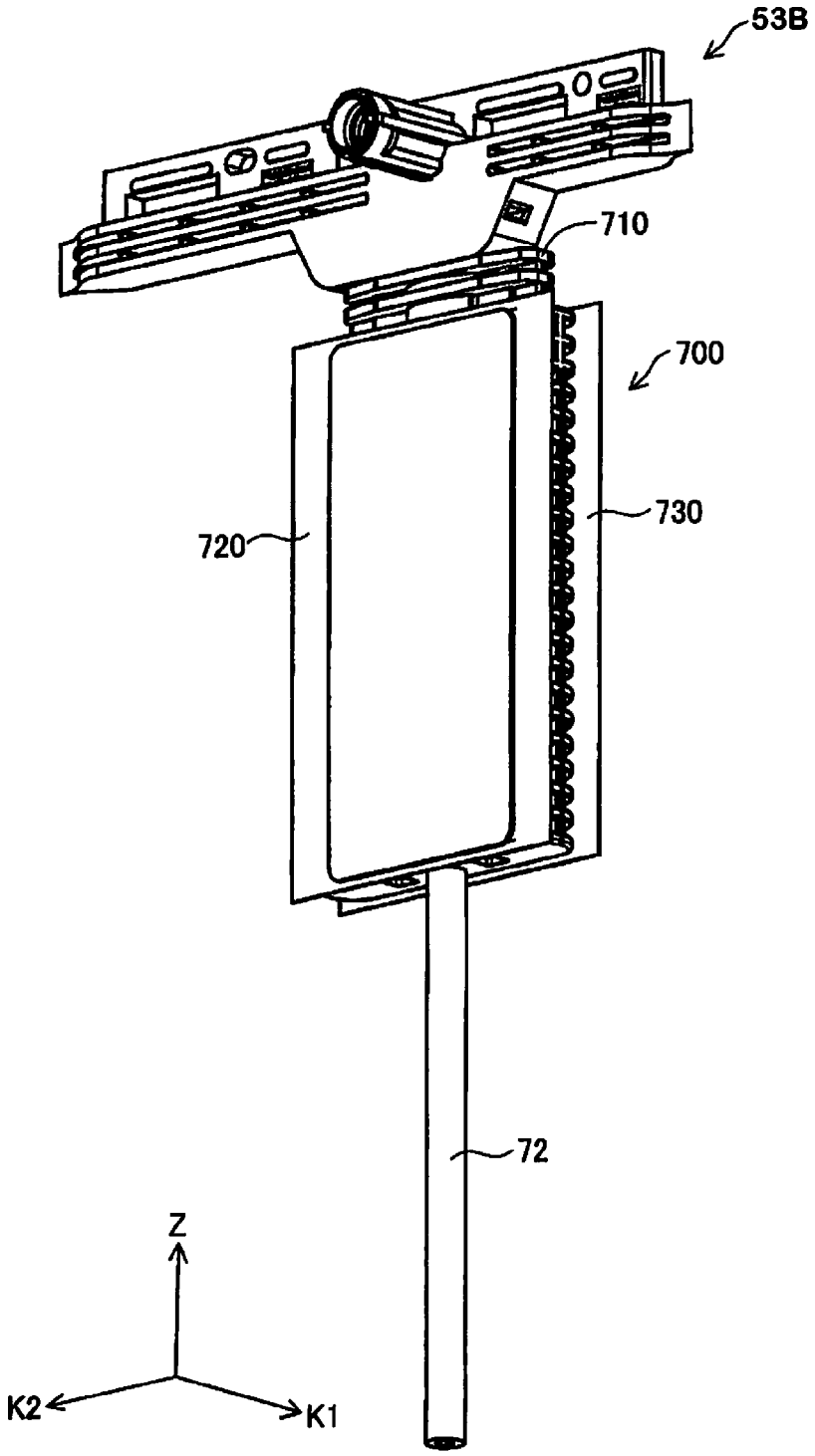
FIG. 54 is a perspective diagram illustrating a phase where connecting of a flow path is completed.

The second embodiment is different to the first embodiment in the point where a filter unit 700 is provided at an interior of the liquid containing bag 52. FIG. 53 is a perspective diagram illustrating a preparation phase in process P810 in the ink enclosing process (FIG. 14). FIG. 54 is a perspective diagram illustrating a phase where process P810 is completed. A flow path is provided in the filter unit 700 (refer to FIG. 55 and FIG. 58), and the filter unit 700 is connected between the liquid supply structure 53B and a flow path member 72 as shown in FIGS. 53 and 54.

Figure 55:
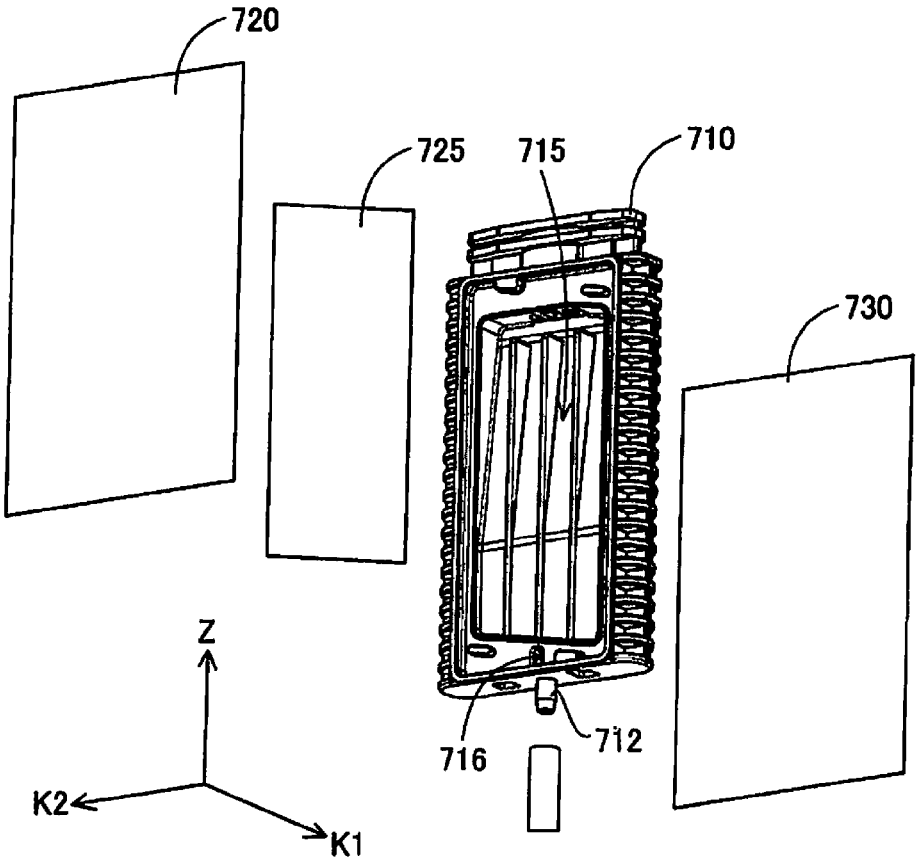
FIG. 55 is a perspective diagram illustrating a state where a filter unit is dismantled.

FIG. 55 and FIG. 56 are perspective diagrams illustrating a state where the filter unit 700 is dismantled. The filter unit 700 is provided with a frame 710, a filter chamber film 720, a filter 725, and a deaerating chamber film 730. The frame 710 is provided with an upper side connecting section 711, a lower side connecting section 712, a flow path chamber 715, a through hole 716, and a deaerating chamber 735.

The frame 710 is formed by a resin mold or the like. The filter 725 allows ink to permeate but does not allow impurities of a predetermined size or more to permeate. The filter chamber film 720 and the deaerating chamber film 730 allow gas to permeate but do not allow ink to permeate. The filter chamber film 720 and the deaerating chamber film 730 are formed using the same material.

The deaerating chamber film 730 seals the deaerating chamber 735 in a state where the pressure in the deaerating chamber 735 is reduced. Reduced pressure has the meaning of the pressure being lower than atmospheric pressure. As such, gas which comes into contact with the deaerating chamber film 730 from the outside permeates the deaerating chamber film 730 and is trapped in the deaerating chamber 735 if the atmosphere of the deaerating chamber film 730 is atmospheric pressure. As such, at least a portion of gas which is mixed inside the liquid containing bag 52 during filling of ink is trapped inside the deaerating chamber 735.

Figure 57:
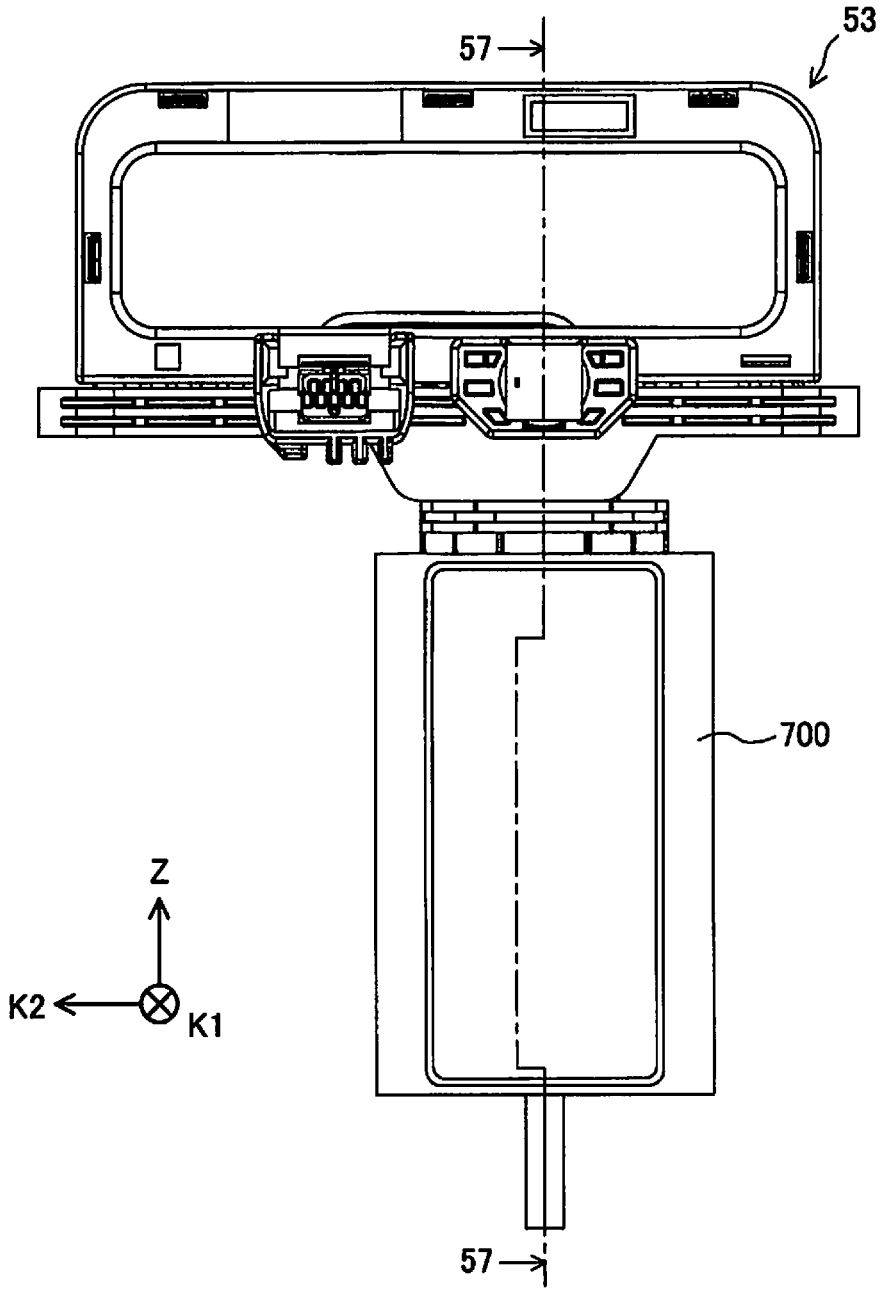
FIG. 57 is a front surface diagram illustrating circumstances where an operation member and a filter unit are connected.
Figure 58:
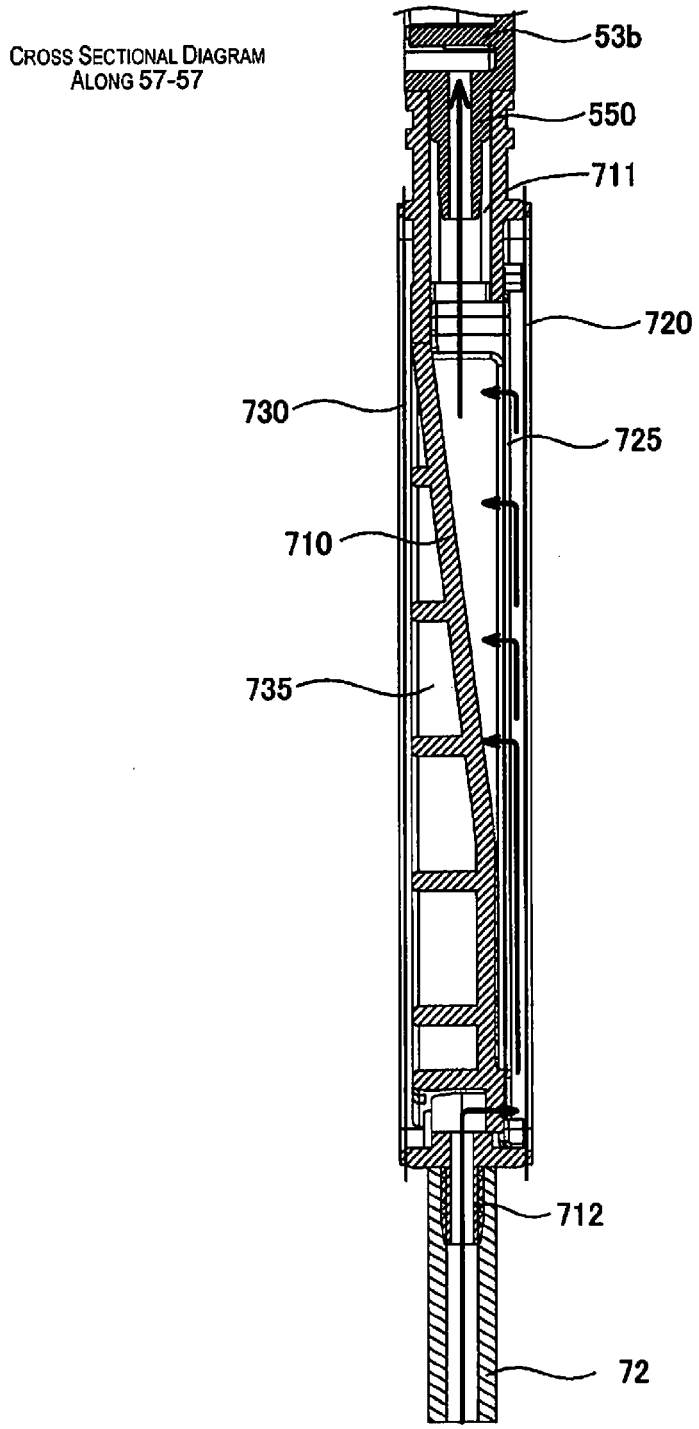
FIG. 58 is a cross sectional diagram of FIG. 57.

FIG. 57 is a front surface diagram illustrating circumstances where the operation member 53 and the filter unit 700 are connected. FIG. 58 is a cross sectional diagram along 57-57 of FIG. 57.

As shown in FIG. 58, the ink which flows in from the flow path member 72 passes through the through hole 716 (refer to FIG. 55, not shown in FIG. 58) and flows into a gap between the filter chamber film 720 and the filter 725. The ink which flows into the gap passes through the filter 725 and flows into the flow path chamber 715. The ink which flows into the flow path chamber 715 passes through the inside of the lead element 550 and flows into the liquid supply portion 53B.

According to the second embodiment, it is possible to remove gas and impurities from ink which is supplied to the printer 10. A significant increase in flow path resistance over the entirety of the injection flow path is avoided even when the filter 725 is provided since the bypass 562 functions as the injection flow path during filling of ink.

Third Embodiment

Figure 59:
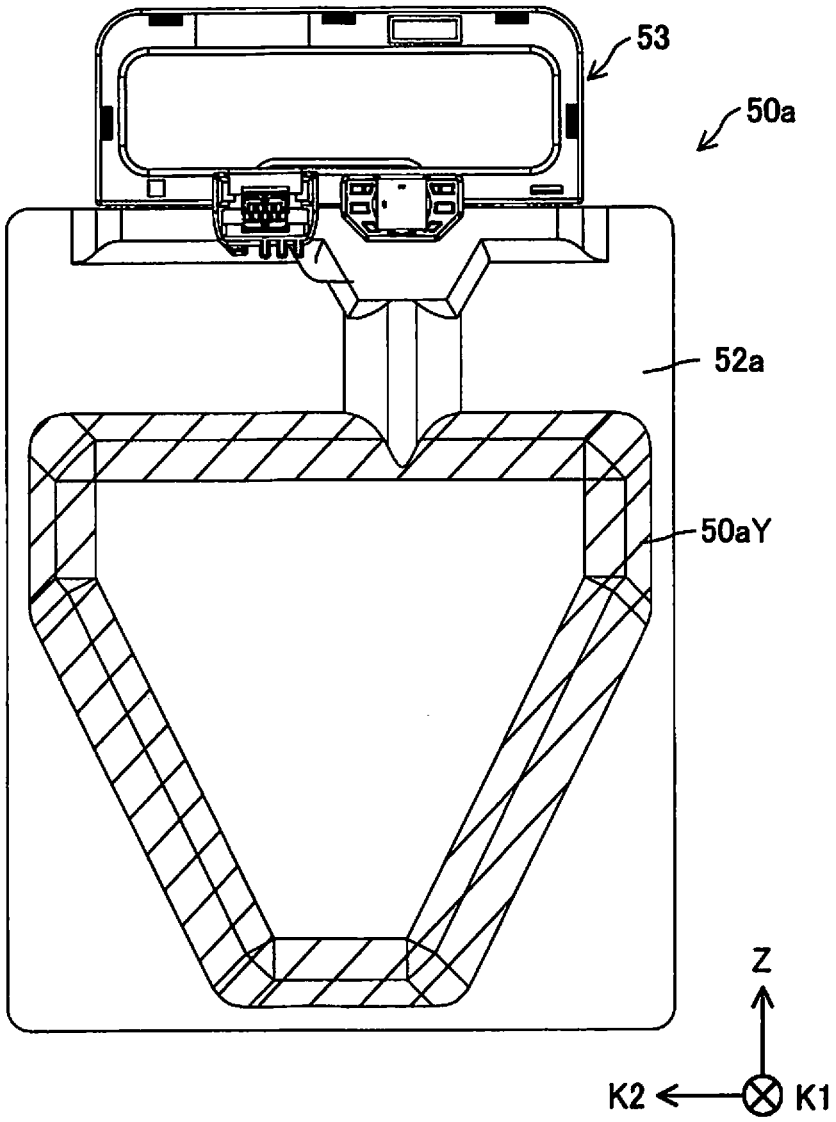
FIG. 59 is a front surface diagram illustrating a liquid container (third embodiment).
Figure 60:
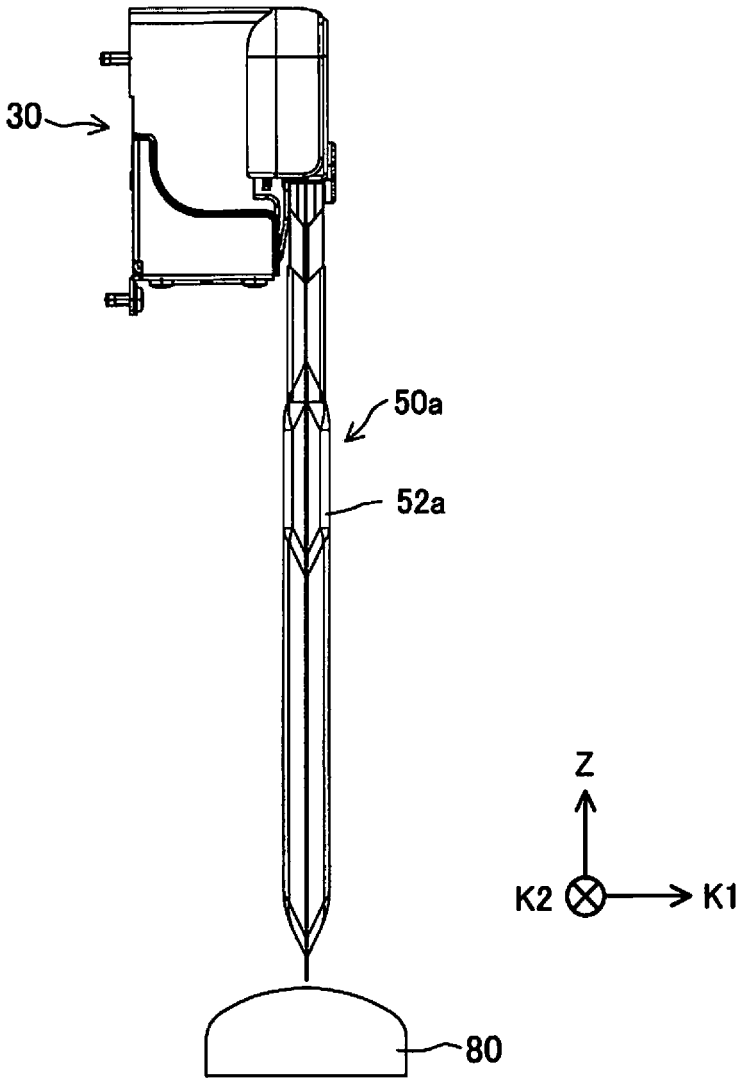
FIG. 60 is a side surface diagram illustrating a liquid container in a mounting state (third embodiment).

FIG. 59 is a front surface diagram illustrating a liquid container 50*a*. FIG. 60 is a side surface diagram illustrating the liquid container 50*a* in the mounting state and illustrates a state where the remaining amount of ink is substantially zero. The liquid container 50*a* is mounted on the attaching and detaching unit 30 as a substitute for the liquid container 50.

The liquid container 50*a* is provided with a liquid containing bag 52*a*. The liquid containing bag 52*a* is formed by joining two films and does not have a gusset portion, which is different to the liquid container 50. The hatching shown in FIG. 59 indicates a welding section 50*a*Y where two films are welded. The welding section 50*a*Y is formed so as to have a pentagonal shape, and liquid not being contained in the vicinity of the corners in the vicinity of the bottom portion is in order to reduce the amount which is contained.

The liquid containing bag 52*a* is joined to the operation member 53. The operation member 53 is the same as the operation member 53 which is included in the liquid container 50 and is connected to the flow path member in an interior of the liquid containing bag 52*a*.

As shown in FIG. 60, the liquid container 50 does not abut with the contacting part 80 in the mounting state. This is because the length of the liquid containing bag 52*a* in the Z axis direction is shorter than the liquid containing bag 52 in the first embodiment. Since the liquid containing bag 52*a* does not have the gusset portion, it is difficult to achieve the effect where the amount of remaining ink is reduced even if the liquid containing bag 52*a* abuts with the contacting part 80. Assuming a case of abutting, there is a concern that the posture of the liquid container 50*a* will be inclined in the mounting state since the liquid containing bag 52*a* does not have the gusset portion. In a case where there is no gusset portion in this manner, it is preferable that the liquid containing bag 50*a* does not abut with the contacting part 80.

Fourth Embodiment

Figure 61:
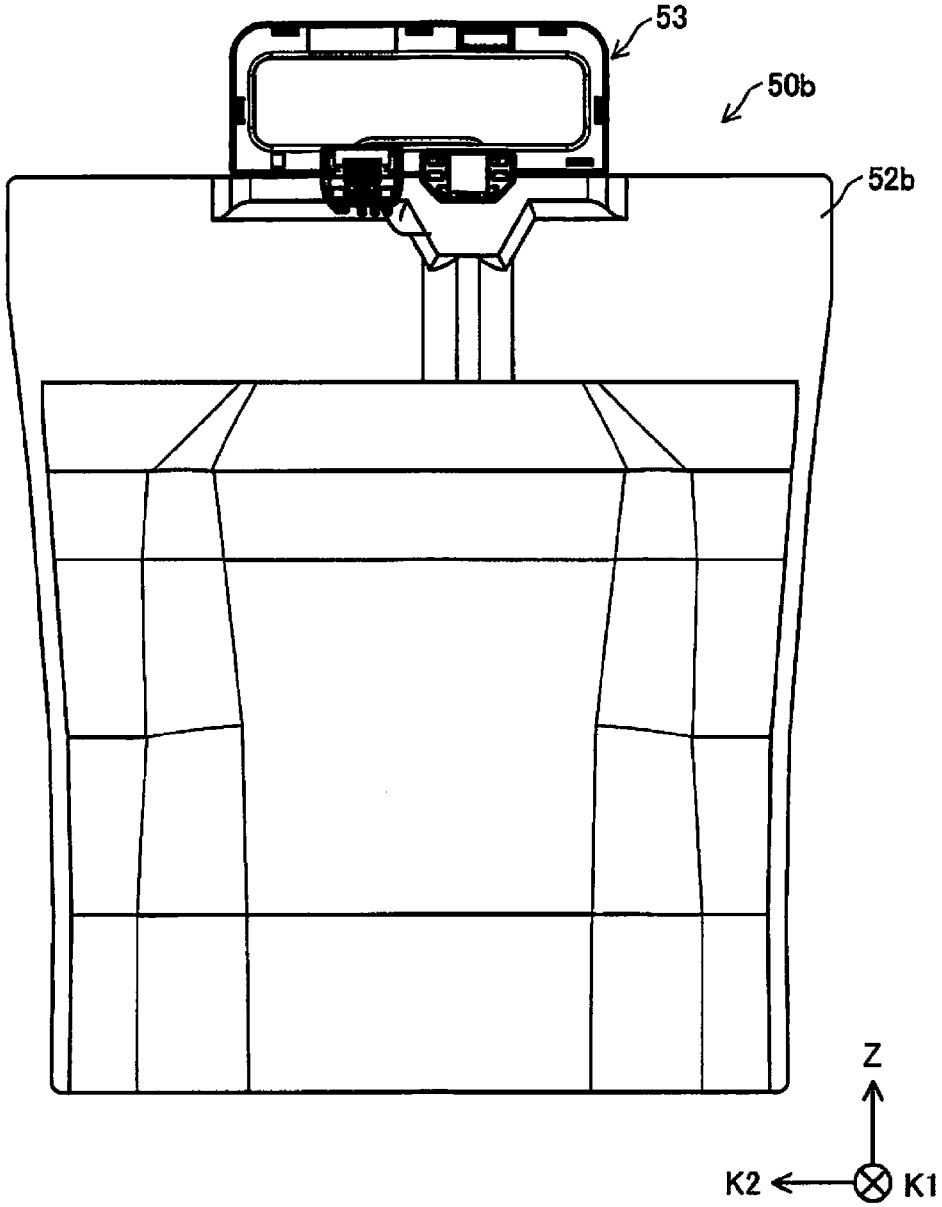
FIG. 61 is a front surface diagram illustrating a liquid container (fourth embodiment).

FIG. 61 is a front surface diagram illustrating a liquid container 50*b*. The liquid container 50*b* is mounted in the attaching and detaching unit 30 as a substitute for the liquid containing bodies 50 and 50*a*. The liquid container 50*b* is provided with a liquid containing bag 52*b* and the operation member 53. The operation member 53 is the same as the operation member 53 which is included in the liquid container 50. The liquid containing bag 52*b* has a width which is wider than the liquid containing bag 52 in the K2 axis direction and the amount of ink which is able to be contained is larger.

As exemplified by the third and fourth embodiments, it is possible to use various liquid containing bags due to the operation member 53 being shared.

The ink is an example of the liquid, the printer 10 is an example of the liquid consuming apparatus, the liquid supply pipe portion 57 is an example of the liquid supply path, the first, second, and third films 521, 522, and 523 are examples of the films, and the lead element 550 is an example of the first flow path, and the bypass 562 is an example of the second flow path.

The present invention is not limited to the embodiments, applied examples, and modified examples described above, and it is possible to realize various configurations within a range which does not depart from the gist of the present invention. It is possible to appropriately perform replacing or combining of, for example, the technical characteristics within the embodiments, applied examples, and modified examples which correspond to the technical characteristics of each of the aspects which are described in the summary of the invention in order to solve a portion or all of the problems described above or in order to achieve a portion or all of the effects described above. In addition, it is possible to appropriately remove the technical characteristics as long as the technical characteristics are not described as essential elements in the present specification. For example, there are the following examples.

Figure 62:
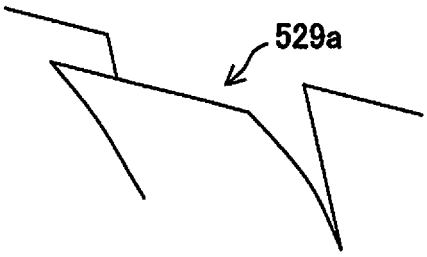
FIG. 62 is a diagram illustrating a slit in a film (modified example).

A slit 529*a* may be provided as shown in FIG. 62 in place of the notch section 529 (FIG. 10).

The contacting part 80 need not be provided integrally with the containing space section 26 and may be separately provided. For example, a flexible member such as a sponge may function as the contacting part by being fixed using an adhesive agent or the like. Alternatively, a spring may be installed in the containing space section 26 and the contacting part 80 may be provided on the spring. By doing this, damage to the liquid containing bag 52 is further suppressed.

The posture of the liquid container 50 during filling of ink may be any posture. The embodiment may be reversed, that is, the liquid containing bag 52 may be further in the +Z axis direction than the operation member 53 and the liquid container 50 may be laid down such that the central axis CT of the liquid supply pipe portion 57 faces in the +Z axis direction or the −Z axis direction.

Alternatively, there may be a posture where the liquid containing bag 52 is folded.

The posture of the liquid container 50 may change from when the liquid filling member 13 is injected to when the liquid filling member 13 is extracted.

All three or any two of the coupling member 53A, the liquid supply portion 53B, and the pushing member 53C may be molded using the same material.

In the embodiments described above, the liquid containing bag 52 is formed using a member which has flexibility but the present invention is not limited to this and it is sufficient if the liquid containing bag 52 functions as the liquid containing part which is able to contain liquid in the interior. For example, a portion of the liquid containing bag 52 may be formed using a member which has flexibility or may be formed using a member which has rigidity where the capacity does not change regardless of the amount of liquid consumption. The capacity of the liquid containing bag 52 changes according to the amount of ink which is contained in the liquid containing bag 52 due to at least a portion of the liquid containing bag 52 being formed using a member which has flexibility.

In the embodiment described above, the operation member 53 has a frame shape but the shape is not limited to this and may be any shape which is able to be grasped by a user. For example, the operation member 53 may be a rod shape (a plate shape) which extends along the Z axis direction.

In the embodiment described above, the coupling member 53A, the liquid supply unit 55, the circuit board holding portion 59, and the like are formed by the three members 53A, 53B, and 53C being combined but the present invention is not limited to this. For example, an assembly which is formed by the three members 53A, 53B, and 53C being combined may be integrally formed. As a method for integrally forming, there are examples of an integral mold, a method for attaching each of the members 53A, 53B, and 53C using a fixing agent or the like, and the like. Due to this, it is possible to easily manufacture the liquid container 50. In addition, it is possible to precisely perform positional alignment between both of the units 55 and 58 since it is possible to integrally form the liquid supply unit 55 and the substrate unit 58. In addition, it is possible to integrally form the coupling member 53A and the joining portion 549. Due to this, it is possible to reduce the possibility that the joining portion 549 and the coupling member 53A will separate due to the weight of the liquid containing bag 52 when a user grasps the coupling member 53A. In addition, the weight which is generated due to the weight of the liquid containing bag 52 itself is applied to the coupling member 53A via the joining portion 549 when a user grasps the coupling member 53A. Due to this, it is possible to reduce the possibility of the liquid containing bag 52 being damaged since it is possible to reduce the external force which is applied to the liquid containing bag 52 itself. Other than this, the liquid supply portion 53B and the liquid containing bag 52 may be molded integrally.

The present invention is not limited to an ink jet printer and the liquid container 50, and it is also possible to apply the present invention to an arbitrary printing apparatus which ejects another liquid other than ink (a liquid ejecting apparatus) and to a liquid container for containing the liquid. For example, it is possible to apply the present invention to the following various types of liquid ejecting apparatuses and liquid containing bodies.

(1) An image recording apparatus such as a facsimile apparatus (2) A color material ejecting apparatus which is used in manufacturing color filters for an image display apparatus such as a liquid crystal display (3) An electrode material ejecting apparatus which is used in forming electrodes for an organic EL (Electro Luminescence) display, a surface light-emitting display (a Field Emission Display (FED)), and the like (4) A liquid ejecting apparatus which ejects liquid which includes biological organic substances which are used in bio-chip manufacture (5) A sample ejecting apparatus which is used as a precision pipette (6) A lubricating oil ejecting apparatus (7) A resin liquid ejecting apparatus (8) A liquid ejecting apparatus which ejects lubricating oil in a pinpoint manner onto a precision machine such as a watch or a camera (9) A liquid ejecting apparatus which ejects a transparent resin liquid such as an ultraviolet curable resin liquid onto a substrate in order to form a micro-spherical lens (an optical lens) which is used in an optical communication element or the like

(10) A liquid ejecting apparatus which ejects acidic or alkaline etching liquid in order to carry out etching on a substrate or the like

(11) A liquid ejecting apparatus which is provided with another arbitrary liquid ejecting head which discharges small amounts of liquid droplets "Liquid droplet" refers to a state of liquid which is discharged from the liquid ejecting apparatus and includes a particle shape, a tear shape, and drawn-out thread shape. Here, it is sufficient if the "liquid" is a material which it is able to be ejected by a liquid ejecting apparatus. For example, it is sufficient if the "liquid" is a material in a state when a substance is in a liquid phase and a material in a liquid state with high or low viscosity, a sol, a gel, and other materials in a liquid state such as an inorganic solvent, an organic solvent, a solution, a liquid resin, and a liquid metal (a molten metal) are also included as the "liquid". In addition, not only liquids as a substance in one state are included but particles of a functional material which are formed of solid matter such as pigments and metal particles being dissolved, dispersed, or mixed into a solvent and the like are also included as the "liquid". Typical examples of the liquids include inks, liquid crystals, and the like which are described in the embodiments described above. Ink encompasses various types of liquid compositions such as typical water-based inks and oil-based inks, gel inks, and hot melt inks.

The first to third films 521 to 523 may be formed using a layer structure where a plurality of films are layered. In this layer structure, for example, an outer layer may be formed using PET or nylon with superior impact resistance and an inner layer may be formed using polyethylene with superior ink resistance. Furthermore, a film which has a layer where aluminum or the like is vapor deposited may be one of the configuring members of the layer structure. Due to this, it is possible to suppress changes in the concentration of ink which is contained, for example, in the liquid containing bag 52 since it is possible to improve gas barrier properties. In this manner, it is possible to arbitrarily set the material of the liquid containing bag 52. The liquid containing bag 52 may be welded by with regard to the joining portions 549*a* and 549*b* by one film being folded back. It is possible for it to be perceived that one end portion is formed with a plurality of film members in this aspect.

It is possible to arbitrarily set both the shape and size of the liquid containing bag 52. For example, a liquid containing bag 52K which contains black ink may have a larger capacity (size) than a liquid containing bag 52C which contains ink of another color (for example, cyan).

The positioning portion 56 may be provided integrally with the operation member 53 by the positioning portion 56 being attached with regard to the operation member 53 using welding or the like. In addition, the positioning portion 56 is provided with an aspect so as to surround a peripheral direction in the vicinity of the liquid supply port 572 except for above the liquid supply port 572, but may be provided in the operation member 53 at a position which is slightly separated from the liquid supply port 572 in a case where the operation member 53 is formed from a material where changing shape is difficult.

The numbers of the cover members 22, the liquid containing bodies 50, and the attaching and detaching units 30 are not limited to the numbers described above. For example, there may be three or less of the liquid containing bodies 50 or there may be five or more of the liquid containing bodies 50. In addition, the attaching and detaching units 30 may also be provided to correspond to the number of the liquid containing bodies 50. In addition, there may be one of the cover members 22 or there may be three or more of the cover members 22.

The number of the engaging portions 511A, 511B, and 511C may be two or less or may be four or more.

There may be four or more of the engaging portions 513 or there may be two or less of the engaging portions 513.

The coupling member 53A need not be replaced when replacing the substrate unit 58. That is, the substrate unit 58 may be removed from the coupling member 53A and the substrate unit 58 which is new may be attached. Even in this case, an operation where the substrate unit 58 is replaced becomes easier due to the coupling member 53A being removed.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid container comprising:

a liquid containing bag configured and arranged to contain a liquid, the liquid containing bag having at least two sheets of film which are flexible; and a liquid supply portion configured and arranged to supply the liquid to a liquid consuming apparatus, wherein the liquid supply portion is welded with each of the two sheets of film at one end of the liquid containing bag, and the liquid supply portion includes a liquid supply path, a first chamber and a second chamber in the liquid supply portion, the first chamber communicating with the liquid supply path and with an interior of the liquid containing bag, the second chamber communicating with the interior of the liquid containing bag, the first chamber is partitioned by a first rib, an end surface of the first rib opposing one sheet of film out of the two sheets of film and being welded with the film, the second chamber is partitioned from the first chamber by a second rib, an end surface of the second rib opposing the one sheet of film and being configured to be welded to the film, the first chamber communicates with the second chamber via a gap between the second rib and the one sheet of film, and the second rib is separated from the first rib.

2. The liquid container according to claim 1, wherein a first flow path and a second flow path are formed, the first flow path communicating from the first chamber to the interior of the liquid containing bag, and the second flow path communicating from the first chamber to the interior of the liquid containing bag via the second chamber.

3. The liquid container according to claim 2, wherein an opening portion of the second flow path which communicates with the interior of the liquid containing bag is arranged closer to the one end than an opening portion of the first flow path in the liquid containing bag.

4. The liquid container according to claim 2, further comprising a filter which is provided in the first flow path.

5. The liquid container according to claim 2, further comprising a flow path member whose one end is connected to an end portion of the first flow path in the liquid containing bag, wherein the other end of the flow path member is positioned lower than the one end in the direction of gravity.

6. The liquid container according to claim 1, wherein a protrusion is provided on the end surface of the second rib.

7. A filling method for filling liquid into the liquid container according to claim 6, comprising:

filling liquid from the liquid supply path to the interior of the liquid containing bag via the first chamber and filling liquid from the liquid supply path to the interior of the liquid containing bag via the first chamber and the second chamber; and welding the end surface of the second rib and the film by melting the protrusion.

8. The filling method according to claim 7, further comprising:

discharging gas in the liquid supply path from the interior of the liquid containing bag via the second chamber and the first chamber after the filling of liquid and before the welding.

9. A liquid container comprising:

a liquid containing bag configured and arranged to contain a liquid, the liquid containing bag having at least two sheets of film which are flexible; and a liquid supply portion configured and arranged to supply the liquid to a liquid consuming apparatus, wherein the liquid supply portion is welded with each of the two sheets of film at one end of the liquid containing bag, and the liquid supply portion has a liquid supply path, a first chamber which communicates with the liquid supply path and an interior of the liquid containing bag, and a second chamber which communicates with the interior of the liquid containing bag in the liquid supply portion, the first chamber is partitioned by a first rib, an end surface of the first rib being welded to one sheet of film out of the two sheets of film, the second chamber is partitioned from the first chamber by a second rib, an end surface of the second rib being welded to the one sheet of film, and the second rib is separated from the first rib.

* * * * *